US005746268A

United States Patent [19]

Fujisaki et al.

[11] Patent Number: 5,746,268

[45] Date of Patent: May 5, 1998

[54] CONTINUOUS CASTING METHOD AND APPARATUS

[75] Inventors: Keisuke Fujisaki; Kiyoshi Wajima; Kenji Umetsu; Kenzo Sawada; Takatsugu Ueyama; Takehiko Toh; Kensuke Okazawa; Yasushi Okumura, all of Futtsu, Japan

[73] Assignee: Nippon Steel Corporation, Tokyo, Japan

[21] Appl. No.: 646,230

[22] PCT Filed: Jan. 12, 1995

[86] PCT No.: PCT/JP95/00027

§ 371 Date: May 9, 1996

§ 102(e) Date: May 9, 1996

[87] PCT Pub. No.: WO95/24285

PCT Pub. Date: Sep. 14, 1995

[30] Foreign Application Priority Data

| | | | |
|---|---|---|---|
| Mar. 7, 1994 | [JP] | Japan | 6-035541 |
| Mar. 7, 1994 | [JP] | Japan | 6-035704 |
| Mar. 11, 1994 | [JP] | Japan | 6-041575 |
| Mar. 18, 1994 | [JP] | Japan | 6-049257 |

[51] Int. Cl.[6] ..... B22D 27/02

[52] U.S. Cl. ..... 164/468; 164/504

[58] Field of Search ..... 164/466, 468, 164/502, 504

[56] References Cited

FOREIGN PATENT DOCUMENTS

| | | | |
|---|---|---|---|
| 62-207543 | 9/1987 | Japan | 164/468 |
| A-63-104763 | 5/1988 | Japan . | |
| A-1-228645 | 9/1989 | Japan . | |
| B-3-33055 | 5/1991 | Japan . | |
| A-3-275256 | 12/1991 | Japan . | |
| A-4-284956 | 10/1992 | Japan . | |
| A-5-23804 | 2/1993 | Japan . | |
| A-5-329594 | 12/1993 | Japan . | |
| A-6-182517 | 7/1994 | Japan . | |
| 2109724 | 6/1983 | United Kingdom | 164/504 |

OTHER PUBLICATIONS

Fujisaki et al., Fundamental Electromagnetic Characteristics Of In–Mold Electromagnetic Stirring In Continuous Casting, Oct. 1994, pp. 272–277.

Fujisaki et al., Flow Control Of Molten Metal In Mold Using Linearmotors, May 1994, pp. 57–66.

*Primary Examiner*—Kuang Y. Lin

*Attorney, Agent, or Firm*—Pollock, Vande Sande & Priddy

[57] ABSTRACT

A method and an apparatus for continuously casting a metal slab made of steel are provided for uniformly circulating molten metal on a meniscus in a mold. The cast metal slab has no surface defect such as a slitting. On the meniscus, the method and apparatus operates to generate electromagnetic stirring thrusts along two long mold sides, these thrusts being opposed to each other. The thrust oriented from a dipping nozzle to the short mold side is made larger than the thrust oriented from the short mold side to the dipping nozzle. A circuit for connecting each coil of a shifting field electromagnetic stirring coil part with a three-phase power supply is symmetric to another circuit with respect to the dipping nozzle. The circuit is divided into two parts along each long mold side. The divided circuit parts are located in parallel but have respective impedances.

37 Claims, 72 Drawing Sheets

FIG. 18

| POWER SUPPLY / CIRCUIT COMBINATION / THRUST FORM | ONE POWER SUPPLY | TWO POWER SUPPLYS | | | FOUR POWER SUPPLYS |
|---|---|---|---|---|---|
| | A B D C | ① A B D C | ② A B D C | ③ A B D C | A B D C |
| | A=B=C=D | A=C<B=D | A=B<C=D | A=D<B=C | A<B<C<D |
| ROTATION | | | | | |
| BRAKE | | | | | |
| ACCELERATION | | | | | |
| TRANSLATION | | | | | |

$\alpha = 1.0$ $\alpha = 0.25$ $\alpha = 0$

DISTRIBUTION OF ELECTROMAGNETIC FORCE (FOUR POLES,1.8Hz MAXIMUM2.493e+4 [N/m$^3$])

ACCELERATING MODE

CONTINUOUS CASTING METHOD AND APPARATUS

TECHNICAL FIELD

The present invention relates to a continuous casting method and apparatus for forming a metal slab with no surface defect, such as a vertical crack, when continuously casting a metal slab made of steel, for example.

BACKGROUND ART

FIG. 1 is a sectional view showing a conventional apparatus for continuously casting a metal slab. In FIG. 1, molten metal 1 is injected from a dipping nozzle 2 to a mold 3. The molten metal is cooled down progressively from the wall surface of the cooled mold 3 to its inner portion. The cooled metal is made to be a coagulated shell 4, which is pulled out of the mold 3 as a metal slab.

FIG. 2 is a plan view showing the apparatus viewed downwardly on the A—A plane of FIG. 1. In FIG. 2, the dipping nozzle 2 is located on the central portion of the horizontal plane of the mold. The molten metal 1 is ejected from a nozzle outlet into the mold and is circulated in the mold as viewed by arrows of FIG. 1. As indicated by real-line arrows of FIGS. 1 and 2, the molten metal is inversely flown from a short side 11 of the mold 3 to the dipping nozzle 2 on the meniscus 5 (top surface of the molten metal).

In the foregoing apparatus for continuously casting a metal slab, a vertical crack is likely to form on the coagulated shell 4 if the temperature of the molten metal varies at substantially the same height of the mold wall surface. To prevent this vertical crack, the JP-A-1-228645 has disclosed that the molten metal is circulated on the meniscus 5 and an electromagnetic stirring method is used as the means for circulating the molten metal.

FIG. 3 shows the conventional electromagnetic stirring device disclosed in this publication. This stirring device includes a pair of electromagnetic stirring coils 6*a* and 6*b* provided along long sides 10*a* and 10*b* of the mold, respectively. This device is actuated to apply a uniform electromagnetic stirring thrust force to the molten metal contained in-the mold 3 through the effect of the stirring coils 6*a* and 6*b* so that the molten metal is circulated along the mold wall. That is, the electromagnetic stirring coil 6*a* includes plural magnetic cores 12*a* ranged along the long side 10*a* of the mold, and a coil 14*a* wound around a slot 13*a* formed thereon. The other stirring coil 6*b* has the same arrangement. The coil 14*a* is connected to a three-phase current power supply 8 through a wiring box 7*a*. Likewise, the coil 14*b* is connected to the three-phase current power supply 8 through a wiring box 7*b*. A representative wiring arrangement is illustrated in FIG. 3. In this wiring arrangement, a shifting field type electromagnetic stirring thrust force is applied to the molten metal on the meniscus as viewed by arrows of FIG. 2.

In the conventional electromagnetic stirring device shown in FIG. 3, the distribution of the thrust force on the meniscus is shown in FIG. 4 on the assumption that the three-phase current power supply 8 has a frequency of 2 Hz and a current of 400 A. The distribution shown in FIG. 4 is analyzed by universal software used for analyzing electromagnetic field numerical values. In this figure, the arrow direction indicates the direction of the thrust force of each cell and the arrow length indicates the magnitude of the thrust force. As will be understood from FIG. 4, the components of the thrust force along the long side 10 of the mold are kept substantially constant at each location of the long side.

As mentioned above, the in-mold electromagnetic stirring device provided in the conventional continuous casting apparatus for casting a metal slab operates to apply uniform electromagnetic stirring force to the molten metal along the long side of the mold. Hence, the circulating flow of the molten metal on the meniscus is made stronger when the molten metal flows from the short side 11 of the mold to the dipping nozzle 2 or made weaker when the molten metal flows from dipping nozzle 2 to the short side 11 of the mold.

On the other hand, on the meniscus, non-metallic inclusion or powder is floating. If the circulating flow of the molten metal is inhomogeneous and is partially stagnant, the non-metallic inclusion or powder is collected around the stagnant portion or the powder is entrained down into that portion. When the molten metal is changed into a solid metal, the non-metallic inclusion or powder brings about bubbles of CO, for example. If powder is left in the metal, burning is more likely to take place. The burning may cause a breakout. As such, the conventional in-mold electromagnetic stirring device serves to keep the temperature of the molten metal at a the top of the mold wall uniform but does not offer a sufficient capability of preventing a vertical crack of the coagulated shell 4.

SUMMARY OF THE INVENTION

It is an object of the present invention to provide a continuous casting method and apparatus for continuously casting a metal slab that operate to uniformly circulate molten metal on a meniscus in a mold, keep the temperature of the molten metal at a height of the mold wall uniform, and keep the circulating flow of the molten metal uniform to prevent collection of non-metallic inclusion or entrainment of powder and thereby producing a slab with no surface defect, such as a vertical crack.

In carrying out the object, a continuous casting method for casting a metal slab according to a first aspect of the invention includes the steps of injecting molten metal into the mold from a dipping nozzle provided in the center of the horizontal plane of the mold and generating two kinds of electromagnetic force, inverted with respect to each other, along both of the long sides of the mold through the effect of at least two electromagnetic stirring coil parts. In the latter step, the components of the electromagnetic force directed from the dipping nozzle to the short sides of the mold is different from the components of the electromagnetic stirring force directed from the short sides of the mold to the dipping nozzle. Further, the continuous casting method further includes the step of pulling out the coagulated metal as cooling down part of the mold.

Further, a continuous casting apparatus for continuously casting a metal slab according to a first aspect of the invention is arranged to inject the molten metal into the mold from the dipping nozzle provided in the center of the horizontal plane of the mold and pull out the coagulated metal as cooling down a part of the mold for continuously casting a metal slab. The continuous casting apparatus includes two electromagnetic stirring coil parts for controlling flow of the molten metal in the mold through electromagnetic force. The electromagnetic stirring coil parts are provided along two long sides of the mold, respectively, and have plural magnetic cores ranged along these two long mold sides and plural coils wound therearound. At least one power supply circuit for generating a two or more phase alternating current having a predetermined frequency is provided, and connecting means for connecting the two electromagnetic stirring coil parts with at least one power supply circuit are provided so that two circuits composed of the plural coils and the connecting means for the two long mold sides are point-symmetric to each. other with respect to the dipping nozzle and each of the two circuits are divided into two circuit parts. The term "point-symmetric" means that the two circuits arranged at one side and the opposite side of the dipping nozzle have the same characteristics, e.g., impedance or size.

A continuous casting apparatus for continuously casting a metal slab according to a second aspect of the invention is arranged to inject molten metal into the mold from a dipping nozzle provided in the center of the horizontal plane of the mold and pull out the coagulated metal as cooling down a part of the mold. The continuous casting apparatus includes two electromagnetic stirring coil parts provided along the two long sides of the mold, respectively, for controlling flow of the molten metal in the mold through electromagnetic force, those electromagnetic stirring coil parts having plural magnetic cores ranged along the two long sides of the mold and plural coils wound therearound, and conducting means for feeding current to the two electromagnetic stirring coil parts. If the space inside and outside of the mold is divided into first to fourth spaces by a plane passing through the center of the dipping nozzle and in parallel with the two long sides of the mold and another plane passing through the center of the dipping nozzle and perpendicular to the long sides of the mold and the third space is symmetric to the first space with respect to the center of the dipping nozzle and the fourth space is symmetric to the second space with respect to the center of the dipping nozzle, the magnetic core existing in the first space and the magnetic core existing in the third space are longer than those existing in the second space and the fourth space.

Otherwise, the conducting means is actuated to conduct alternating current to the coils existing in the first and the third spaces for driving the molten meal along the sides of the mold, and a circuit is provided for conducting direct current through the coils existing in the second and the fourth spaces or cutting off the alternating current through the coils existing in the second and the fourth spaces. Here, if one of the long sides of the mold exists in the first and the second spaces and the other long side exists in the third and the fourth spaces, one of the two electromagnetic stirring coil parts may be provided only in the first space and the other may be provided only in the third space.

Further, a continuous casting apparatus for continuously casting a metal slab according to a third aspect of the invention is arranged to inject molten metal into the mold from a dipping nozzle provided in the center of the horizontal plane of the mold and pull out the coagulated metal as cooling down a part of the mold. The continuous casting apparatus includes two electromagnetic stirring coil parts provided along the two long sides of the mold, respectively, for controlling flow of the molten metal in the mold through electromagnetic force. These electromagnetic stirring coil parts have plural magnetic cores ranged along the long sides of the mold and plural coils wound therearound.

Further, the continuous casting apparatus includes conducting means for feeding current to the two electromagnetic stirring coil parts, flow speed sensing means for sensing a flow speed of the surface layer of the molten metal at plural locations of the surface of the molten metal contained in the mold, flow speed converting means for converting the detected flow speed into flow speed components corresponding to each of predetermined surface flow speed distributing modes, compensation calculating means for comparing the converted flow speed components with the target values for the modes, respectively, and calculating flow speed component deviations, reverse converting means for reversely converting the flow speed component deviations into the corresponding flow speed deviations of the surface of the molten metal at the plural locations, and control means for controlling the conducting means in a manner to reduce these flow speed deviations.

The continuous casting method and apparatus for continuously casting a metal slab according to the first aspect of the invention, as described above, is capable of applying uniform circulating flow to the molten metal on the meniscus along the mold by adjusting the distribution of electromagnetic stirring force generated in the two electromagnetic stirring coil parts. Further, the continuous casting apparatus for casting a metal slab according to the second aspect of the invention makes it possible to simplify and reduce the electromagnetic stirring coil parts. The continuous casting apparatus for casting a metal slab according to the third aspect of the invention makes it easier to set, change and adjust a flow speed distribution of the molten metal.

BRIEF DESCRIPTION OF DRAWINGS

FIG. 18 is an explanatory view showing a function of the continuous casting apparatus according to the second embodiment of the present invention;

FIGS. 72A to 72D are plane views showing vector components of the surface flow on the meniscus of the molten metal in the mold, in which FIG. 72A is a plane view showing the components at a stirring mode, FIG. 72B is a plane view showing the components at a translation mode, FIG. 72C is a plane view showing the components at an accelerating mode, and FIG. 72D is a plane view showing the components at a twisting mode.

DETAILED DESCRIPTION OF

Figure 5:
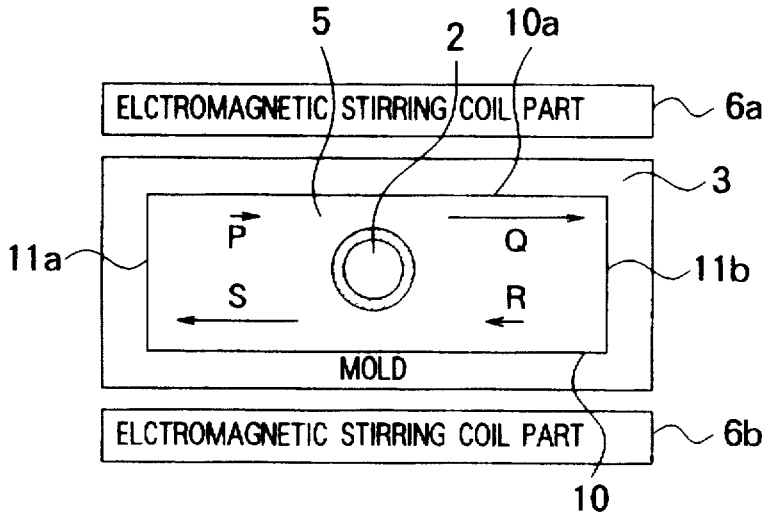
FIG. 5 is an explanatory view showing a continuous casting apparatus according to a first embodiment of the present invention.

The description will be oriented to a continuous casting method and apparatus according to a first embodiment of the present invention with reference to FIG. 5. FIG. 5 illustrates a continuous casting apparatus for a metal slab viewed from an upper point of a meniscus. A mold 3 is substantially square in cross section. A dipping nozzle 2 is located in the center of the mold in the cross section. The dipping nozzle 2 injects molten metal. Electromagnetic stirring coil parts 6*a* and 6*b* are located along long sides 10*a* and 10*b* of the mold 3, respectively. This continuous casting method adjusts a distribution of electromagnetic stirring thrust through the effect of these electromagnetic stirring coil parts 6*a* and 6*b*. The adjusted distribution makes it possible to uniformly circulate the molten metal on the meniscus 5 along the inside of the mold 3.

That is, as shown in FIG. 5, the electromagnetic stirring coil part 6*a* operates to give rise to electromagnetic stirring thrusts P and Q along the long mold side 10*a*. The thrust P is oriented from a short mold side 11*a* to the dipping nozzle 2. The thrust Q is oriented from the dipping nozzle 2 to a short mold side 11*b*. The electromagnetic stirring coil part 6*b* operates to give rise to electromagnetic stirring thrusts R and S along the long mold side 10*b*. The thrust R is oriented from the short mold side 11*b* to the dipping nozzle 2. The thrust S is oriented from the dipping nozzle 2 to the short mold side 11*a*. The thrusts P and Q are oriented opposite the thrusts R and S. And, the thrust Q is larger than the thrust P and the thrust S is larger than the thrust R.

The electromagnetic stirring thrust distributed and adjusted as noted above serves to uniformly circulate the molten metal on the meniscus clockwise as viewed on the sheet. In FIG. 5, to uniformly circulate the molten metal counter-clockwise, the electromagnetic stirring thrusts are oriented opposite to each other and the thrusts P and R are larger than the thrusts Q and S, respectively.

In turn, the continuous casting apparatus according to this embodiment is arranged to have two circuits on the side of the long mold sides 10*a* and 10*b*. The circuit on the long side 10*a* includes a coil 14*a* of the electromagnetic stirring coil part 6*a* and a wiring box 7*a* serving as connecting means. This circuit is divided into two subcircuits A and B. The other circuit on the long side 10*b* includes a coil 14*b* of the electromagnetic stirring coil part 6*b* and a wiring box 7*b* serving as connecting means. This circuit is divided into two subcircuits C and D. The subcircuits A and B are point-symmetric to the subcircuits C and D with respect to the dipping nozzle 2. The subcircuits A and B are connected in parallel and have respective impedances, as are the subcircuits C and D.

Figure 6:
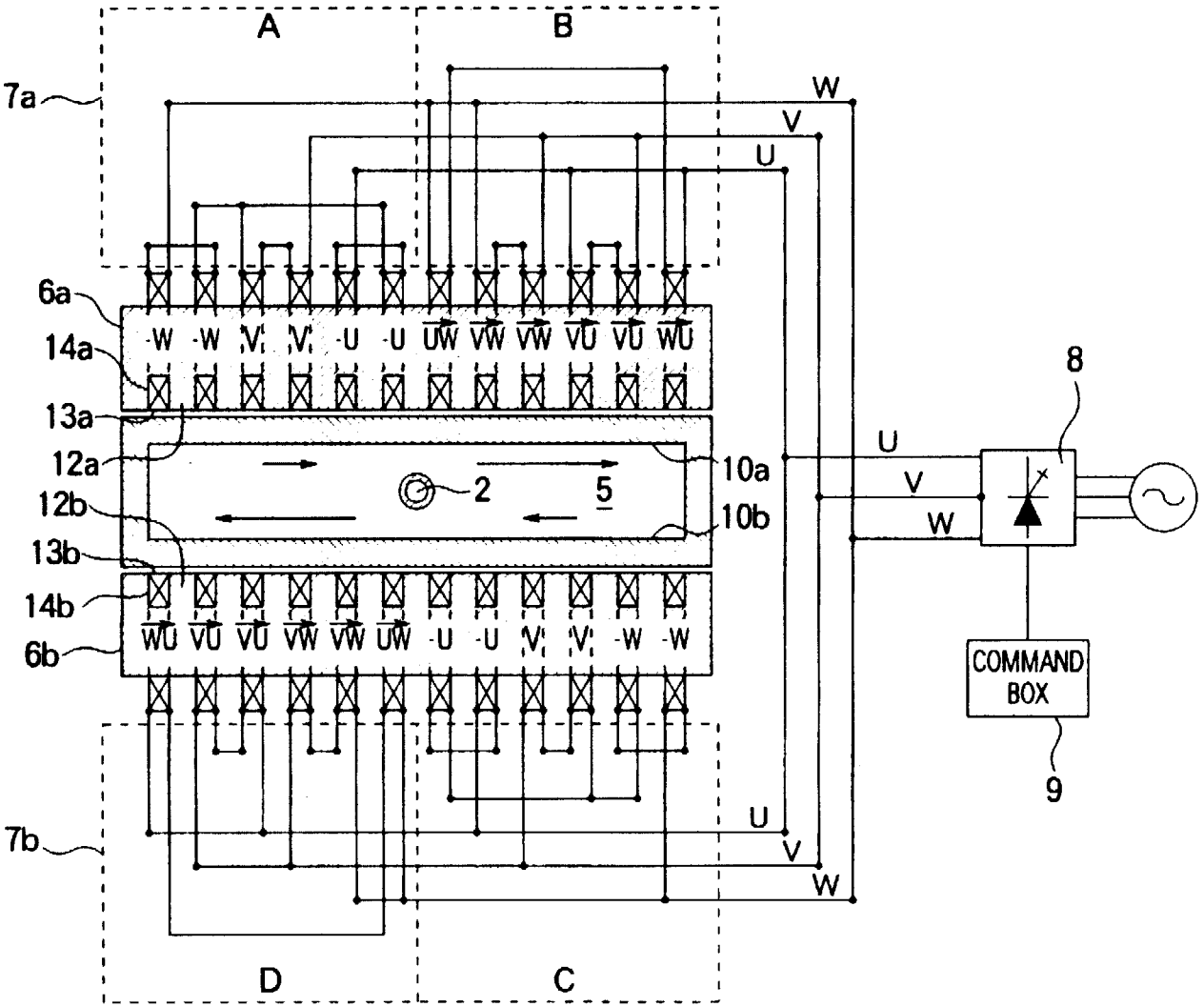
FIG. 6 is a sectional view and circuit diagram showing the continuous casting apparatus according to the first embodiment.
Figure 7:
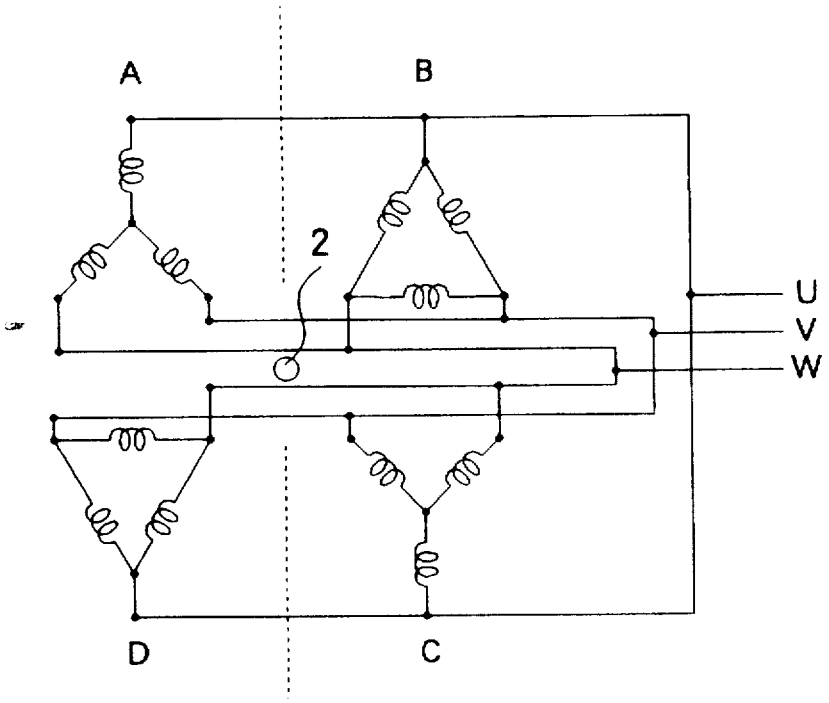
FIG. 7 is a circuit diagram showing the continuous casting apparatus shown in FIG. 6.

In the circuit as shown in FIG. 6, the subcircuits A and C are Y-connected (star-connected), while the subcircuits B and D are delta-connected (ring-connected) as shown in FIG. 7. The subcircuits A and C have larger impedances than those B and D. As indicated by arrows on the meniscus 5 of FIG. 6, therefore, the electromagnetic stirring thrust caused along the long side 10*a* is oriented in opposition to the thrust caused along the long side 10*b*. Further, the electromagnetic stirring thrust oriented from the dipping nozzle 2 to the short side of the mold is larger than the thrust oriented from the short side to the dipping nozzle 2. A numeral 9 denotes a command box,.which is used for setting electromagnetic stirring conditions such as suitable frequency, voltage and current for the continuous casting conditions. By setting the conditions, the uniform current of the molten metal on the meniscus 5 is brought about along the inside of the mold.

Figure 8:
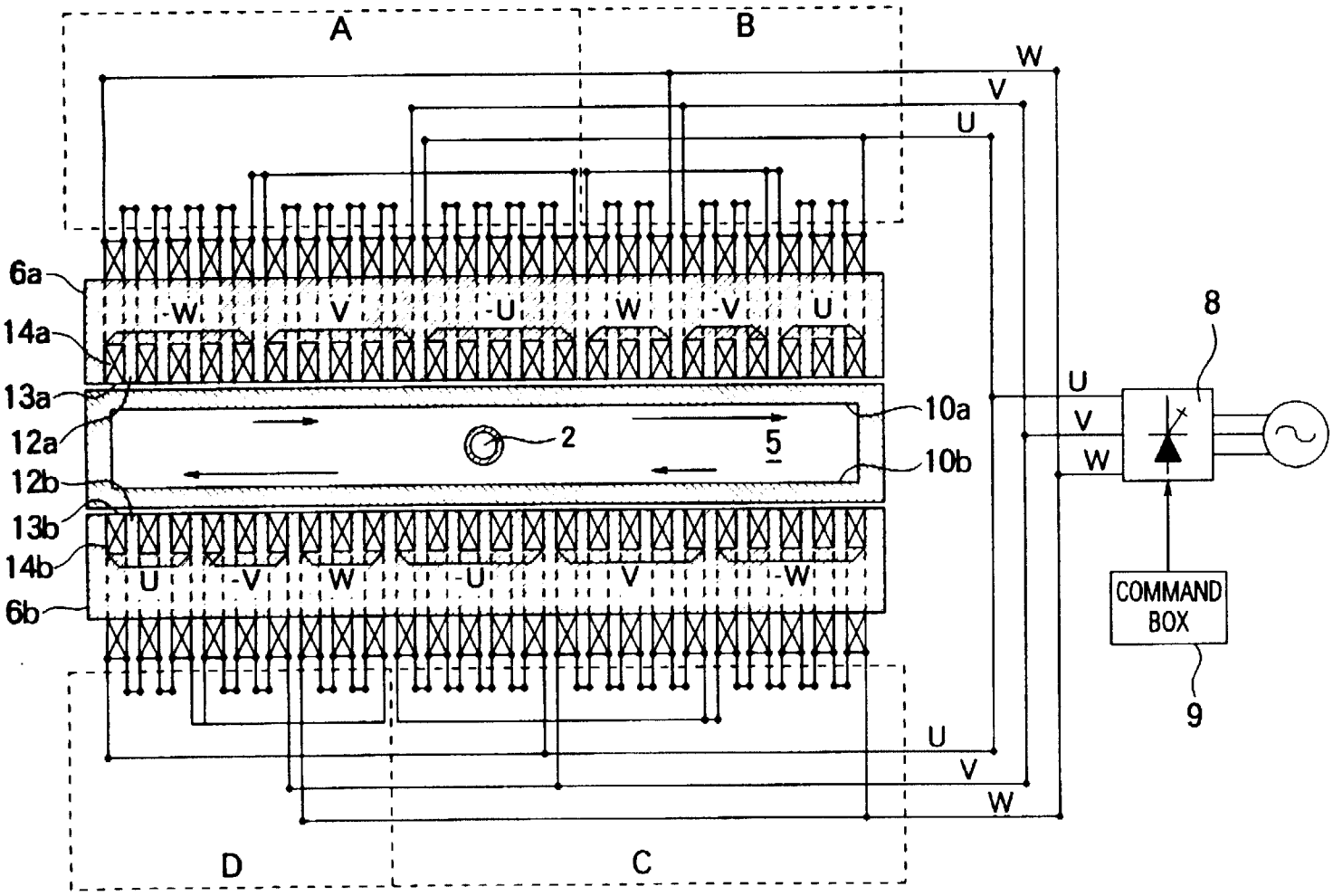
FIG. 8 is a sectional view and circuit diagram showing another continuous casting apparatus according to the first embodiment of the present invention.

Another example of circuits for the casting apparatus according to this embodiment is illustrated in FIG. 8. This circuit is arranged to have 24 slots 13 for each side of the electromagnetic stirring coil parts 6*a* and 6*b*. The subcircuit A or C has 15 slots for coils, each five of which are connected in series. The subcircuit B or D has 9 slots for coils, each three of which are connected in series. The subcircuits A and C have larger impedances than the subcircuits B and D. Hence, the electromagnetic stirring thrust is distributed as indicated by arrows on the meniscus 5 in FIG. 8. This distribution gives rise to a uniform flow of the molten metal on the meniscus 5.

Figure 1:
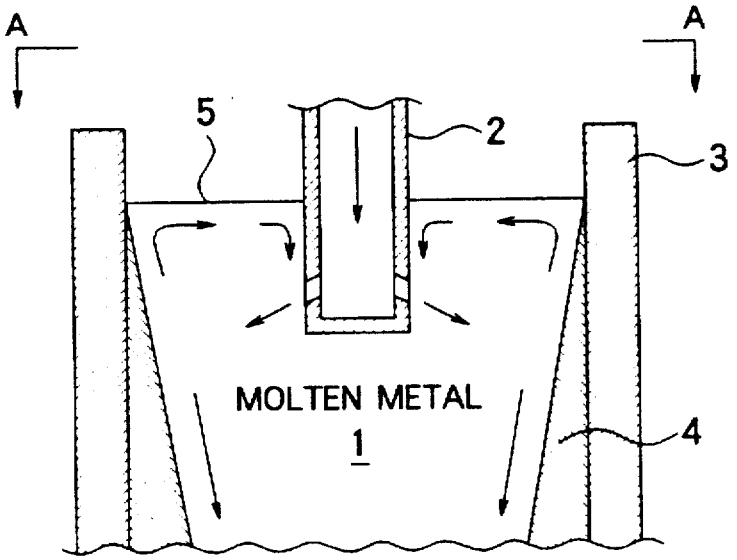
FIG. 1 PRIOR ART
FIG. 1 is an explanatory view showing the inside of a mold used in the conventional continuous casting apparatus.
Figure 2:
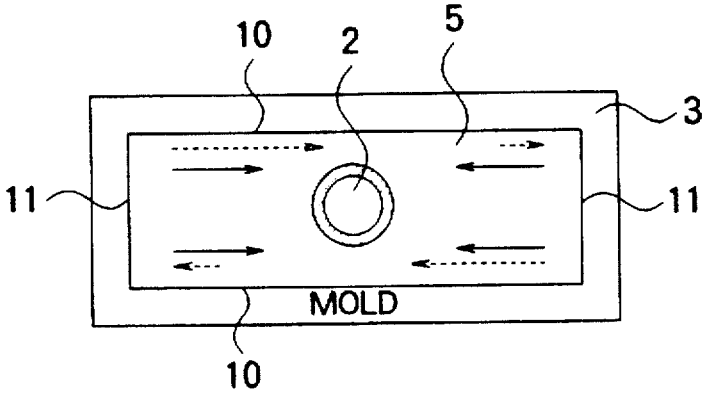
FIG. 2 PRIOR ART
FIG. 2 is a perspective view showing the mold viewed from the line A to A of FIG. 1.

As described above, in continuously casting a metal slab, the molten metal injected from the dipping nozzle collides with the short side of the mold and causes reversing flow. Then, as shown in FIG. 2, the flow is oriented from the mold short side 11 to the dipping nozzle 2 on the meniscus 5 as indicated by real-line arrows. According to the present invention, the electromagnetic stirring thrusts Q and S oriented from the dipping nozzle 2 to the short side 11 of the mold are larger than the thrusts P and R oriented from the short side 11 of the mold to the dipping nozzle 2 on the meniscus 5 as shown in FIG. 5. This makes it possible to give rise to a uniform flow of the molten metal on the meniscus 5. According to, an embodiment invention, the electromagnetic stirring conditions are adjusted by the command box and the subcircuits. The command box is responsible for adjusting the conditions of a power supply such as a frequency, a voltage and a current. The subcircuits each including the electromagnetic stirring coil part 6A or 6B and the wiring box are operated to set their impedances for the preferable conditions.

The continuous casting method according to the present invention is carried out to apply a proper electromagnetic stirring thrust to the molten metal on the meniscus. In the proper thrust, the reverse flow is considered. The molten metal uniformly goes along the mold wall so that the molten metal is not stagnated. This prevents any non-metallic inclusion from being stored in the molten metal and any powder from being entrained in the flow of the molten metal on the meniscus, thereby forming a metal slab with no surface defects, such as a vertical crack.

Below, the description will be oriented to the comparison of the simulation between an example of a conventinal apparatus and the present invention.

Figure 3:
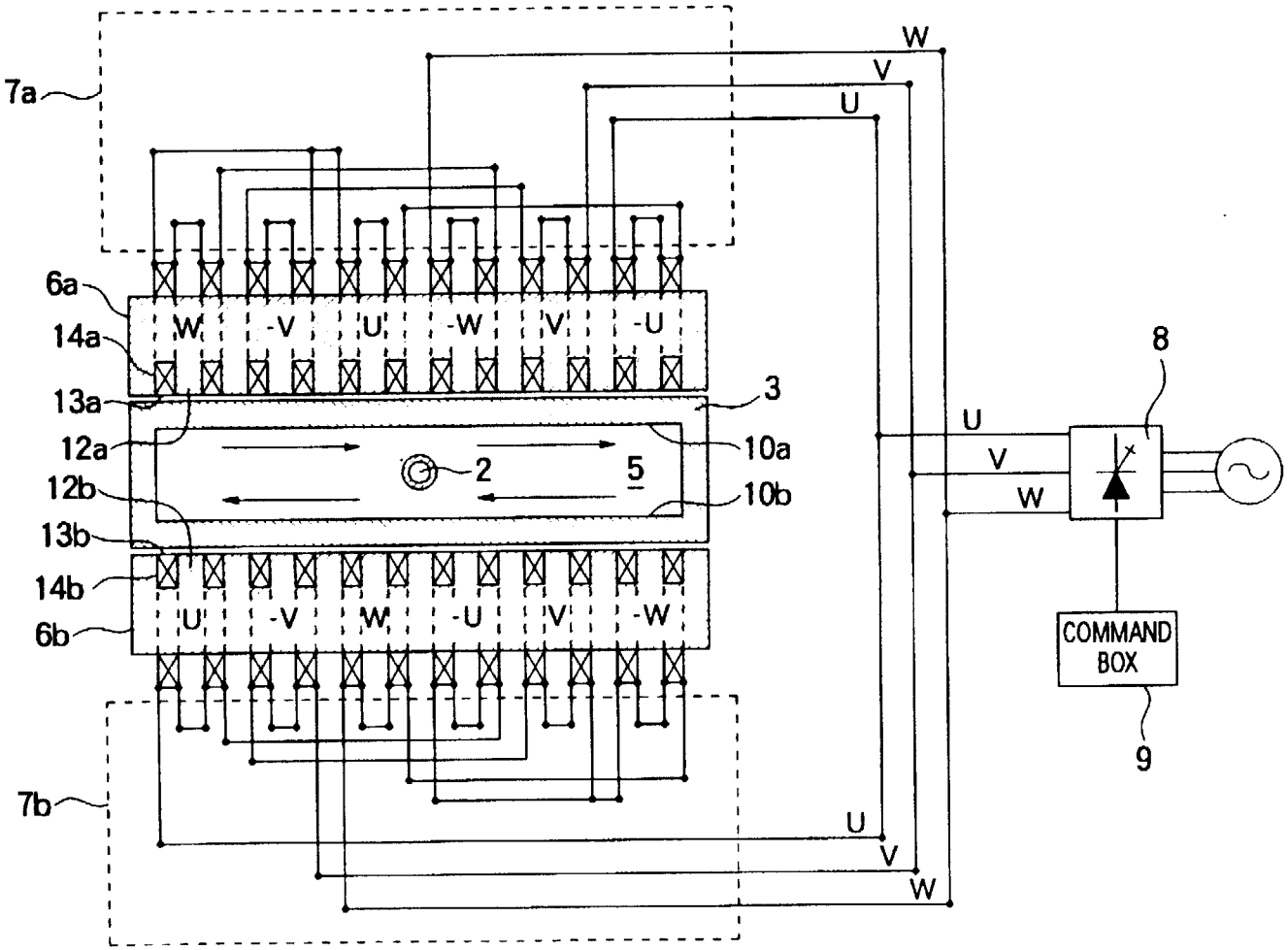
FIG. 3 PRIOR ART
FIG. 3 is a sectional view and circuit diagram showing the conventional apparatus.
Figure 10:
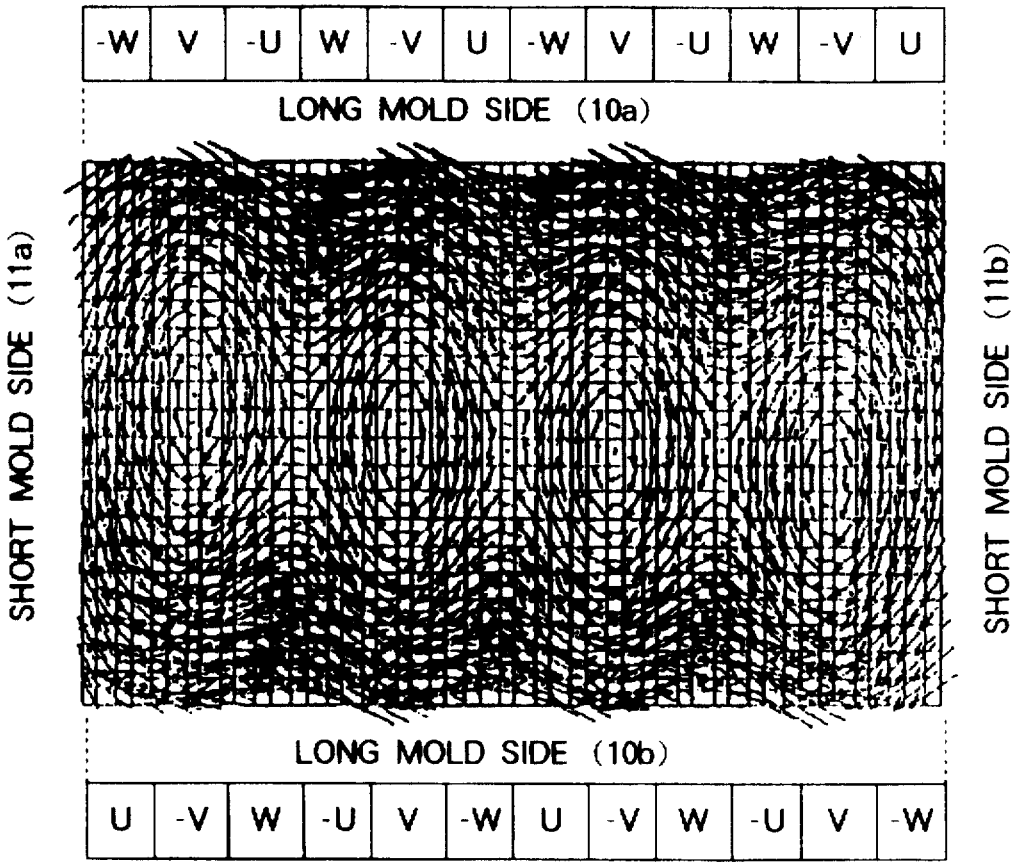
FIG. 10 PRIOR ART
FIG. 10 is a chart showing a distribution of electromagnetic stirring thrust caused in a second example of the conventional apparatus.

(Example 2 of the Conventional Apparatus) FIG. 10 illustrates a distribution of thrust given when the conventional apparatus arranged to connect each two coils of the electromagnetic stirring coil parts 6*a* and 6*b* in series, as shown in FIG. 3, applies a rotating thrust to the molten metal. in this apparatus, it is assumed that the frequency is 2 Hz, the current is 525 A, and the current density is $3.893\times10^6$ AT/m$^2$ in both of the coil parts 6*a* and 6*b*. The thrust distribution is made more uniform than that shown in FIG. 14. In this example, however, the thrust components caused along the long side 10 of the mold are made substantially constant at each spot of the long side. The reverse flow of the molten metal makes it impossible to form a uniform flow, thereby bringing about a surface defect on the slab, according to an experiment.

Figure 4:
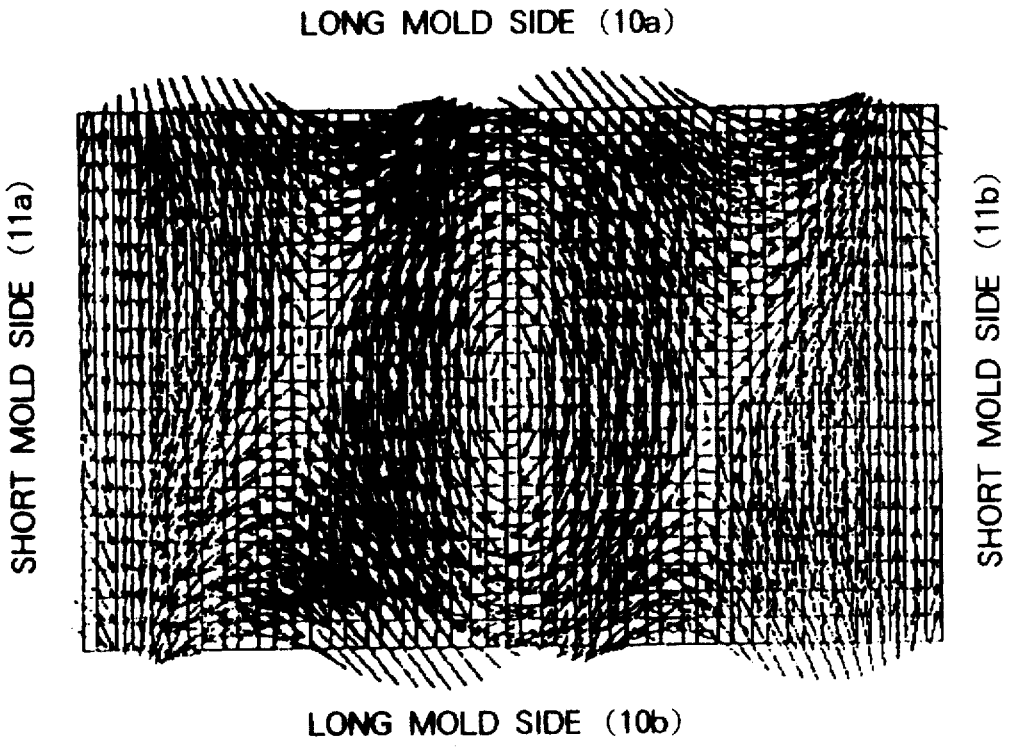
FIG. 4 PRIOR ART
FIG. 4 is a chart showing a distribution of electromagnetic stirring thrust caused in an example of conventional apparatus.
Figure 11:
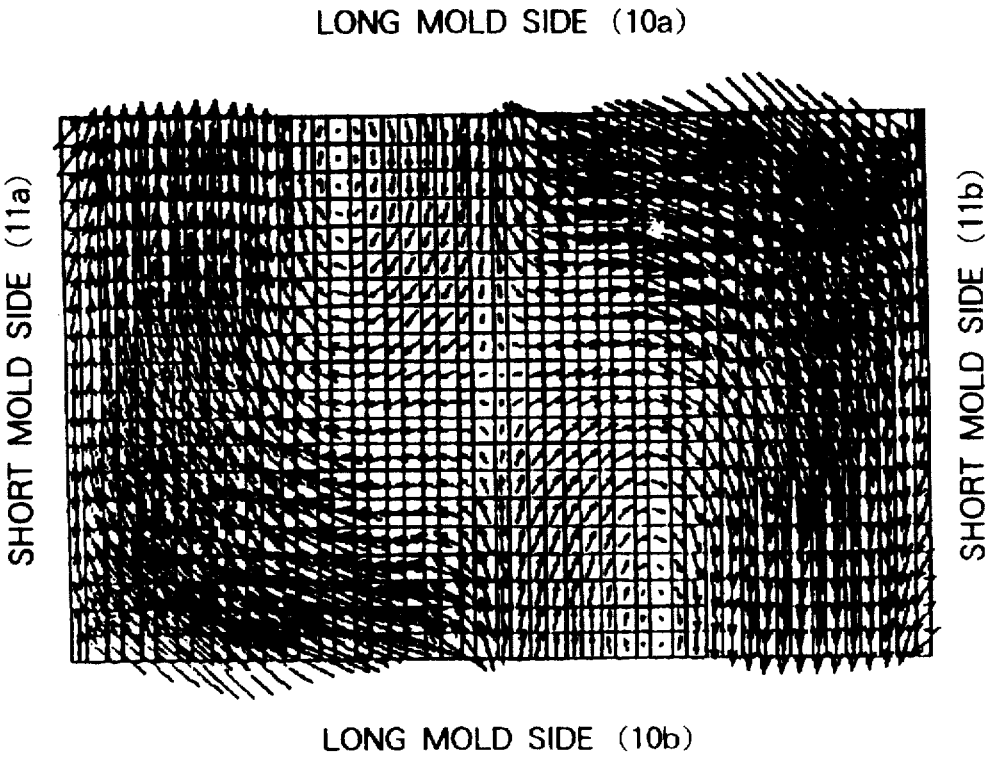
FIG. 11 is a chart showing a distribution of electromagnetic stirring thrust caused in a first example of the present invention.
Figure 12:
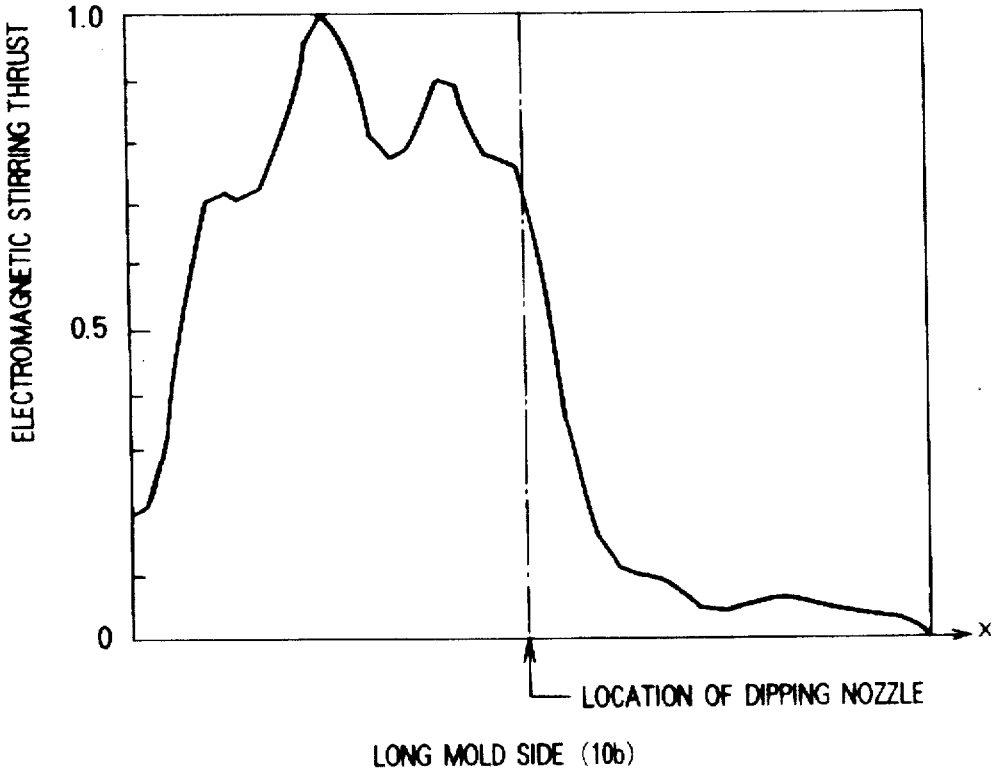
FIG. 12 is a graph showing the distributions of electromagnetic stirring thrust caused in the first example of the present invention.

(Example 1 of the Present Invention) In this apparatus shown in FIG. 6, it is assumed that a three-phase power supply has a frequency of 2 Hz, a current is 525 A, a current density is $2.248\times10^6$ AT/m$^2$ in the subcircuits A and C, (which means that these subcircuits have 1.73 time as large an impedance as in the second example of the conventional apparatus), and another current density is $3.893\times10^6$ AT/m$^2$ in the subcircuits B and D, (which means that these subcircuits have the same impedance as in the second example of the conventional apparatus). The distribution of the electromagnetic stirring thrust on the meniscus 5 in this assumption will be illustrated in FIGS. 11 and 12. FIG. 11 is in the same style as FIGS. 4 and 10. FIG. 12 is a graph showing the thrust components oriented toward the long side 10*b* of the mold. The thrust is indicated by a ratio having a value of 1.0 as a maximum of the thrust. As seen from FIGS. 11 and 12, the thrust components oriented from the short side 11 of the mold to the dipping nozzle 2 (in the right side of FIG. 12) are smaller, while the thrust components oriented from the dipping nozzle 2 to the short side 11 of the mold are larger (in the left side of FIG. 12). Therefore, when this kind of apparatus operates to electromagnetically stir the molten metal, a smaller thrust is brought about in the same direction as the reverse flow of the molten metal on the meniscus, while a larger thrust is brought about in the opposite direction. These thrusts give rise to a uniform flow along the inside of the mold and causing no stagnation in the flow, thereby making it possible to form the metal slab with no surface defects according to an experiment.

Figure 13:
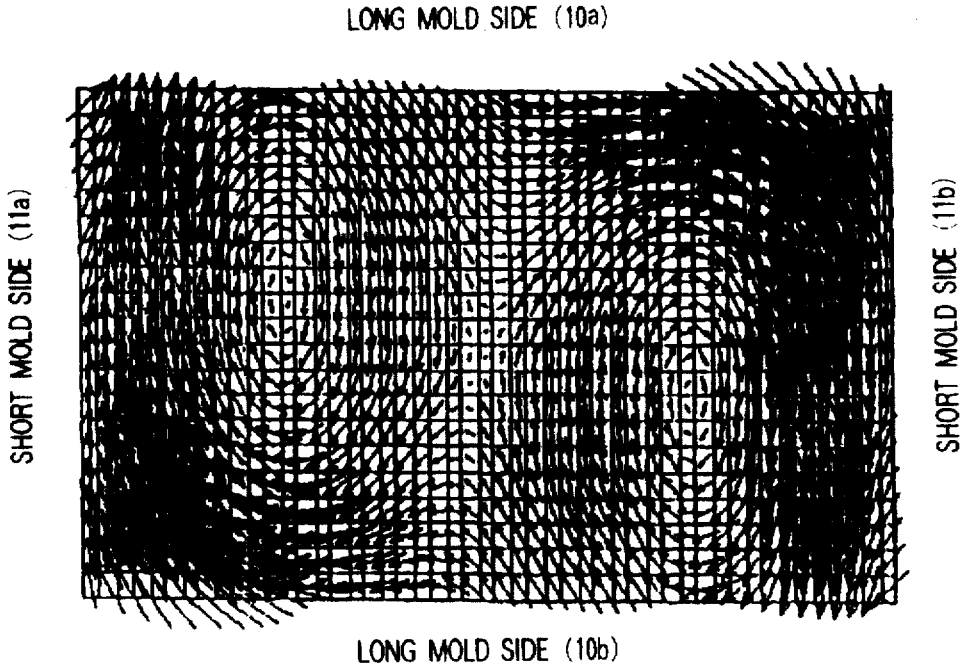
FIG. 13 is a chart showing a distribution of electromagnetic stirring thrust caused in a second example of the present invention.
Figure 14:
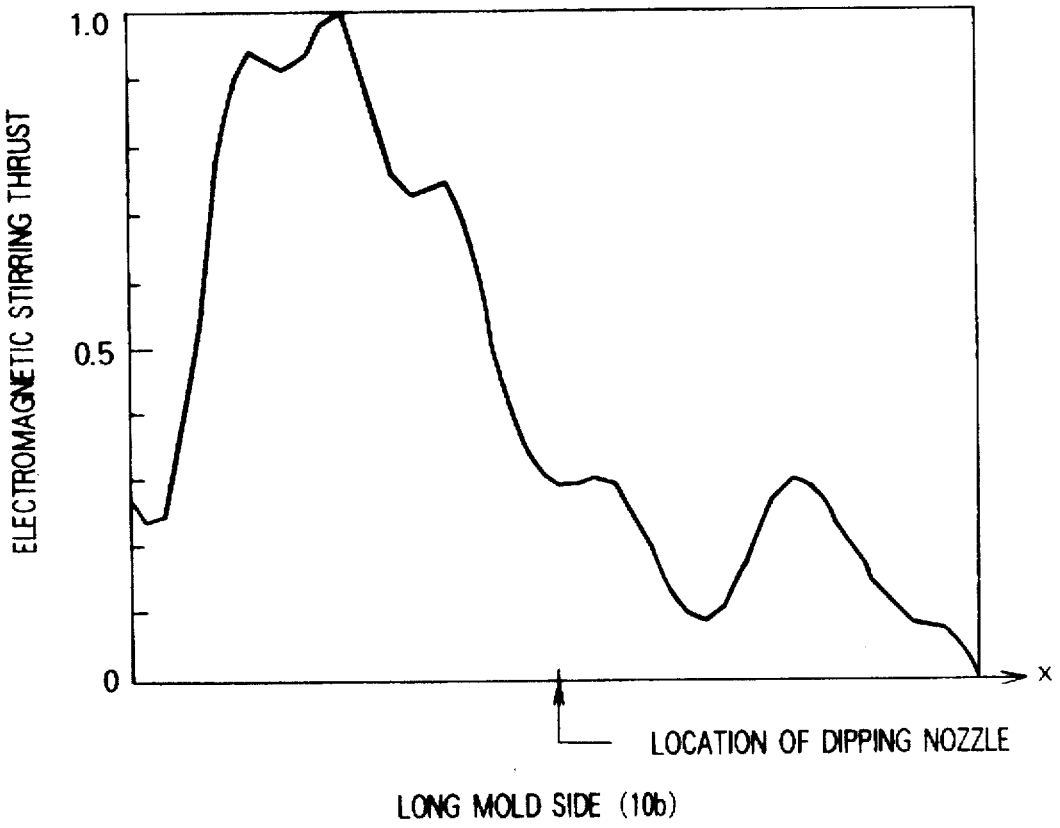
FIG. 14 is a graph showing the distributions of electromagnetic stirring thrust caused in the second example of the present invention.

(Example 2 of the Present Invention) In the apparatus of this invention as shown in FIG. 8, it is assumed that a three-phase power supply has a frequency of 2 Hz, a current density is $2.366\times10^6$ AT/m$^2$ in the subcircuits A and C, (which means that those subcircuits have 1.65 time as large an impedance as in the second example of the conventional apparatus), and another current density is $3.893\times10^6$ AT/m$^2$ in the subcircuits B and D, (which means that those subcircuits have the same impedance as in the second example of the conventional apparatus). The distribution of the electromagnetic stirring thrust on the meniscus 5 in this assumption is illustrated in FIGS. 13 and 14 in the same style as the example 1 of the present invention. Also in this example, the thrust components oriented from the short side 11 of the mold to the dipping nozzle 2 are smaller (in the right side of FIG. 14), while the thrust components oriented from the dipping nozzle 2 to the short side 11 of the mold are larger (in the left side of FIG. 14). Hence, this kind of apparatus operates to apply a smaller thrust in the same direction as the reverse flow of the molten metal on the meniscus, while the apparatus operates to apply a larger thrust in the opposite direction when it electromagnetically stirs the molten metal. This results in a uniform flow along the inside of the mold and prevention of any stagnation of the current, thereby making it possible to form a metal slab with no surface defects according to an experiment.

Figure 9:
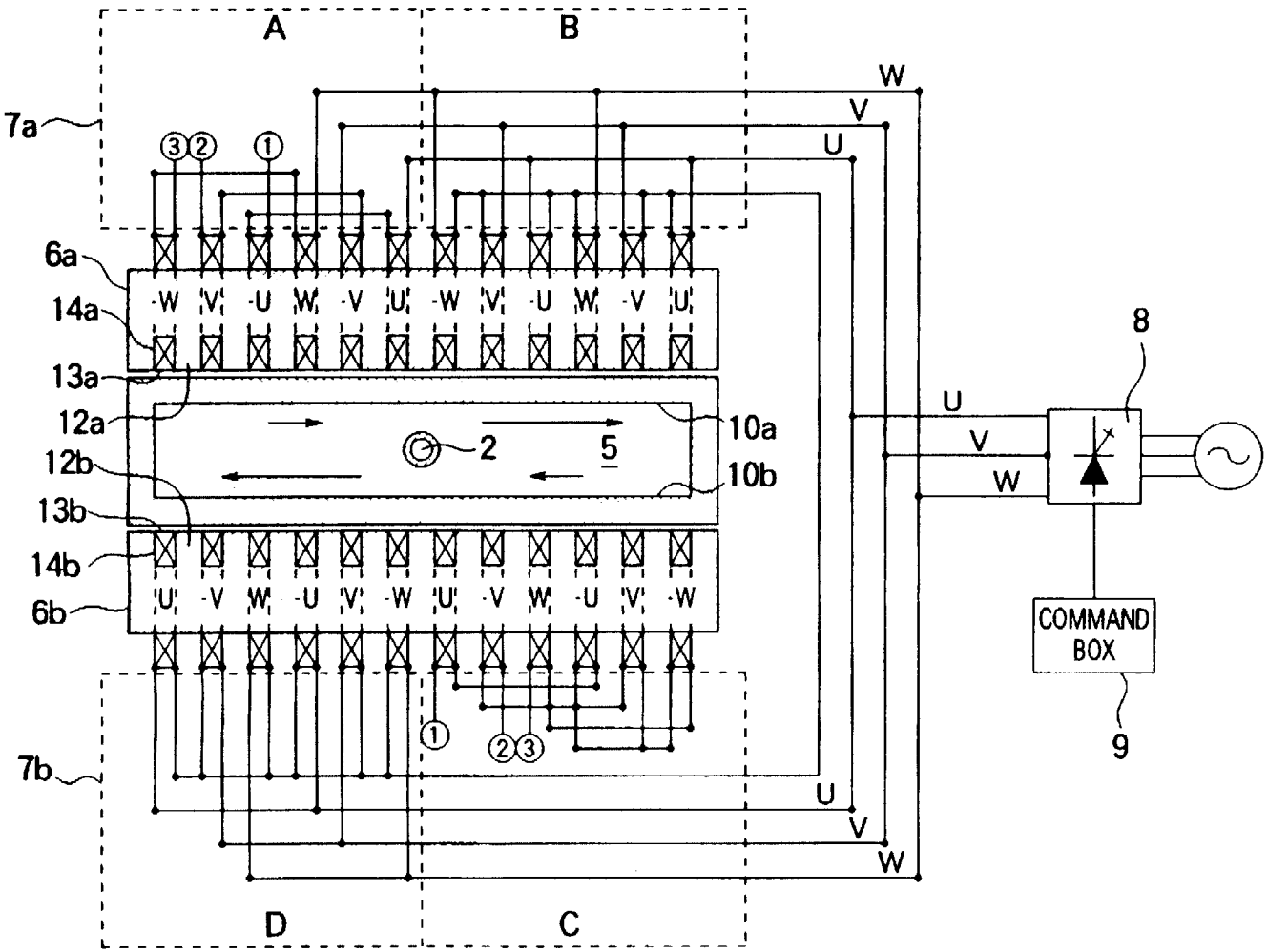
FIG. 9 is a sectional view and circuit diagram showing still another continuous casting apparatus according to the first embodiment of the present invention.

(Example 3 of the Present Invention) In the apparatus of this invention as shown in FIG. 9, it is assumed that a three-phase current power supply has a frequency of 2 Hz, a current density is $0.973\times10^6$ AT/m$^2$ in the subcircuits A and C, (which means that those subcircuits have four times as large an impedance as in the second example of conventional apparatus), and another current density is $3.893\times10^6$ AT/m$^2$ in the subcircuits B and D, (which means that those subcircuits have the same impedance as in the second example of the conventional apparatus). The distribution of the electromagnetic stirring thrust on the meniscus 5 in this assumption is arranged as follows. That is, like the examples 1 and 2 of the present invention, the thrust components oriented from the short side 11 of the mold to the dipping nozzle 2 are smaller, while the thrust components oriented from the dipping nozzle 2 to the short side 11 of the mold are larger. This results in giving rise to a uniform flow along the inside of the mold and preventing any stagnation of the molten metal, thereby making it possible to form a metal slab with no surface defects according to an experiment.

In turn, the description will be oriented to a continuous casting apparatus according to a second embodiment of the present invention. In the continuous casting of a metal slab, the flow speed of ejecting the molten metal is variable in each ejecting outlet. This is because non-metallic inclusion in the molten metal adheres to the ejecting outlet of the dipping nozzle 2, for example. In this case, the current of the molten metal on the meniscus is continuously variable. Hence, the uniform electromagnetic stirring thrust in the conventional apparatus does not stabilize the flow of the molten metal. Further, it is desirable to apply to the molten metal on the meniscus various kinds of thrusts, such as rotation, braking and accelerating of a reverse flow. However, the conventional electromagnetic stirring operation utilizes a three-phase and one power supply. Hence, it has been difficult to continuously change the thrust according to the continuously variable current of the molten metal.

Further, the electromagnetic stirring thrusts long both of the long sides of the mold may interfere with each other, so that a thrust eddy may take place. The shell portion corresponding to the eddy is likely to have a surface defect, such as a vertical crack.

The continuous casting method for continuously casting a metal slab according to this embodiment of the present invention is intended to include the steps of uniformly circulating the in-mold molten metal on the meniscus, applying a proper thrust distribution to reverse flow for braking or accelerating, or, even if the flow of the molten metal is continuously variable, continuously changing the electromagnetic stirring thrust for overcoming a disadvantageous thrust eddy. This method therefore makes it possible to form a metal slab with an excellent surface property.

The continuous casting apparatus for a metal slab according to this embodiment of the present invention is arranged to have the electromagnetic stirring coil parts located along the long sides of the mold on the meniscus respectively. The electromagnetic stirring coil parts operate to control the flow of the molten metal on the meniscus while injecting the molten metal from the dipping nozzle to the mold. The continuous casting apparatus includes these two electromagnetic stirring coil parts, two or four power supplies, wiring boxes for connecting the coil parts with the power supplies respectively, and a control system for power supply conditions. The electromagnetic stirring coil parts include plural magnetic cores ranged along the long sides of the mold and coils wound around the magnetic cores of a shifting field type. The circuit on each long side, including the coils and the wiring boxes wired therewith, is divided into two subcircuits. Each two of the four subcircuits is connected to the corresponding power supply. Or, each of the four subcircuits is connected to the corresponding power supply.

Figure 15:
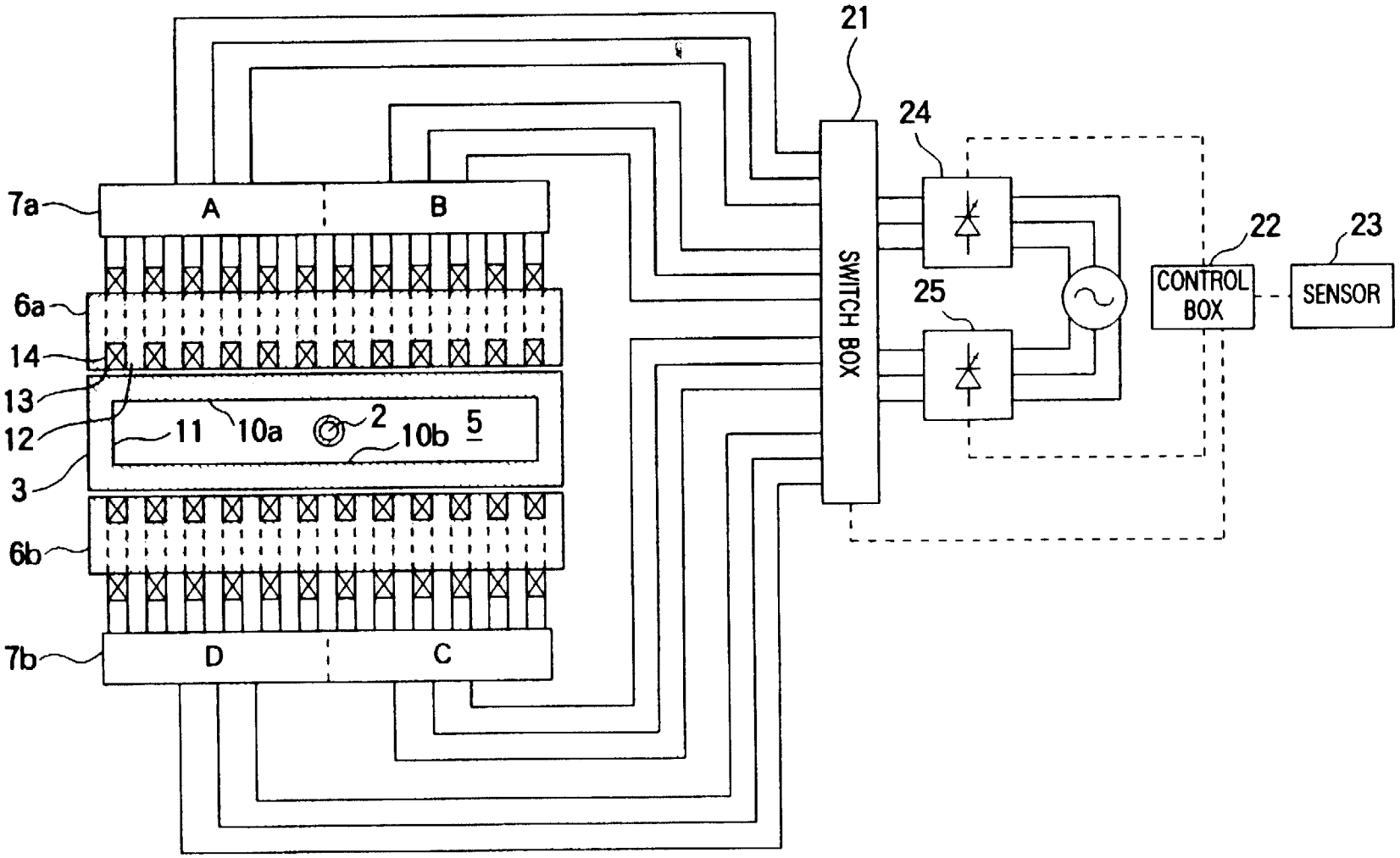
FIG. 15 is an explanatory view showing a continuous casting apparatus according to a second embodiment of the present invention.

The continuous casting apparatus will be described with reference to the relevant drawings. FIG. 15 is a cross section showing the continuous casting apparatus viewed from an upper point of the meniscus and illustrates a wiring connection of the electromagnetic stirring coil parts. A mold 3 has a cross-section which is substantially square. The mold 3 provides a dipping nozzle 2 in the sectional center thereof, from which nozzle the molten metal is injected. The electromagnetic stirring coil parts 6*a* and 6*b* are located along the two long sides 10*a* and 10*b* of the mold. These coil parts operate to apply the electromagnetic stirring thrust for controlling the flow of the molten metal on the meniscus 5.

The continuous casting apparatus shown in FIG. 15 uses two power supplies, that is, a first power supply 24 and a second power supply 25. The circuit including each coil 14 of the two coil parts 6*a* and 6*b* and the corresponding power supply is divided into two subcircuits. That is, the divided subcircuits total four, A, B, C and D. Each pair of these four subcircuits is connected to the corresponding power supply 24 or 25 for controlling the electromagnetic stirring thrust applied by the coils of the circuit. For example, the following three combinations are considered:

(1) The subcircuits A and C are connected to the first power supply 24 and the subcircuits B and C are connected to the second power supply 25.

(2) The subcircuits A and B are connected to the first power supply 24 and the subcircuits C and D are connected to the second power supply 25.

(3) The subcircuits A and D are connected to the first power supply 24 and the subcircuits B and C are connected to the second power supply 25.

Any one of these three combinations may be freely selected by switching the switch box 21, even when the apparatus is in operation. Or, one combination may be pre-set without using the switch box 21.

Figure 16:
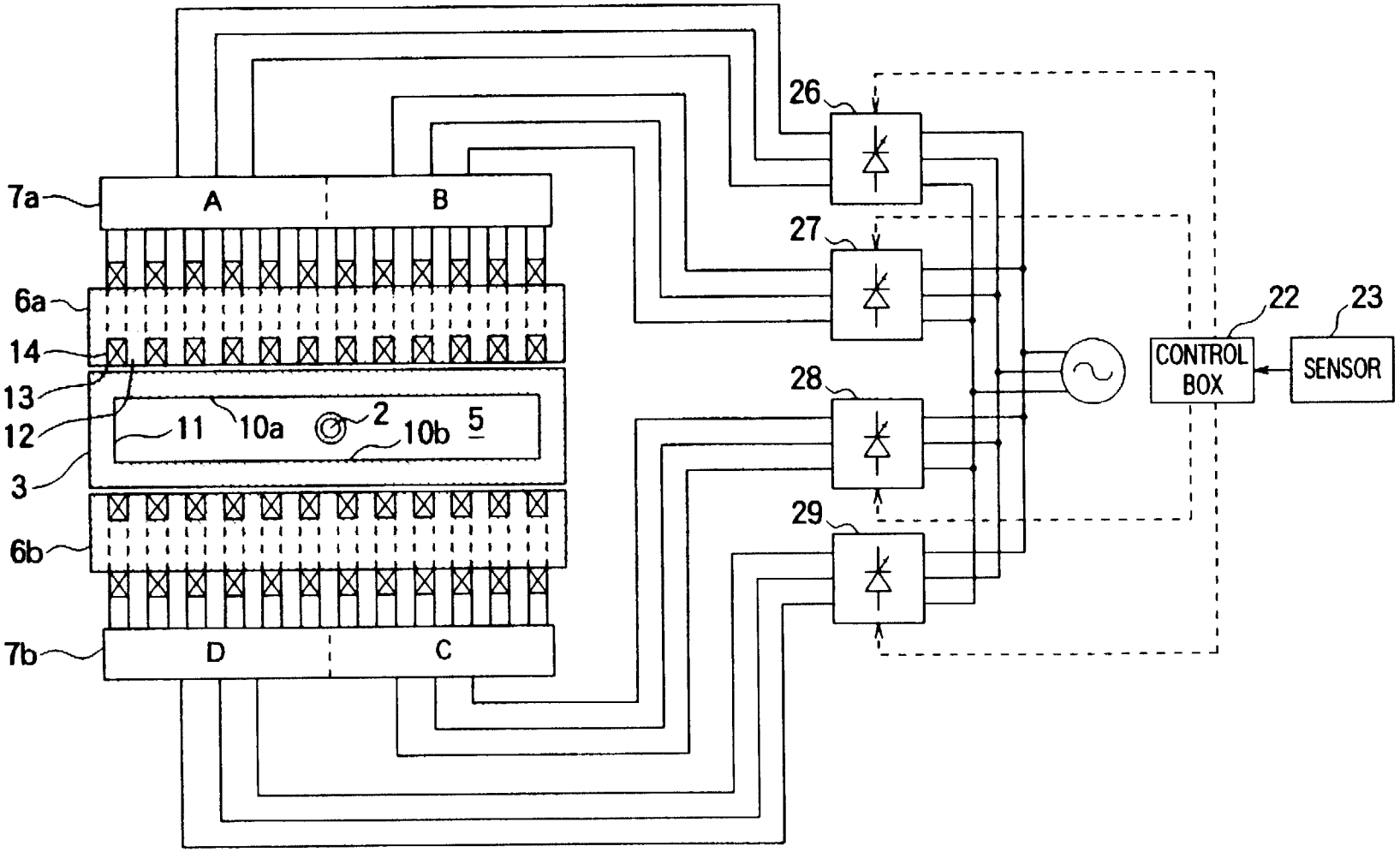
FIG. 16 is an explanatory view showing another continuous casting apparatus according to the second embodiment of the present invention.

Another continuous casting apparatus according to this embodiment of the invention, as shown in FIG. 16, uses four power supplies, that is, a first power supply 26, a second power supply 27, a third power supply 28 and a fourth power supply 29. The circuit on each long side composed of each coil 14 of the two coil parts 6*a* and 6*b* and each power supply connected therewith is divided into two subcircuits. That is, a total of four subcircuits A, B, C and D are formed. Those subcircuits are connected to the corresponding power supplies for individually controlling the electromagnetic stirring thrusts applied by these coils.

Figure 17:
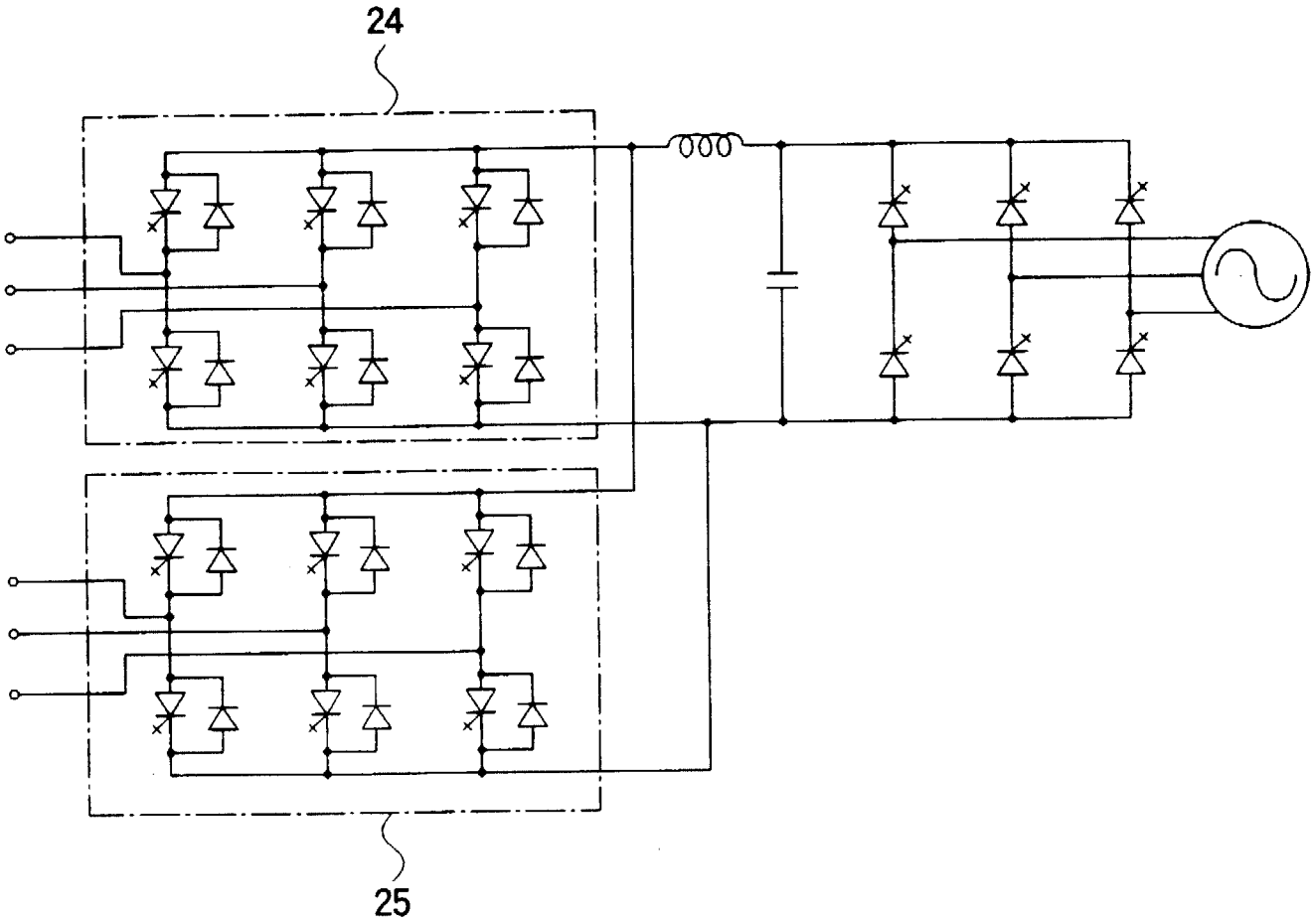
FIG. 17 is a circuit diagram showing a power supply circuit used in the continuous casting apparatus according to the second embodiment of the present invention.

In this embodiment, the distribution of the electromagnetic stirring thrust is controlled by adjusting the power supply conditions, such as a frequency, a phase difference, and a current, with the control box 22 according to the observed result of the flow of the molten metal on the meniscus 5. The conditions are controlled for two power supplies 24 and 25 or four power supplies 26 to 29. To observe the flow of the molten metal, a user may directly watch the meniscus or a sensor 23 may be used. The sensor 23 outputs an image processed by a TV camera. In the subcircuits A, B, C and D, the coils 14 may be connected in series, in parallel or both. The connection may be suitably selected. The connections may be fixed or switched when the casting apparatus is in operation. Each of the power supplies 24 to 29 may adopt the arrangement as shown in FIG. 17 in addition to those shown in FIGS. 15 and 16. Moreover, rather than the inverter type, a cycloconverter type may be used.

According to the foregoing second embodiment, the four subcircuits A, B, C and D are used for controlling an electromagnetic stirring thrust through the effect of two or four power supplies. Hence, this casting apparatus enables various kinds of thrust distributions to be applied to the molten metal on the meniscus or suitably control the flow of the molten metal according to the continuously changing casting state. FIG. 18 shows the thrust distributions based on the conventional one power supply system, the two power supply system and the four power supply system. A square of FIG. 18 indicates a meniscus enclosed by the mold. The arrow head indicates the direction of thrust. The arrow length indicates the magnitudes of thrust. The rotation means circulation of the molten metal on the meniscus. The brake means braking a reverse flow of the molten metal. The acceleration means acceleration of a reverse flow. The translation means a flow of the molten metal from one short side of the mold to the other short side. In FIG. 18, the subcircuits A to D have the same impedance as each other. The thrust form is changed according to each circuit connection. In the conventional system with one power supply, each subcircuit provides the same magnitude of thrust, while if the casting apparatus of the invention uses two power supplies, each pair of the subcircuits may have any thrust by changing the current value of the power supply connected to each pair of subcircuits. If four power supplies are provided, each subcircuit may have its own variable thrust.

Hence, if the flow of the molten metal in the mold is changed depending on the status of the outlet of the dipping nozzle while the continuous casting is in operation, the continuous casting method and apparatus according to this invention form a desired flow of the molten metal. For example, when inclusion adheres to the ejecting outlet of the dipping nozzle provided in the cross-sectional center of the mold so that the flow of the molten metal in the mold may be changed, the molten metal on the meniscus is controlled to constantly keep a uniform flow.

Figure 19:
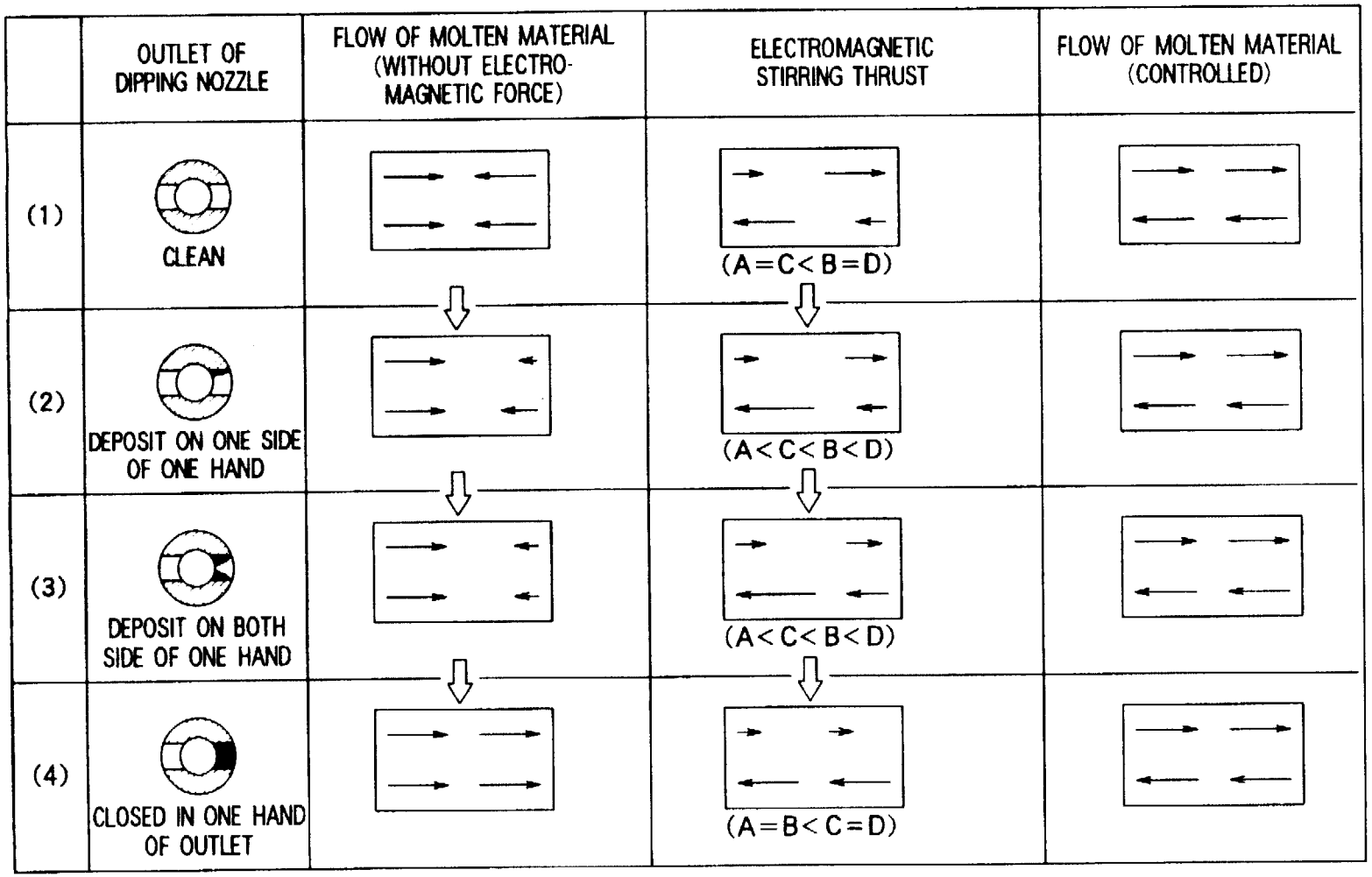
FIG. 19 is an explanatory view showing the function of the continuous casting apparatus according to the second embodiment of the present invention.

This control is illustrated in FIG. 19. In this figure, (1) no inclusion adheres to the ejecting outlet of the nozzle, that is, the outlet is kept clean. In this case, the flow of the molten metal on the meniscus is made to be a symmetric reverse flow if no electromagnetic stirring is done. To obtain the uniform flow of the molten metal, the electromagnetic stirring thrust is made stronger against the reverse flow, that is, toward the flow directed from the center of the mold to the short side of the mold, while it is made weaker toward the reverse flow, that is, the flow directed from the short side of the mold to the center of the mold. Such a thrust distribution can be obtained by adjusting the current to be fed to each subcircuit as A=C<B=D in FIGS. 15 to 16. This is achieved by a system with two or four power supplies. (2) Inclusion adheres to one side of the outlet.

In this case, if no electromagnetic stirring is done, the flow of the molten metal is made weaker on the side where inclusion adheres. Hence, the four power supply system of this embodiment operates to adjust the current value to be fed to each subcircuit as A<C<B<D for distributing the thrust as shown in FIG. 19. This thrust distribution results in forming a uniform flow of the molten metal.

(3) Inclusion adheres to both sides of one ejecting outlet. In this case, if no electromagnetic stirring is done, the four power supply system of this invention operates to adjust the current value as A<C<B<D for distributing the thrust as shown in FIG. 19. This thrust distribution results in forming a uniform flow of the molten metal as well.

(4) The ejecting outlet is closed by inclusion. In this case, if no electromagnetic stirring is done, the flow of the molten metal is a translation, that is, oriented from one short side to the other short side of the mold. The current value to be fed to each subcircuit is adjusted as A=B<C=D so that the thrust distribution is controlled as shown in FIG. 19. This thrust distribution results in forming a uniform flow. This is achieved by the system with two or four power supplies according to this embodiment.

To obtain these thrust distributions, it is necessary to observe the flow of the molten metal on the meniscus and properly change the power supply conditions or the wiring connections. In FIG. 19, for the cases of (2) and (3), the system with two power supplies may achieve a substantially uniform flow though it may be incomplete.

Next, if the thrusts caused by the coil parts located in opposition interfere with each other, that is, a thrust eddy takes place, the continuous casting of the invention is effective in adjusting the phase difference between the power supplies for changing the location of the eddy. Hence, no non-metallic inclusion is accumulated in the eddy portion of the molten metal. This makes it possible to form a slab with no surface defects like a vertical crack.

Further, if two or more power supplies are used in this embodiment, the total power capacity is the same as that of one power supply. Hence, the total equipment cost is made relatively low.

Figure 20:
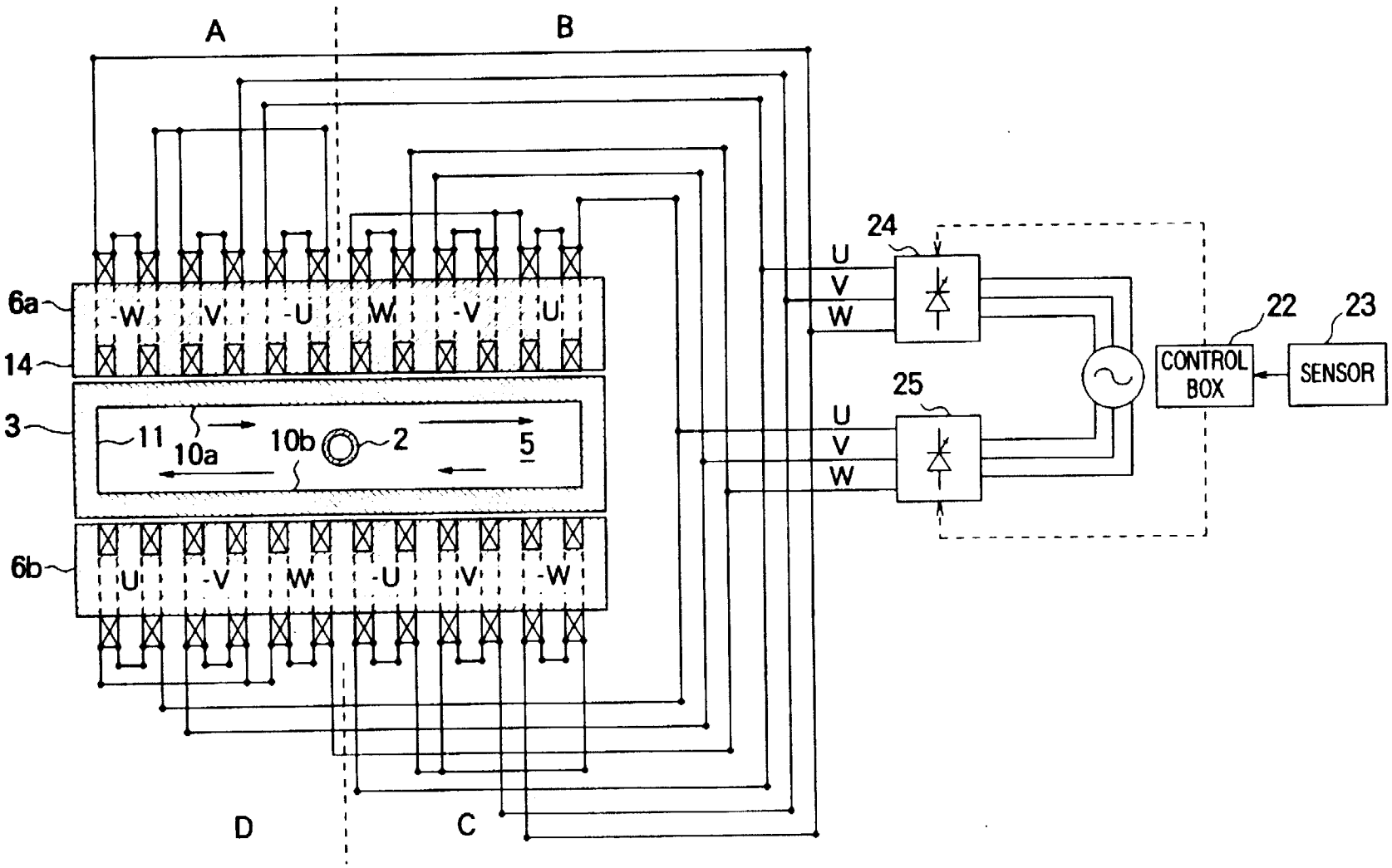
FIG. 20 is a sectional view and circuit diagram showing the continuous casting apparatus according to the second embodiment of the present invention.
Figure 21:
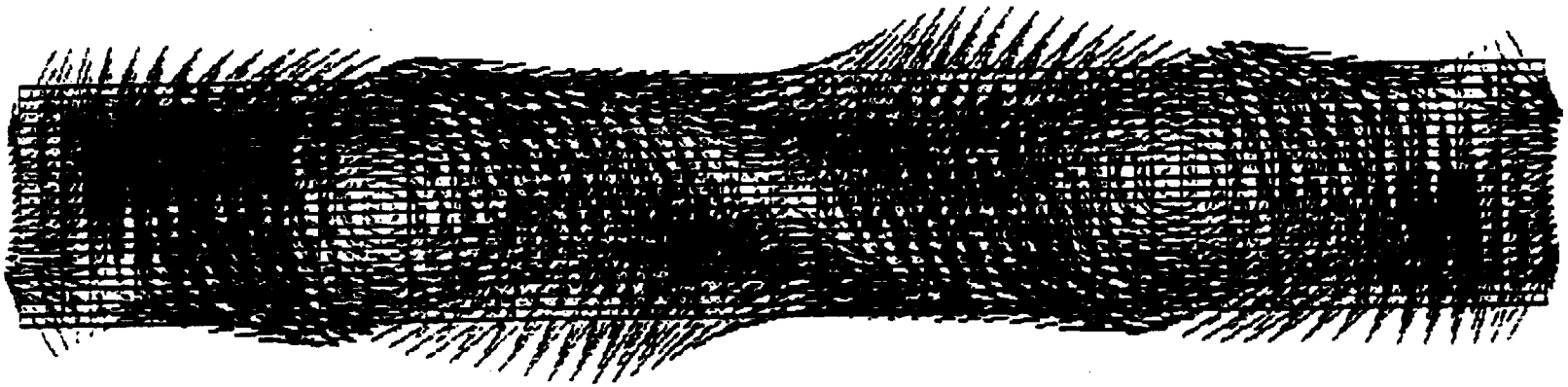
FIG. 21 is an explanatory view showing a distribution of electromagnetic stirring thrust caused in the second embodiment of the present invention.
Figure 22:
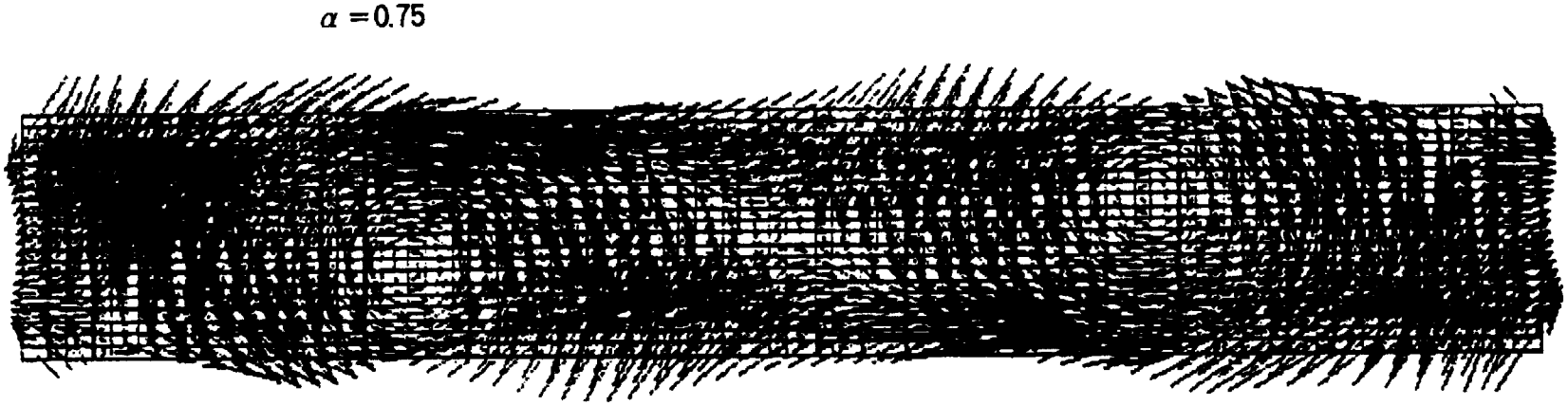
FIG. 22 is an explanatory view showing a distribution of electromagnetic stirring thrust caused in the second embodiment of the present invention.
Figure 23:
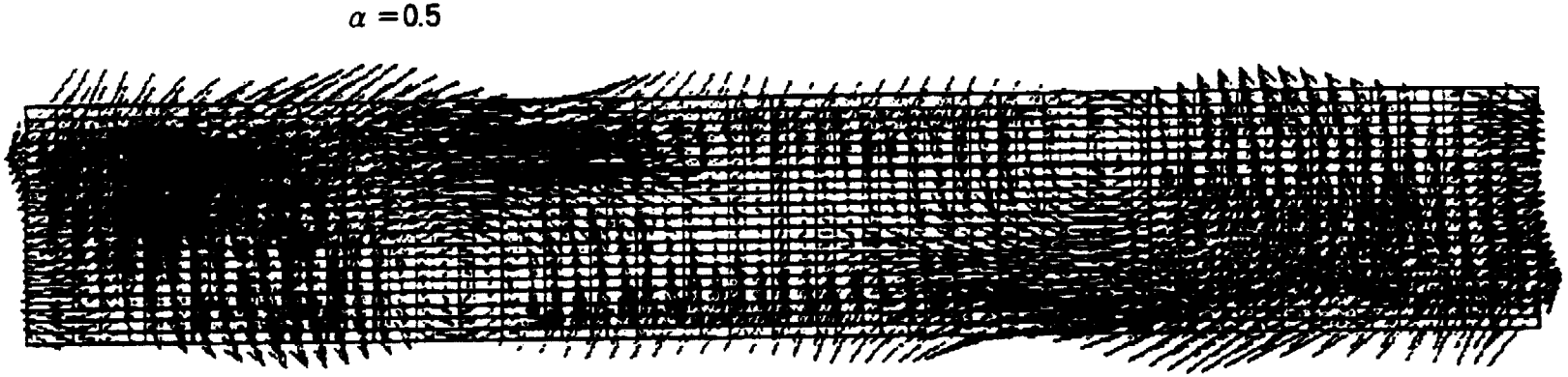
FIG. 23 is an explanatory view showing a distribution of electromagnetic stirring thrust caused in the second embodiment of the present invention.
Figure 24:
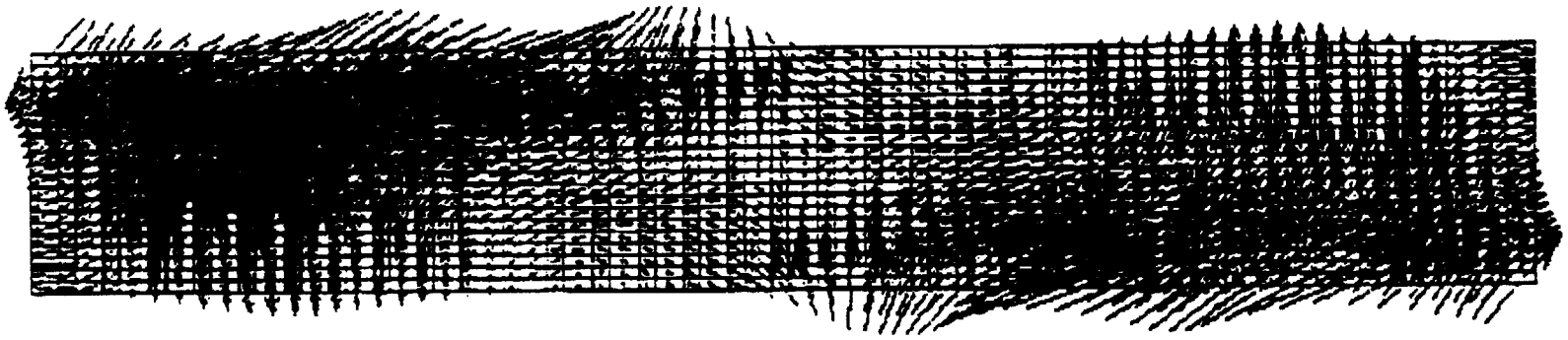
FIG. 24 is an explanatory view showing a distribution of electromagnetic stirring thrust caused in the second embodiment of the present invention.
Figure 25:
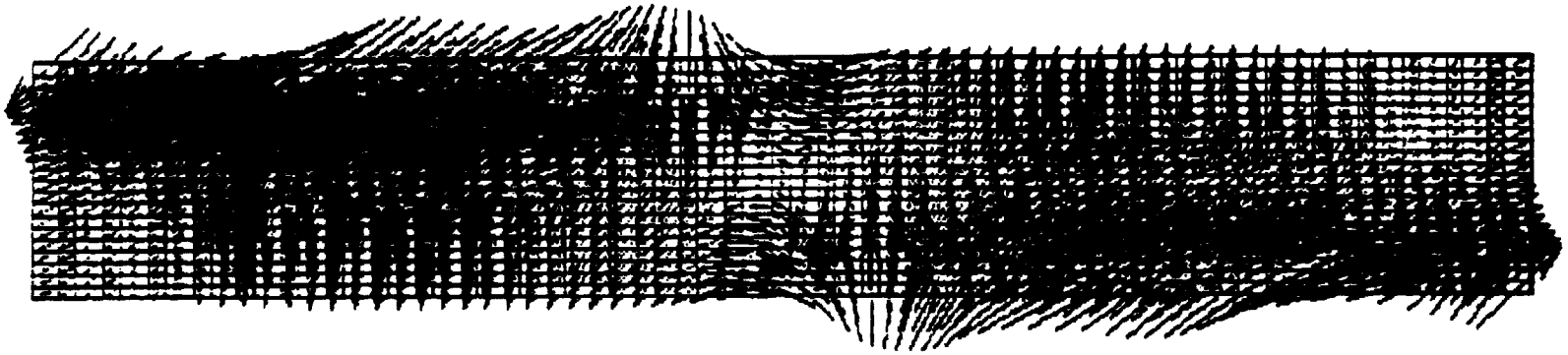
FIG. 25 is an explanatory view showing a distribution of electromagnetic stirring thrust caused in the second embodiment of the present invention.
Figure 26:
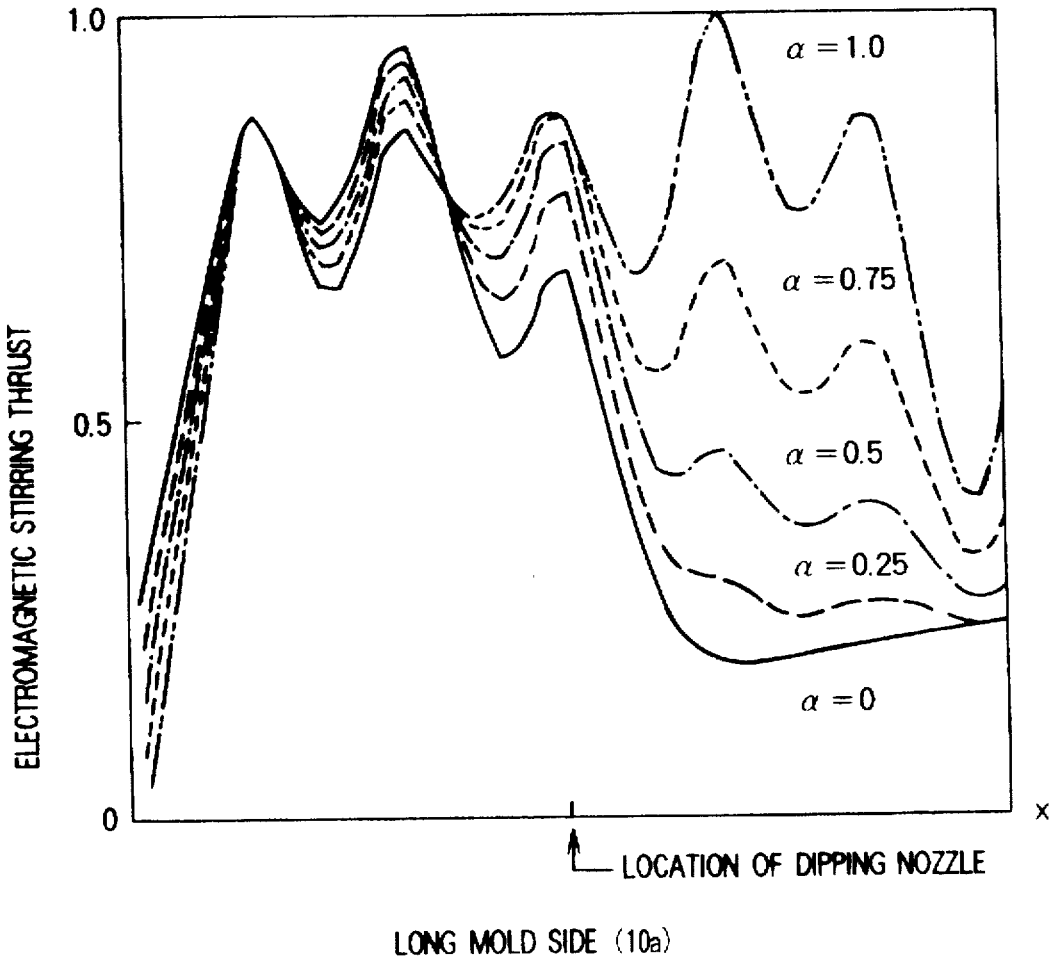
FIG. 26 is a graph showing distributions of electromagnetic stirring thrust caused in the second embodiment of the present invention.

Next, the simulated result of this embodiment will be described. As shown in FIG. 20, the molten metal is circulated on the meniscus 5 by using the device including the subcircuits-A and C connected to a first power supply 24 and the subcircuits B and D connected to a second power supply 25. The first and the second power supplies 24 and 25 are both operated in a frequency of 1.8 Hz and assuming that the first power supply 24 has a current density $I_1$ of $8.319\times10^6$ $AT/m^2$ (peak value). FIGS. 21 to 25 illustrate the distributions of electromagnetic stirring thrust on the meniscus according to the change of current density $I_2$. The formats of these figures are the same as that of FIG. 4. In these figures, $\alpha$ is $I_1/I_2$. Further, FIG. 26 shows the thrust components oriented toward the long side 10*a* of the mold as in FIGS. 21 to 25. Those thrust components are indicated by a ratio having a value of 1.0 as a maximum thrust value.

As will be understood from FIGS. 21 to 25, by changing the currents of the two power supplies, it is possible to change the distribution of the electromagnetic stirring thrust on the meniscus. By adjusting a value of $\alpha$ as the operator is observing the molten metal flow on the meniscus, it is also possible to give rise to the uniform flow of the molten metal on the meniscus. This uniform flow leads to forming a metal slab with no surface defect, according to an experiment.

Moreover, in the casting apparatus shown in FIG. 20, by changing the phase differences between the power supplies 24 and 25, the location of a thrust eddy on the meniscus is changed. This locational change of the eddy results in forming a slab with an excellent surface property.

In the casting apparatus as shown in FIG. 16, by adjusting the current of each power supply as an operator is observing the molten metal flow on the meniscus, the molten metal is circulated on the meniscus 5. After the casting is completed, one side of the dipping nozzle 2 is closed as shown in (4) of FIG. 19. During the casting operation, however, the uniform flow of the molten metal is kept constantly. This results in forming a slab with an excellent surface property.

In the continuous casting of a metal slab made of steel, for example, the casting apparatus of this embodiment operates to uniformly circulate the in-mold molten metal on the meniscus or apply a brake on or an acceleration to a reverse flow. If the flow of the molten metal is continuously changed, the casting apparatus is capable of continuously changing the electromagnetic stirring thrust for overcoming a disadvantageous eddy possibly caused by the stirring thrusts. This makes it possible to form a metal slab with an excellent surface property. Also, the system with two or four power supplies needs the same total power capacity as the system with one power supply. Hence, the equipment cost is made relatively low.

Next, the description will be oriented to a third embodiment of the invention.

In the aforementioned first to second embodiments, to exert a stable circulation, it is necessary to bring about a strong electromagnetic force. For example, in FIG. 27, a right half part of the linear motor 6F and a left half part of the linear motor 6L, both of which are serve as an electromagnetic stirring coil parts, need to apply an electromagnetic force strong enough to overcome the flow of molten metal injected from the dipping nozzle to the mold. Normally, hence, the linear motor 6F or 6L has a few poles, like two or four poles. The following accounts for this reason. Assuming that $\tau_s$ denotes a disposition pitch of slots (that is, a ditch around which an electric coil is wound or inserted) of the linear motor located along one side of the mold, n denotes a number of slots, L denotes a length of a mold side of the linear motor, M denotes a number of phases of alternating current to be conducted through the coil (normally, M=3), $\tau_p$ denotes a poll pitch, and N denotes a number of poles, the following relation will be established.

$$L = \tau_s \times n \quad (1)$$
$$= \tau_p \times N \quad (2)$$
$$\tau_p = m \times \tau_s \quad (3)$$
$$m = n/M \quad (4)$$

As such, to enlarge the electromagnetic force, it is necessary to reduce a leak inductance component. For this purpose, the poll pitch $\tau_p$ is made longer. That is, as will be understood from the expression (3), the slot pitch $\tau_s$ is made longer. Hence, from the expressions (1) and (2), L is a constant (needed length). It means the number of poles N is made smaller. This accounts for why the number of poles N provided in the conventional linear motor is as small, such as two or four.

Figure 33:
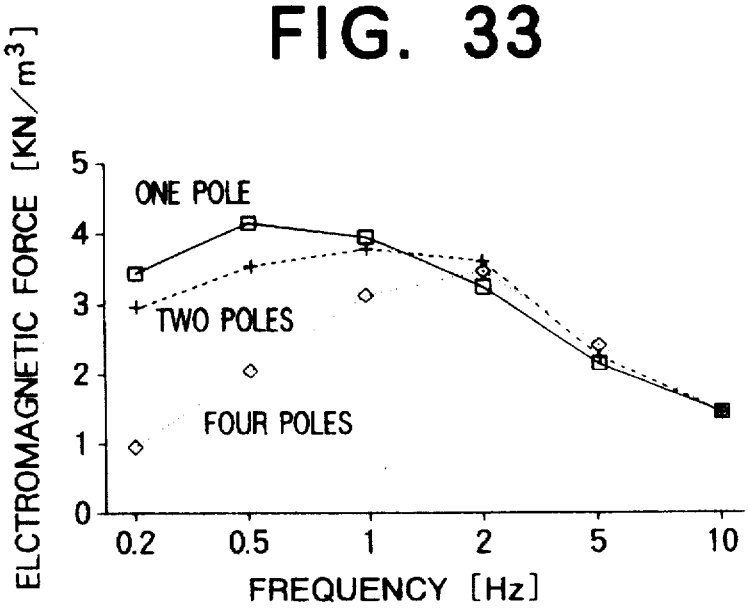
FIG. 33 is a graph showing a relation between an applied AC frequency and electromagnetic force of the linear motor for each number of poles.

Further, the conventional apparatus has a small frequency of alternating current to be conducted through the electric coils, for example, 1 to 2 Hz. As shown in FIG. 33, for two poles, the electromagnetic force becomes a maximum at the frequency of substantially 1 Hz. For four poles, the electromagnetic force becomes a maximum at the frequency of substantially 2 Hz.

The continuous casting apparatus according to this embodiment enables stronger electromagnetic force to be applied and is intended to more affectively prompt bubbles to be floated up, prevent powder from being entrained in the flow of the molten metal, or wipe the inner side of the mold nearby the surface layer of the molten metal.

As shown in FIGS. 27 to 32, the continuous casting apparatus for continuously casting a metal slab according to this embodiment includes linear motors 6F and 6L located along the sides of the mold and conducting means 30A, 30B for conducting alternating current in a manner to allow linear driving force to take place in each of electric coils. The linear motor has plural magnetic poles and plural electric coils for exerting those magnetic poles, respectively. Those magnetic poles are ranged around the mold 3 enclosing the molten metal 1. As a first feature, this continuous casting apparatus is characterized in that the linear motor has five or more poles. As a second feature, the continuous casting apparatus is characterized in that the conducting means operates to conduct a 4 Hz or higher alternating current through the electric coils. As a third feature, the continuous casting apparatus is characterized in that an ampere turn value is 1200 AT/cm or higher.

Figure 27:
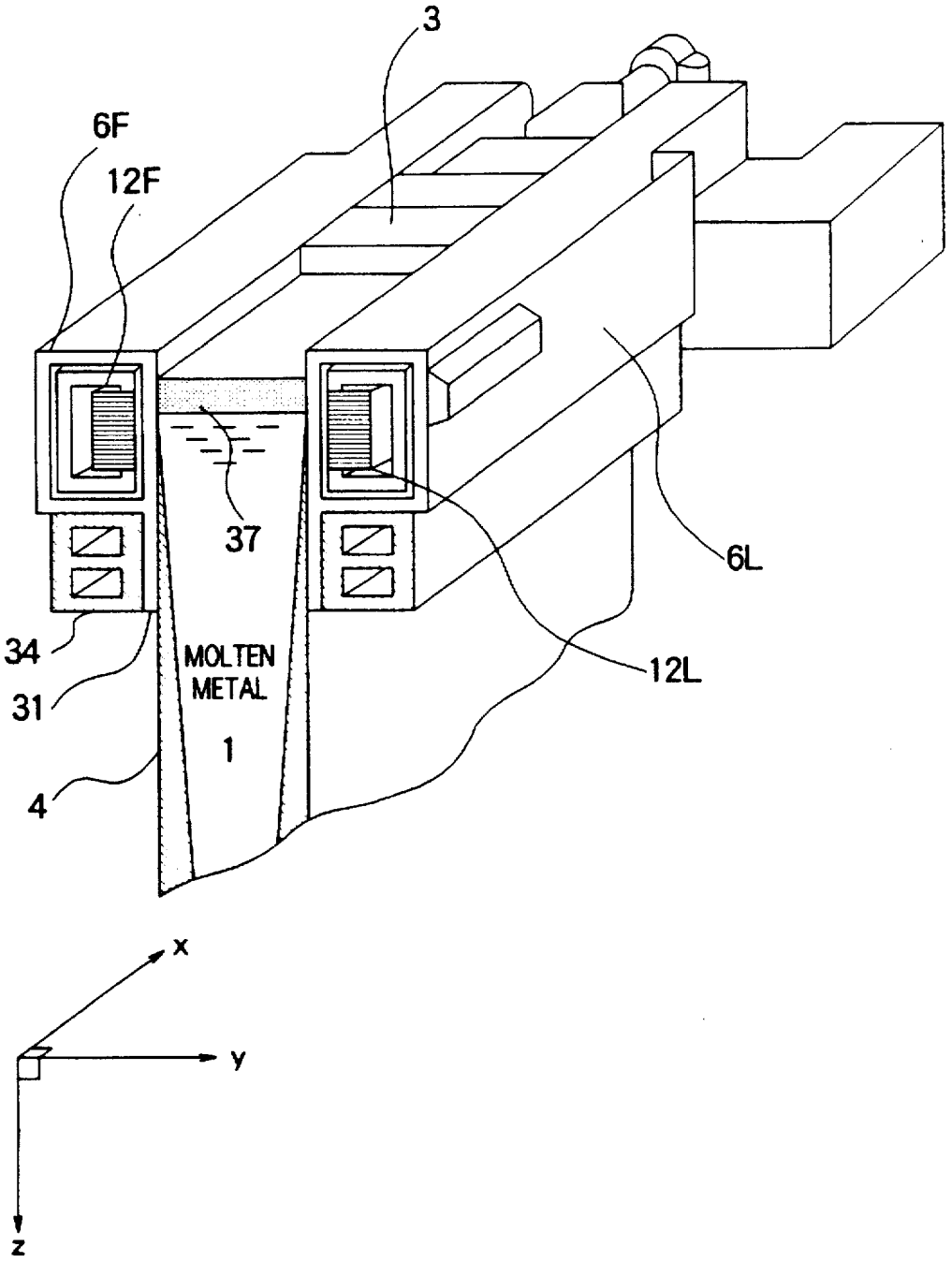
FIG. 27 is a perspective view showing an outer appearance and a central sectional view of a continuous casting apparatus according to a third embodiment of the present invention.
Figure 34:
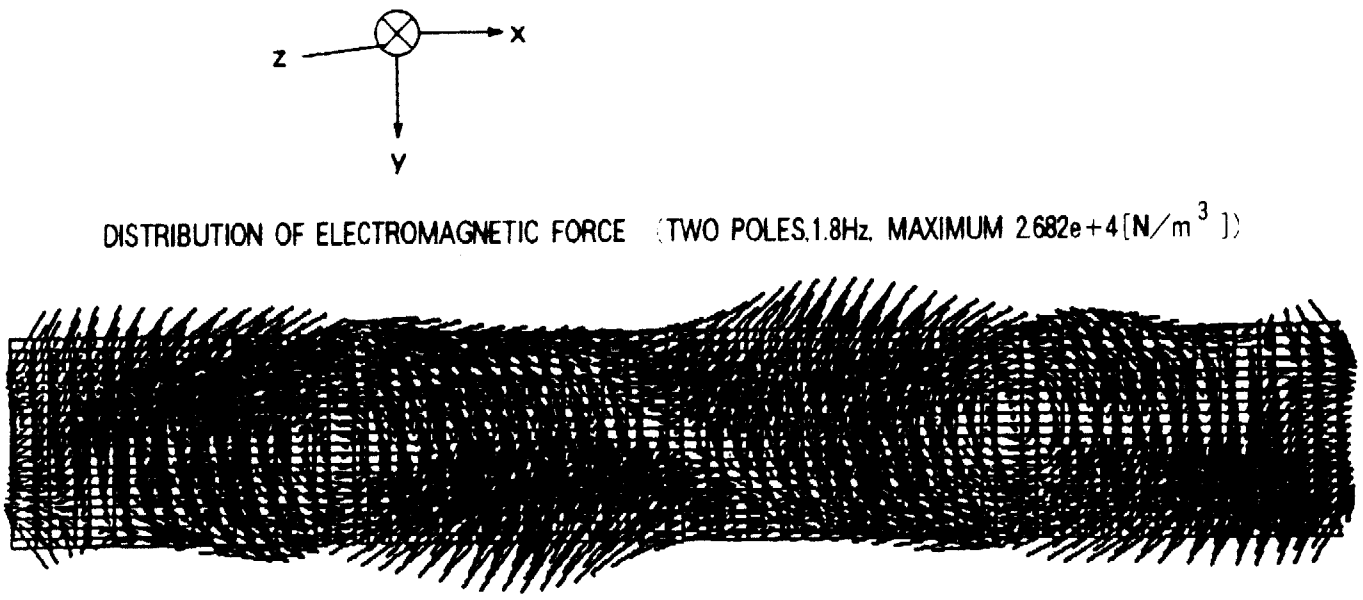
FIG. 34 is a plane view showing a distribution of electromagnetic force caused by two two-pole linear motors.
Figure 35:
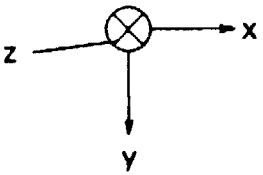
FIG. 35 is a plane view showing a distribution of electromagnetic force caused by two four-pole linear motors.
Figure 35:
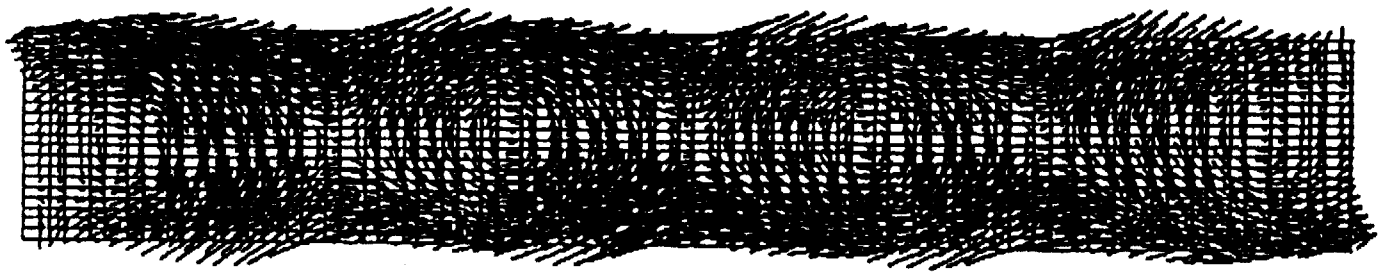
Figure 36:
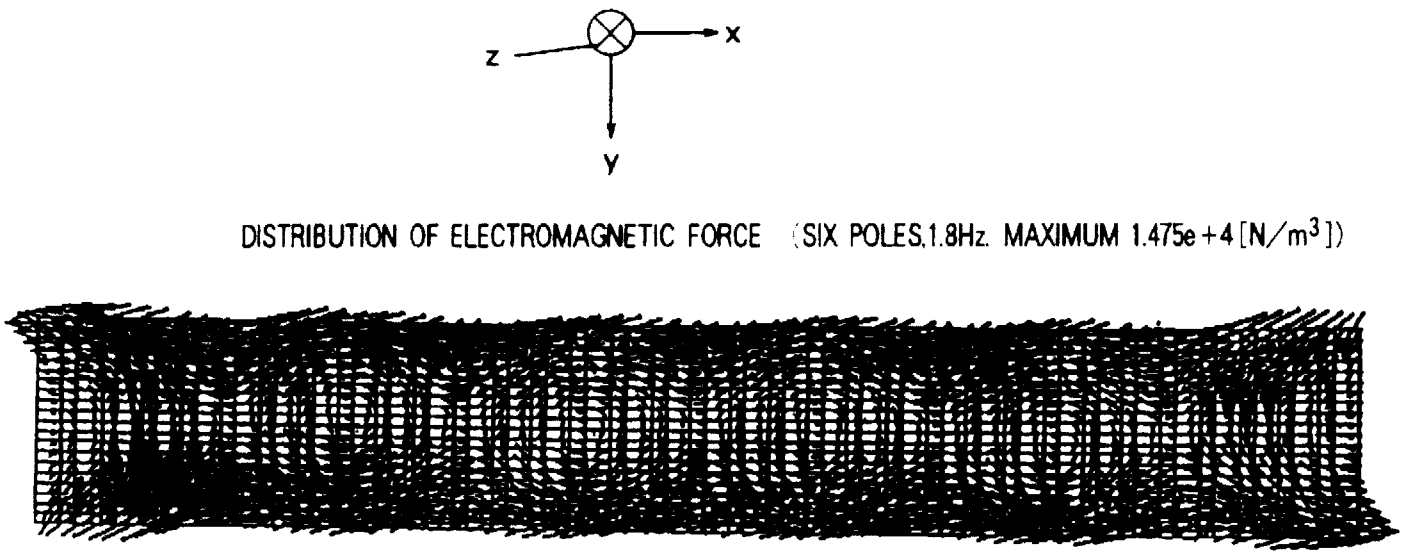
FIG. 36 is a plane view showing a distribution of electromagnetic force caused by two six-pole linear motors.
Figure 37:
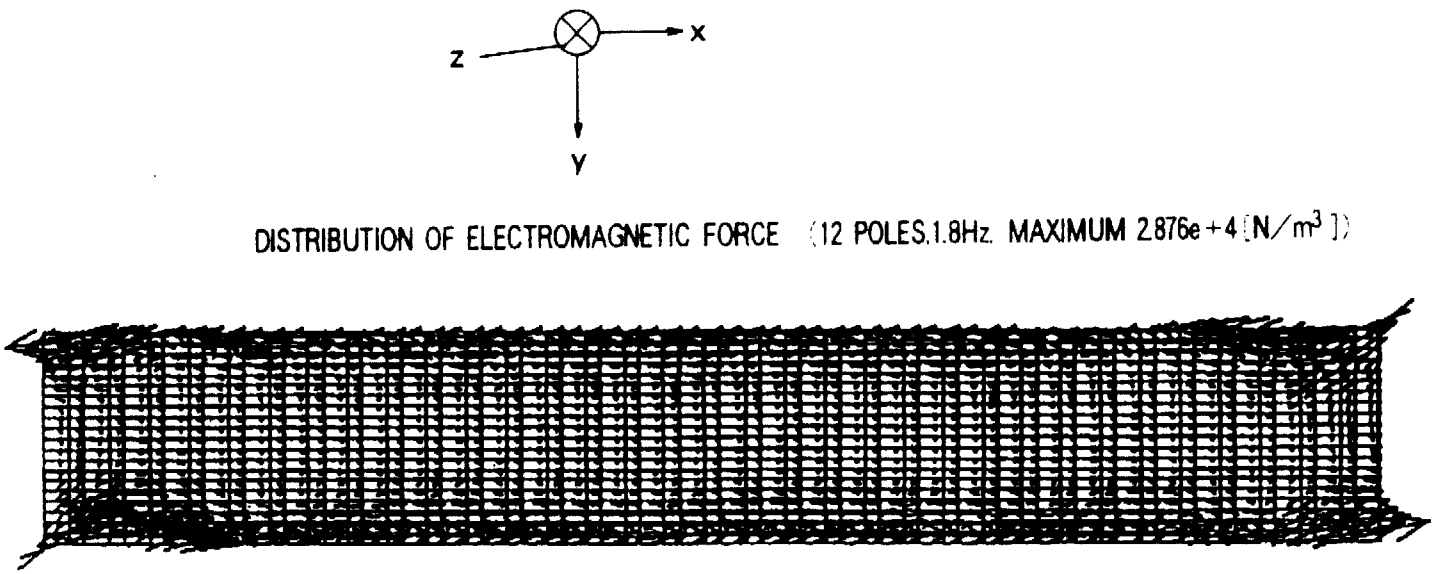
FIG. 37 is a plane view showing a distribution of electromagnetic force caused in two 12-pole linear motors.

The variable distributions of electromagnetic force applied to the surface of the molten metal in the mold are shown in FIGS. 34 to 37. Each of these distributions corresponds to a value of a magnetic pole N. FIG. 34 shows the distribution of N=2. FIG. 35 shows the distribution of N=4. FIG. 36 shows the distribution of N=6. FIG. 37 shows the distribution of N=12. These figures illustrate by arrows the distribution of electromagnetic force on the horizontal surface of the molten metal 1 in the mold on the assumption that the mold is laid between the linear motors is 6F and 6L, each of those motors composed of slots of n=36 (that is, 36 electric coils) located along one long side of the mold, as shown in FIG. 27. In these figures, an arrow head indicates the direction of electromagnetic force. An arrow length indicates the strength of the electromagnetic force. This corresponds to the electromagnetic force (integrated value) taking place for one period if a three-phase current (M=3) of 1.8 Hz is conducting through the coils.

In the distribution of N=2 shown in FIG. 34, the electromagnetic force is large, but the electromagnetic force component is too large in the y-axial direction along the short side of the mold (the arrow is longer in the y-axial direction as shown in FIG. 34). Hence, the electromagnetic force is eddied counter-clockwise at two spots, that is, each is on the right and the left of the mold (in the y-axial direction). This eddy force gives rise to an eddy of the molten metal 1. This eddy may entrain the powder in the molten metal. Further, the distribution of the electromagnetic force components in the x-axial are distorted. This makes it difficult to evenly wipe the inside of the mold in the x-axial direction. This may partially stop the flow of the molten metal.

In the distribution of N=4 shown in FIG. 35, the electromagnetic force is eddied at four portions, that is, two at each the right and the left of the mold (in the y-axial direction). As the eddies increase in number, the y-axial electromagnetic force components (oriented along the short side of the mold) are made weaker. However, since the y-axial components are still strong, the powder may be entrained in the flow of the molten metal. Moreover, the distribution of the electromagnetic force in the x-axial direction is distorted along the wall of the mold (inner surface of the long side). This makes it difficult to evenly wipe out the inner side of the mold in the x-axial direction. As mentioned above, in the distributions of N=2 and N=4, it is understood that the prevention of entrainment of the power or the even wipe on the inner surface of the mold is not completed sufficiently.

In the distribution of N=6 shown in FIG. 36, about six eddies are recognized. However, the eddy is so weak that the powder may not be entrained in the molten metal. Further, along the inner surface of the mold long side, the electromagnetic force components at the outer edges of the adjacent eddies make a connection, so that the force components in the y-axial direction are made quite small and the force components in the x-axial direction are made even over the overall long side (x-axial direction). Hence, the flow occurs along the peripheral inner surface of the mold in a constant direction (x-axial direction) and at a constant speed. Therefore, the inner surface of the mold is evenly wiped out and the bubbles are prompted to be float up.

In the distribution of N=12 as shown in FIG. 37, the y-axial electromagnetic force component is substantially nullified, so that-no eddy is formed. The current flow takes place only along the peripheral inner surface of the mold. This distribution is, therefore, highly effective in preventing powder from being entrained in the flow of the molten metal. Further, the x-axial electromagnetic force components are made even over the overall long side of the mold (in the x-axial direction). The current flow takes place along the inner peripheral surface of a mold in the constant direction (x-axial) and at a constant speed. Therefore, the inner surface of the mold is evenly wiped out by the flow and the bubbles are prompted to float up.

According to the first feature of this embodiment, the linear motor used in this embodiment has five or more poles, which are more numerous than those provided in the conventional continuous casting apparatus. This may bring about the same function and effect as those described with reference to FIGS. 36 and 37.

As described above, the conventional apparatus uses a linear motor with two or four poles. Further, if the two-pole linear motor is used, the maximum electromagnetic force can be obtained at a frequency of 1 Hz. If the four-pole linear motor is used, the maximum electromagnetic force can be obtained at a frequency of 2 Hz. Hence, the conventional apparatus is arranged to flow a three-phase current of 1 to 2 Hz through the linear motor. If the frequency is as low as this value, the penetration of the magnetic force into the molten metal is made so deep that the electromagnetic force applied to the inside of the molten metal is strong. This strong force may bring about a strong current as shown in FIGS. 34 and 35.

Figure 38:
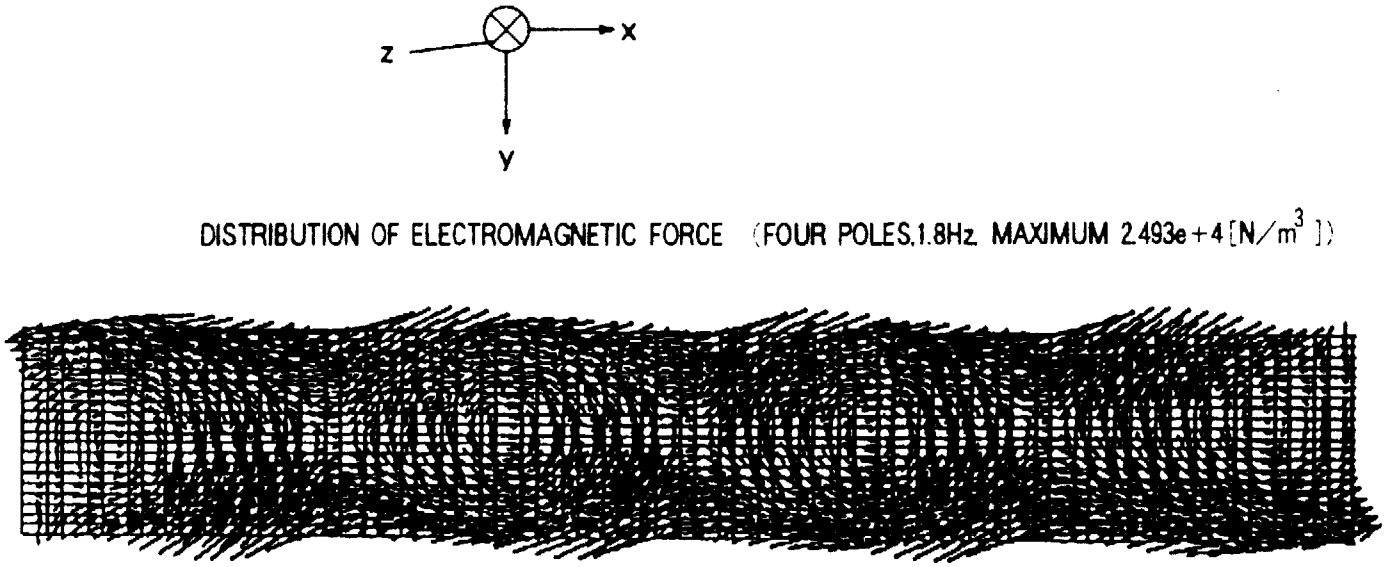
FIG. 38 is a plane view showing a distribution of electromagnetic force caused by applying three-phase alternating current of 1.8 Hz to two four-pole linear motors.
Figure 39:
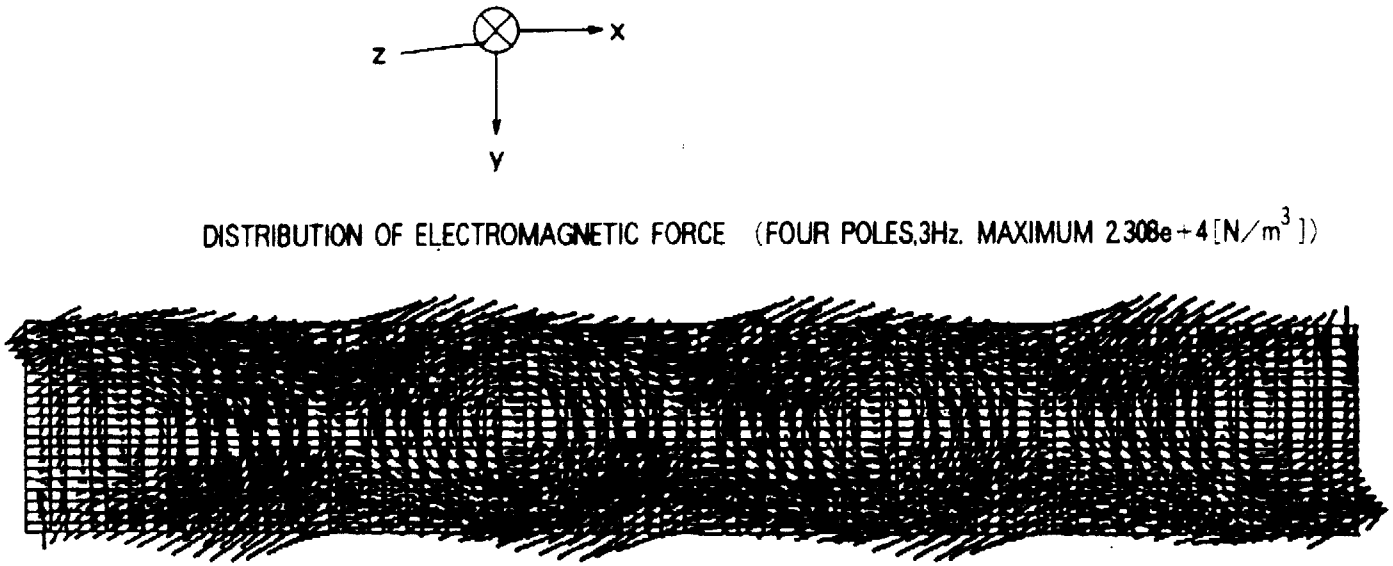
FIG. 39 is a plane view showing a distribution of electromagnetic force caused by applying three-phase alternating current of 3 Hz to two four-pole linear motors.
Figure 40:
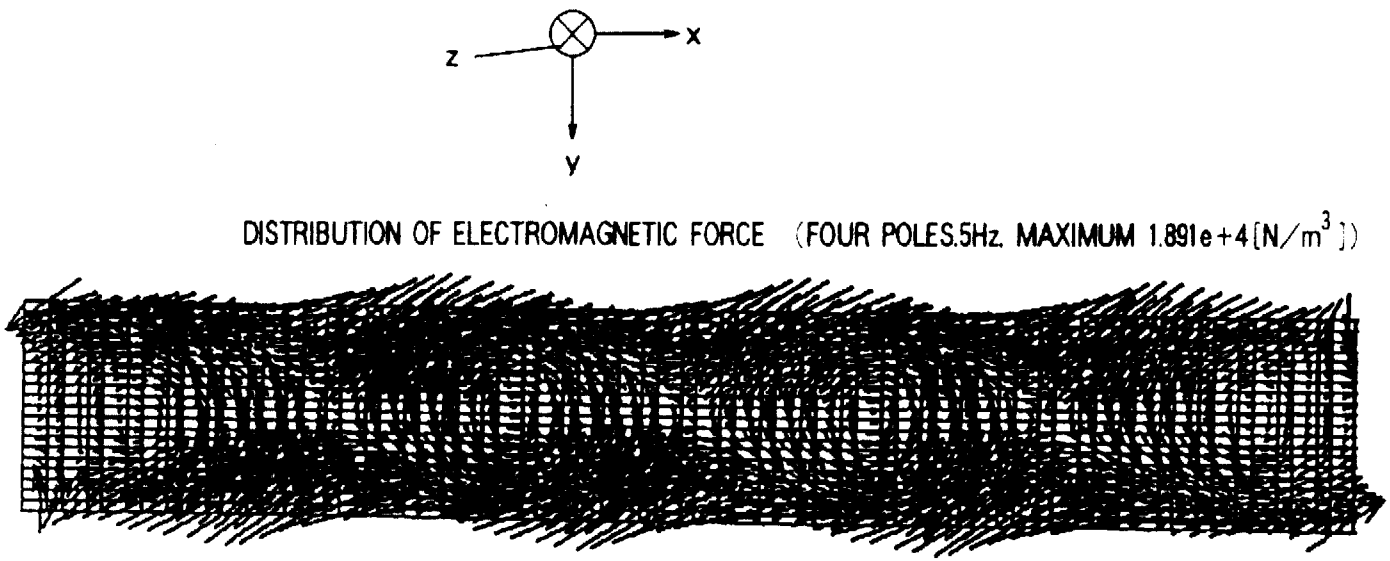
FIG. 40 is a plane view showing a distribution of electromagnetic force caused by applying three-phase alternating current of 5 Hz to two four-pole linear motors.
Figure 41:
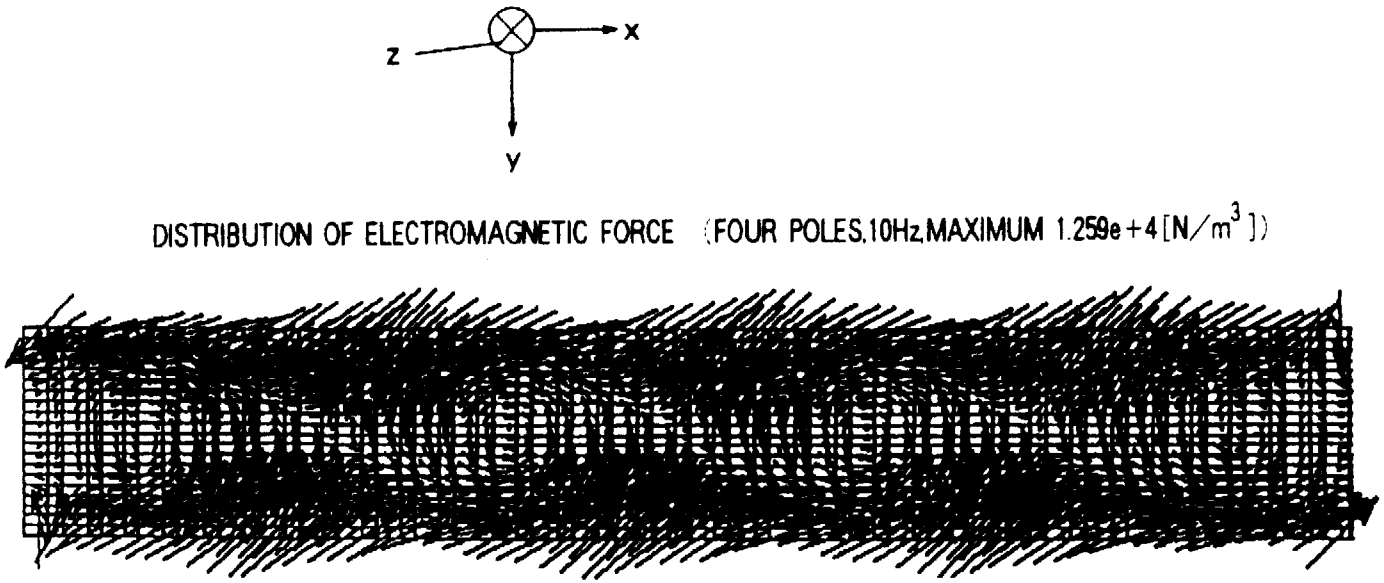
FIG. 41 is a plane view showing a distribution of electromagnetic force caused by applying three-phase alternating current of 10 Hz to two four-pole linear motors.
Figure 42:
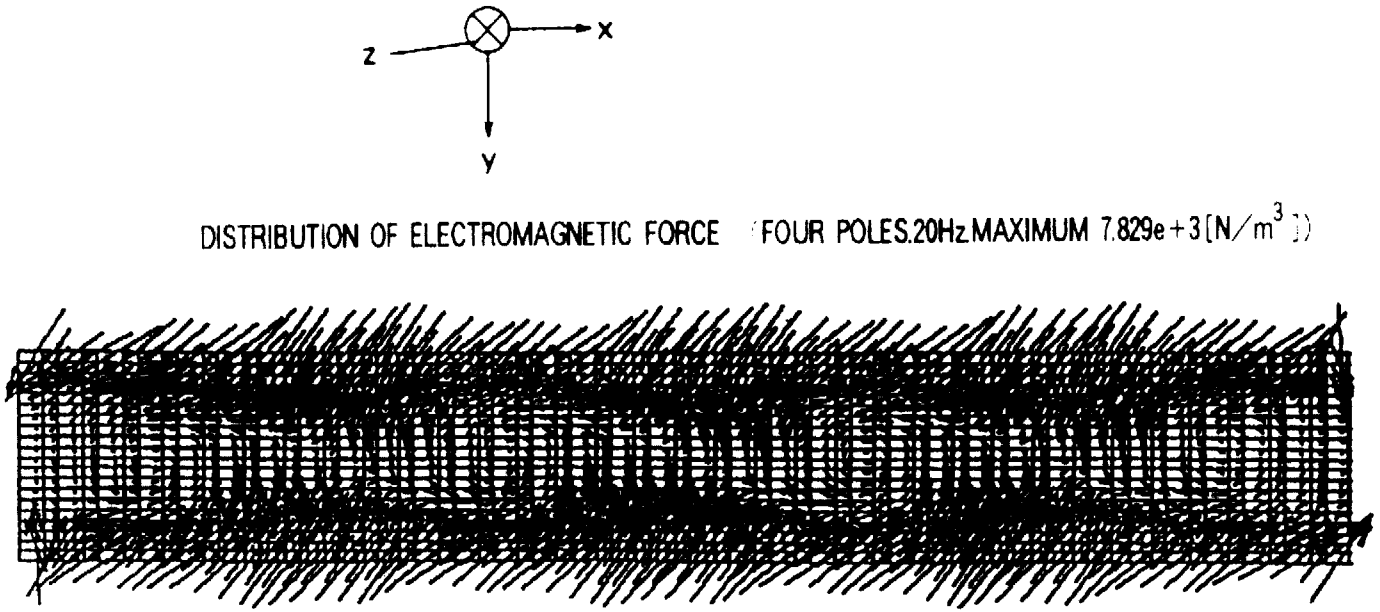
FIG. 42 is a plane view showing a distribution of electromagnetic force caused by applying three-phase alternating current of 20 Hz to two four-pole linear motors.

The variable distributions of electromagnetic force applied to the surface of the molten metal in the mold are shown in FIGS. 38 to 42. Each distribution corresponds to an AC frequency applied to the electric coil. For example, FIG. 38 shows the distribution for a frequency of 1.8 Hz. FIG. 39 shows the distribution for 3 Hz. FIG. 40 shows the distribution for 5 Hz. FIG. 41 shows the distribution for 10 Hz. FIG. 42 shows the distribution for 20 Hz. These figures illustrate by arrows the distribution of electromagnetic force on the horizontal surface of the molten metal 1 in the mold on the assumption that the mold is laid between the linear motors 6F and 6L, each of those motors includes slots of n=36 (that is, 36 electric coils) located along one long side of the mold, as shown in FIG. 27. In these figures, an arrow head indicates the direction of electromagnetic force. An arrow length indicates the strength of electromagnetic force. This corresponds to the electromagnetic force (integrated value) taking place for one period if a three-phase current (M=3) of 1.8 Hz is conducting through the linear motor with four poles (N=4).

Comparing the distributions shown in FIGS. 38 to 42 with one another, as a frequency is made higher, the y-axial electromagnetic force components are increased and the x-axial force components are decreased. However, the overall electromagnetic force is made lower in the molten metal, so that the eddy inside-of the molten metal is made weaker. The weaker eddy leads to a lower possibility of causing powder to be entrained in the molten metal. According to the second feature of the present invention, the frequency to be applied to the linear motor is 4 Hz or higher, which is higher than that to be applied in the conventional apparatus. The higher frequency leads to reducing the possibility of causing powder to be caught in the eddy of the-molten metal. If the poles are increased in number and the frequency is made greater, the electromagnetic force is smaller than that as shown in FIG. 33. Hence, to secure a certain level of stirring speed to keep the same electromagnetic force as that of the conventional apparatus, it is necessary to increase a current value, generally, an ampere turn value (strength of a magnetic field) indicated by the following expression:

$$\text{Ampere turn value}=(I\times Ns)/\tau_s \quad (5)$$

wherein I denotes a value of current flowing through a coil and Ns denotes a number of winds per one slot. The conventional ampere turn value is 800 AT/cm. Hence, if the poles are increased in number and the frequency is enhanced, it is preferable to enhance the electromagnetic force by flowing the current having at least an ampere turn value of 1200 AT/cm or higher.

The continuous casting apparatus according to this embodiment is arranged to use the linear motor with more poles than those of the conventional apparatus, for example, five or more poles, and to apply alternating current having a frequency of 4 Hz or higher to the linear motor for greatly reducing the eddy appearing inside of the molten metal. That is, though the higher frequency increases the y-axial force components, it is offset by the increase of poles.

FIG. 27 shows a continuous casting apparatus according to the third embodiment of the invention. As shown, molten metal 1 is injected into a space defined by an inner wall 31 of a casting mold 3 through a dipping nozzle (corresponding to the dipping nozzle 2 of FIG. 5). The meniscus of the molten metal 1 is covered by powder 37. The casting mold is cooled down by cooling water flowing in a water box 34. The molten metal 1 becomes made more solid progressively from the outside to the inside. Then, a cast piece (coagulated shell) 4 is continuously pulled-out of the mold. As it is being pulled, the molten metal is continuously injected to the mold. Hence, the molten metal is constantly kept in the casting mold. Two linear motors 6F and 6L are provided on the meniscus level (in the height direction z) of the molten metal 1. These linear motors operate to apply electromagnetic force to the portion immediately below the meniscus of the molten metal 1 (surface area).

Figure 28:
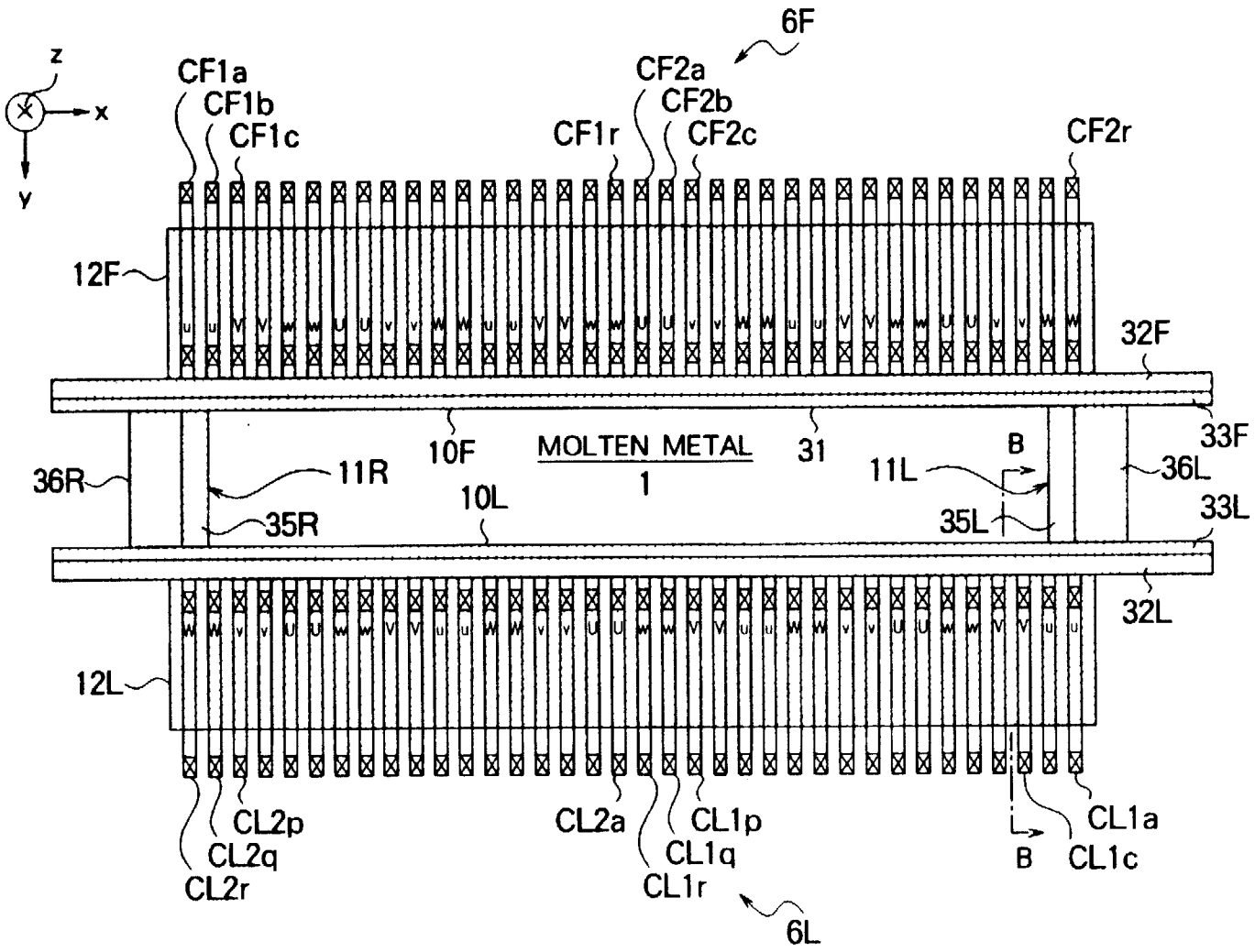
FIG. 28 is an expanded cross section showing a horizontal sectional view of cores 12F and 12L shown in FIG. 27.
Figure 29:
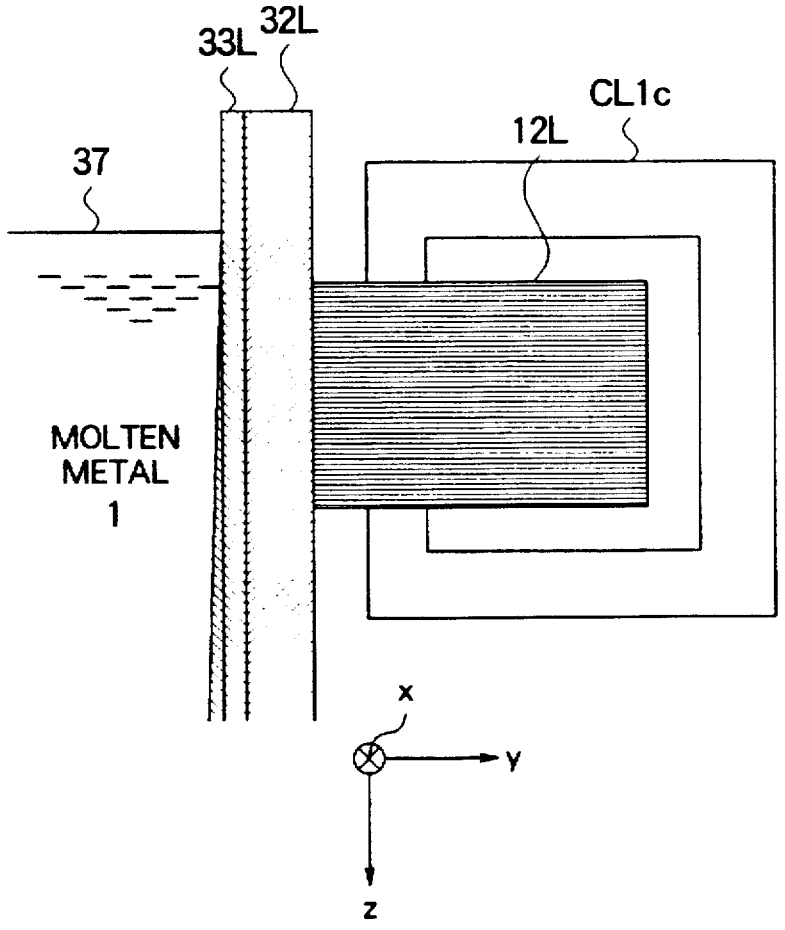
FIG. 29 is an expanded sectional view showing the cores cut on the line B—B of FIG. 28.

FIG. 28 is a horizontally cut section showing the wall 31 shown in FIG. 27 and the cores 12F and 12L of the linear motors 6F and 6L. FIG. 29 is an expanded section showing the casting apparatus cut on the line B—B of FIG. 28. The inner wall 31 of the mold includes long sides 10F and 10L opposed to each other and short sides 11R and 11L opposed to each other. Each side is composed of steel plates 33F, 33L, 35R and 35L and non-magnetic stainless plates 32F, 32L, 36R and 36L for backing the corresponding steel plates.

In this embodiment, the cores 12F and 12L of the linear motors 6F and 6L are slightly longer than the effective lengths of the long sides 10F and 10L of the mold (the x-axial length of the long side with which the molten metal 1 contacts). Along the overall length of each core, 36 slots are formed at predetermined 36 pitches. The slots of the core 12L provide a first group of electric coils CL1*a* to CL1*r* and a second group of electric coils C12*a* to C12*r*, respectively.

The linear motors 6F and 6L operate to apply thrust indicated by arrows of FIG. 5 to the molten metal 1. The first group of electric coils CF1*a* to CF1*r* of the linear motor 6F are responsible for applying weak thrust to the molten metal, while the second group of electric coils CF2*a* to CF2*r* are responsible for applying strong thrust to the molten metal. Hence, the first group of electric coils CF1a to CF1*r* may be provided with smaller winds. Actually, however, according to this embodiment, all the slots and all the electric coils of the linear motor 6F have the same specifications in order to adapt to another control, such as DC conduction for braking or adjustment of an x-axial thrust distribution within the group. In order to generate the respective thrusts in the first and the second groups, the different currents are passed through the corresponding groups. This will be discussed later. The above-mentioned arrangement and function are the same in the linear motor 6L.

Figure 30:
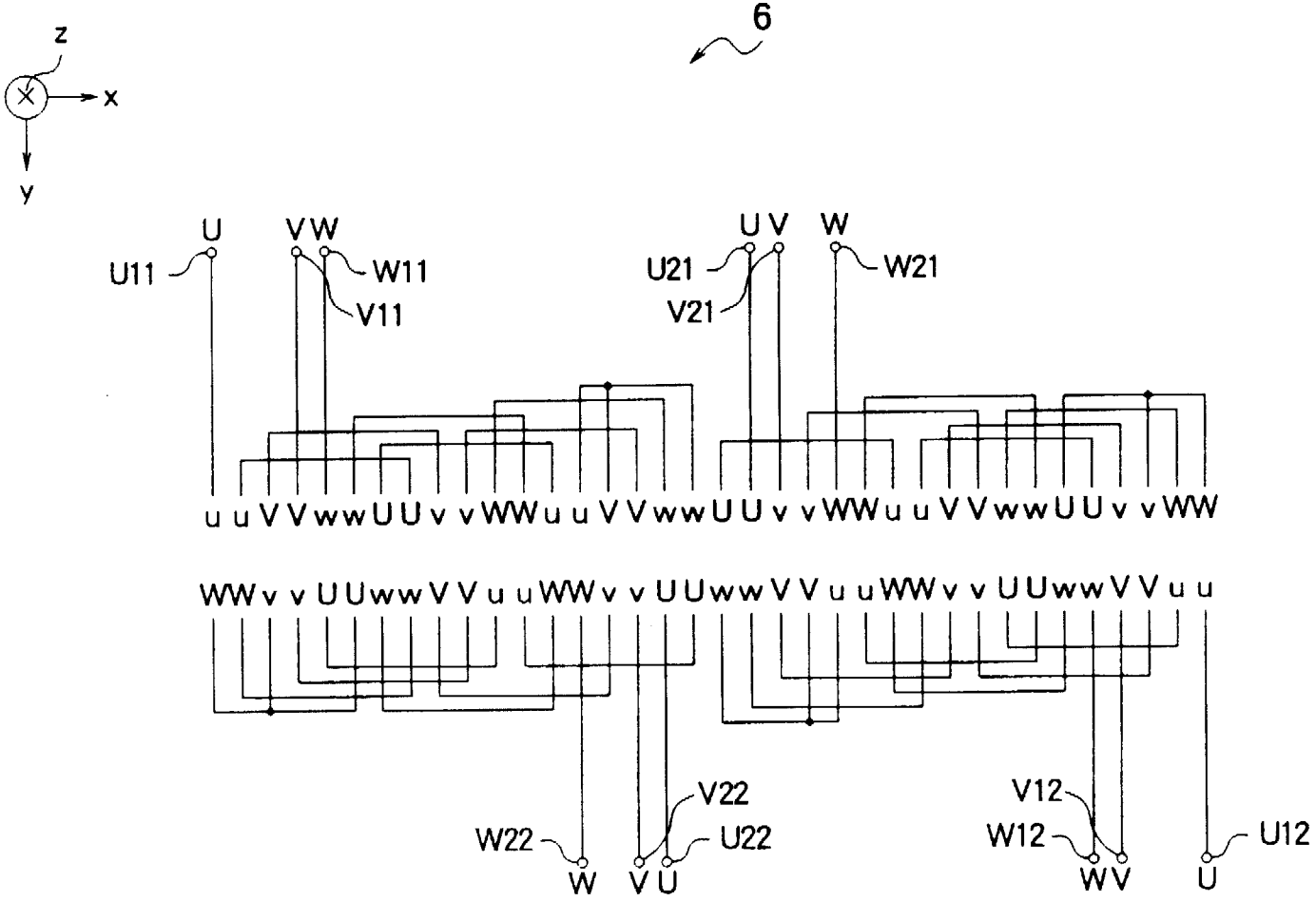
FIG. 30 is a circuit diagram showing wire connections of electric coils shown in FIG. 28.

FIG. 30 shows the wiring connections of all the electric coils in the group as shown in FIG. 28. These wiring connections are arranged to correspond to six poles (N=6) so that three-phase current (M=3) is passed through the electric coils. For example, in FIG. 30, the first group of electric coils CF1*a* to CF1*r* provided in the linear motor 6F are represented as u, u, V, V, w, w, U, U, v, v, W, W, u, u, V, V, w, and w, respectively, in which "NU" represents conduction of a positive U phase of a three-phase AC signal (straightforward conduction) and "u" represents conduction of a reverse U phase (conduction whose phase is shifted by 180° with respect to the U phase). The U phase is applied to a start end of the electric coil "U", while the U phase is applied to an end of the electric coil "u". Likewise, "V" represents conduction of a positive V phase of a three-phase AC signal. "v" represents conduction of a reverse V phase. "W" represents conduction of a positive W phase of a three-phase AC signal. "w" represents conduction of a reverse W phase. The terminals U11, V11 and W11 shown in FIG. 30 are power supply connectors of the first group of electric coils CF1*a* to CF1*r*. The terminals U21, V21 and W21 are power supply connectors of the second group of electric coils CF2*a* to CF2*r* provided in the linear motor 6F. The terminals U12, V12 and W12 are power supply connectors of the first group of electric coils CL1*a* to CL1*r* provided in the linear motor 6L. The terminals U22, V22 and W22 are power supply connectors of the second group of electric coils CF2*a* to CF2*r* provided in the linear motor 6L.

Figure 31:
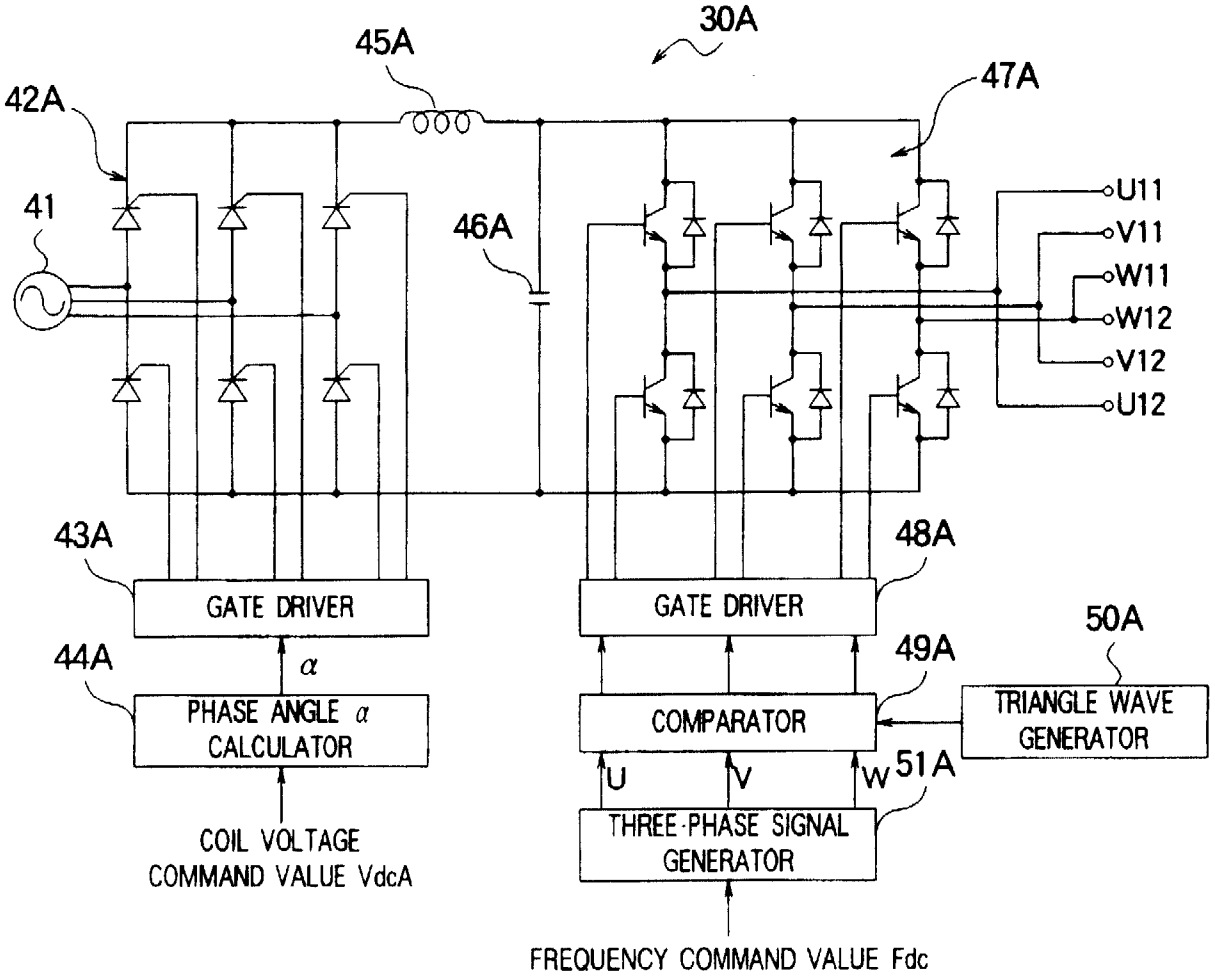
FIG. 31 is a circuit diagram showing a power supply circuit for applying a three-phase AC voltage to a first group of electric coils included in each linear motor shown in FIG. 28.

FIG. 31 shows a power supply circuit for flowing a three-phase AC signal through the first group of electric coils CF1*a* to CF1*r* provided in the linear motor 6F and a first group of electric coils CL1*a* to CL1*r* provided in the linear motor 6L. A three-phase AC power supply (three-phase power line) 41 is connected to a thyristor bridge 42A for DC rectification, the output (pulsating flow) of which is smoothed through the effect of an inductor 45A and a capacitor 46A. The smoothed DC voltage is applied to a power transistor bridge 47A for forming a three-phase AC signal. The power transistor bridge 47A operates to apply a U phase of a three-phase AC signal to the power supply connectors U11 and U12 shown in FIG. 30, V phase to the power supply connectors V11 and V12, and W phase to the power supply connectors W11 and W12.

The first group of electric coils CF1*a* to CF1*r* of the linear motor 6F and the first group of electric coils CL1*a* to CL1*r* of the linear motor 6L operate to generate small thrusts, indicated by arrows of FIG. 5, in response to a coil voltage command value VdcA. This coil voltage command value VdcA is applied to a phase angle α calculator 44A. The calculator 44A operates to calculate a conducting phase angle α (thyristor trigger phase angle) for the command value VdcA and then applies a signal representing the angle α to a gate driver 43A. The gate driver 43A operates to start a phase count from a zero-cross point of each phase and trigger a thyristor of each phase at a phase angle α. Then, through the triggered thyristor, the DC voltage represented by the command value VdcA is applied to the transistor bridge 47A.

On the other hand, a three-phase signal generator 51A operates to generate a constant voltage three-phase AC signal of a frequency (20 Hz in this embodiment) specified by a frequency command value Fdc and apply it to a comparator 49A. A triangular wave generator 50A operates to apply a constant voltage triangular wave of 3 KHz to the comparator 49A as well. If the U phase signal is positive, the comparator 49A operates to output a signal to a gate driver 48A for a U-phase positive interval (0 to 180 degrees) (for a transistor for outputting a U-phase positive voltage). This signal keeps its level high H (transistor on) if the U phase signal is equal to or higher than the triangular wave given by the generator 50A or keeps its level low L (transistor off) if the U phase is lower than the triangular wave. If the U phase signal is negative, the comparator 49A operates to output a signal to the gate driver 48A for a U phase negative interval (180 to 360 degrees) (for a transistor for outputting a U phase negative voltage). The signal keeps its level high H if the U phase signal is equal to or lower than the triangular wave given by the generator 50A or keeps its level low L if the U phase signal is higher than the triangular wave. This holds true for the V phase signal or the W phase signal. The gate driver 48A is actuated to turn on or off the transistors of the transistor bridge 47A in response to the signals for a positive or a negative interval of each phase.

Then, the transistor bridge 47A applies a U phase voltage of a three-phase AC signals to the power supply connectors U11 and U12, applies a V phase voltage of a three-phase AC signal to the power supply connectors V11 and V12, or applies a W phase voltage of a three-phase AC signal to the power supply connectors W11 and W12. These voltages are defined by the coil voltage command value VdcA. In this embodiment, this three-phase voltage frequency is defined as 20 Hz in response to the frequency command value Fdc. That is, the three-phase AC voltage of 20 Hz having a voltage value specified by the coil voltage command value VdcA is applied to the first group of electric coils CF1*a* to CF1*r* and CL1*a* to CL1*r* of the linear motors 6F and 6L shown in FIGS. 28 to 30.

Figure 32:
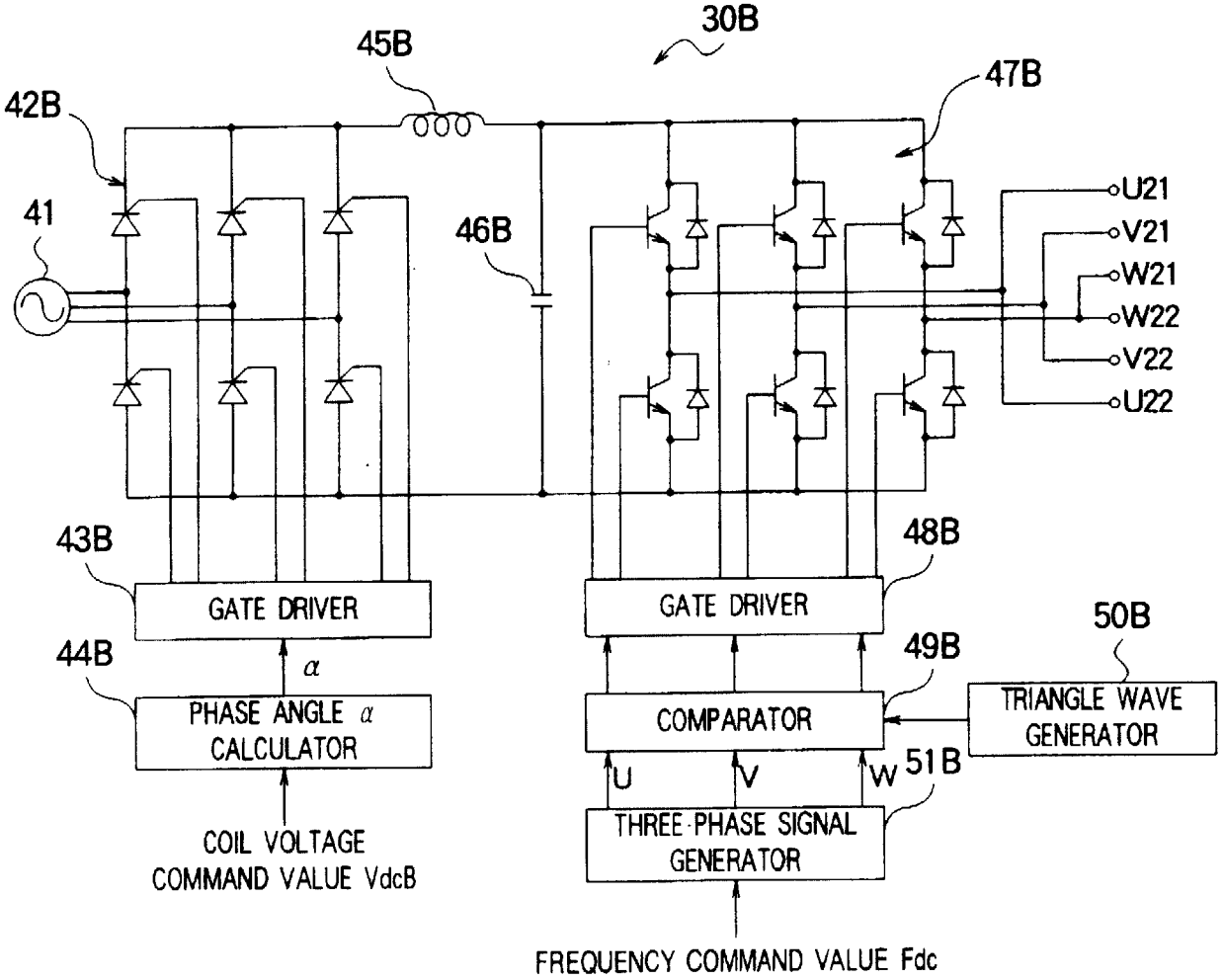
FIG. 32 is a circuit diagram showing a power supply circuit for applying a three-phase AC voltage to a second group of electric coils included in each linear motor shown in FIG. 28.

FIG. 32 shows a power supply circuit for conducting a three-phase AC signal to the second group of electric coils CF2*a* to CF2*r* of the linear motor 6F and the second group of electric coils CL2*a* to CL2*r* of the linear motor 6L. The arrangement of this circuit is the same as that shown in FIG. 5, except a coil voltage command value VdcB to be applied to a phase angle α calculator 44B. This coil voltage command value VdcB is defined to generate a larger thrust as indicated by arrows of FIG. 5. The power supply circuit operates to output a U phase voltage of three-phase current to the power supply connectors U21 and U22, a V phase voltage to the power supply connectors V21 and V22, and a W phase voltage to the power supply connectors W21 and W22. These voltage levels are defined by the coil voltage command value VdcB. In this embodiment, the frequency of a three-phase voltage is defined as 20 Hz in response to a frequency command value Fdc. That is, a three-phase AC voltage of 20 Hz is applied to the second group of electronic coils CF2*a* to CF2*r* and CL2*a* to CL2*r*.

As noted above, the continuous casting apparatus of this embodiment is arranged to apply three-phase current of 20 Hz to six-pole linear motors 6F and 6L. These linear motors 6F and 6L operate to apply thrust, indicated by arrows of FIG. 5, to the molten metal 1 inside of the mold wall 31. The thrust is synthesized with the flow (indicated by a real arrow of FIG. 2) of the molten metal injected from the dipping nozzle. The synthesis results in circulating the molten metal. The six poles provided in the linear motor are more than that of the conventional arrangement. Hence, about six eddies of the molten metal take place. However, the eddy motion is weaker, which lowers the possibility of catching powder in the eddies. Further, the electromagnetic forces of the outer edges of the adjacent eddies are concatenated close to the inner surfaces of the long sides of the mold, so that the y-axial thrust components are made quite small. The x-axial thrust components of the electromagnetic force on the overall length (in the x-axial direction) are made even. The molten metal flows around the inner surface of the mold in a constant direction (x-axial) and at a constant speed. This flow makes it possible to evenly wipe out the inner surface of the mold, thereby prompting the bubbles to float up. Further, the 20 Hz frequency is higher than that of the conventional arrangement, so that the eddy motion inside of the molten metal is quite weak. With increase of the frequency, it is likely that the y-axial thrust components are increased, but the x-axial components are decreased. More poles serve to suppress this likelihood.

According to the first feature of this embodiment, the linear motor provides more poles than the conventional arrangement. Hence, the eddy motion becomes weak, which lowers the possibility of catching the powder in the eddy. Further, the electromagnetic forces of the outer edges of the adjacent eddies are concatenated close to the inner surface of the long side of the mold so that the y-axial electromagnetic force components are kept to a minimum. Hence, the x-axial components extend evenly on the overall long side (in the x-axial direction), so that the molten metal flows around the inner surface of the mold a the constant direction (x-axial) and at a constant speed. This flow makes it possible to evenly wipe out the inner surface of the mold and prompt bubbles to float up.

According to the second feature of this embodiment, the AC frequency is higher than that of the conventional arrangement. Hence, the electromagnetic force inside of the molten metal is lower, thereby weakening the eddy motion inside of the molten metal. This leads to a lower possibility of catching powder in the molten metal.

Next, the description will be oriented to a fourth embodiment of the invention.

Figure 43A:
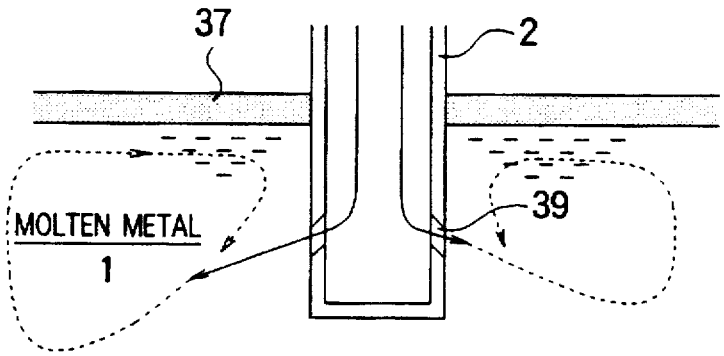
FIG. 43A is a sectional view showing molten metal in a mold.
Figure 43B:
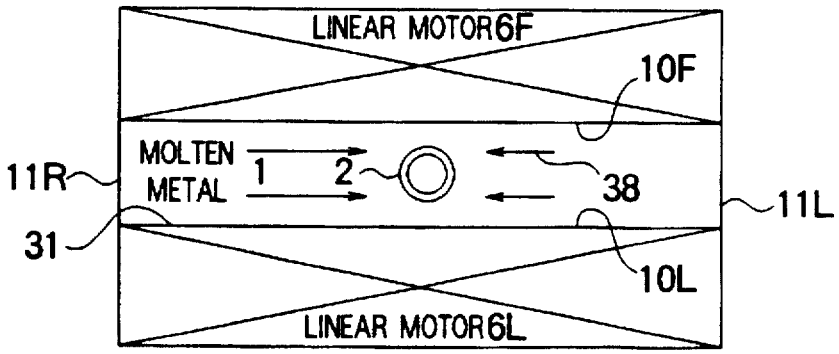
FIG. 43B is a plane view showing a surface flow on a meniscus of the molten metal in the mold.

In the continuous casting for a metal slab, as shown in FIG. 43A, if the flow of the molten metal ejected from-one of two outlets of the dipping nozzle 2 is stronger than the flow of the molten metal ejected from the other outlet, that is, the symmetry of the flows of the molten metal ejected from two outlets is lost, the surface flow located on the latter outlet is made weaker as shown in FIG. 43B. This disordered (drifted) flow of the molten metal results in dividing the molten metal 1 inside of the mold into a high temperature portion and a low temperature portion. That is, a strong flow of the molten metal is high in temperature, while a weak flow of the molten metal is low. The uneven temperature of the mold wall at the same height is likely to bring about a surface crack or shell breaking.

The flow of the molten metal brought about by the linear motors keeps the temperature of the molten metal in the mold substantially uniform. The ejecting characteristic of the outlet 39 of the dipping nozzle 2 is changed by the metal attached. on the outlet 39 while the molten metal is ejected. If this change, in particular, the difference of the characteristics between the two outlets becomes large, a considerable temperature shift may take place.

The continuous casting according to this embodiment has an object of suppressing temperature unevenness of the molten metal in the mold.

The continuous casting apparatus of this embodiment is arranged to have electromagnetic stirring coil parts or linear motors 6F and 6L, the coil parts or the linear motors include plural magnetic cores ranged along the mold side enclosing the molten metal 1 and plural electric coils for exerting the magnetic cores, and conducting means 3OF1, 3OF2, 3OF1 and 3OL2 (see FIGS. 44 to 47) for conducting direct current or alternating current through the electric coils for applying braking force or driving force to the flow of the molten metal, temperature sensing means (S11 to **S1*n*, S21 to S2*n*, S31 to S3*m*, S41 to S4*m*) for sensing a temperature distribution of the mold side, and temperature distribution control means 63 (see FIG. 50) for applying a current command to the conducting means 30F1, 3OF2, 3OL1 and 3OL2** for applying a high braking force to the relatively hot flow portion of the molten metal.

If a portion of the inner wall of the mold has a relatively high temperature, the molten metal around this portion flows at a high speed, while if a portion of the inner wall of the mold has a relatively low temperature, the molten metal around this portion flows at a low speed. As such, the flow speed distribution of the molten metal corresponds to the temperature distribution sensed by the temperature sensing means S11 to **S1*n*, S21 to S2*n*, S31 to S3*m* and S41 to S4*m*. According to this embodiment, the temperature distribution control means 63 operates to apply a current command to the conducting means 30F1, 30F2, 30L1 and 30L2** for applying a high braking force to the molten metal flowing near a relatively hot portion of the mold. That is, since a high braking force is applied to the fast flowing portion of the molten metal, the drift of the molten metal is suppressed, so that the flow speed distribution of the molten metal is uniform. Hence, the temperature is kept even on any portion of the molten metal in the mold.

The outer appearance and the central longitudinal section of the continuous casting apparatus of this embodiment are substantially like those shown in FIG. 27. The expanded cross section of the apparatus where the magnetic cores are horizontally broken is also similar to that shown in FIG. 28. The wiring connection of the electric coils of this apparatus is like that shown in FIG. 30.

Figure 44:
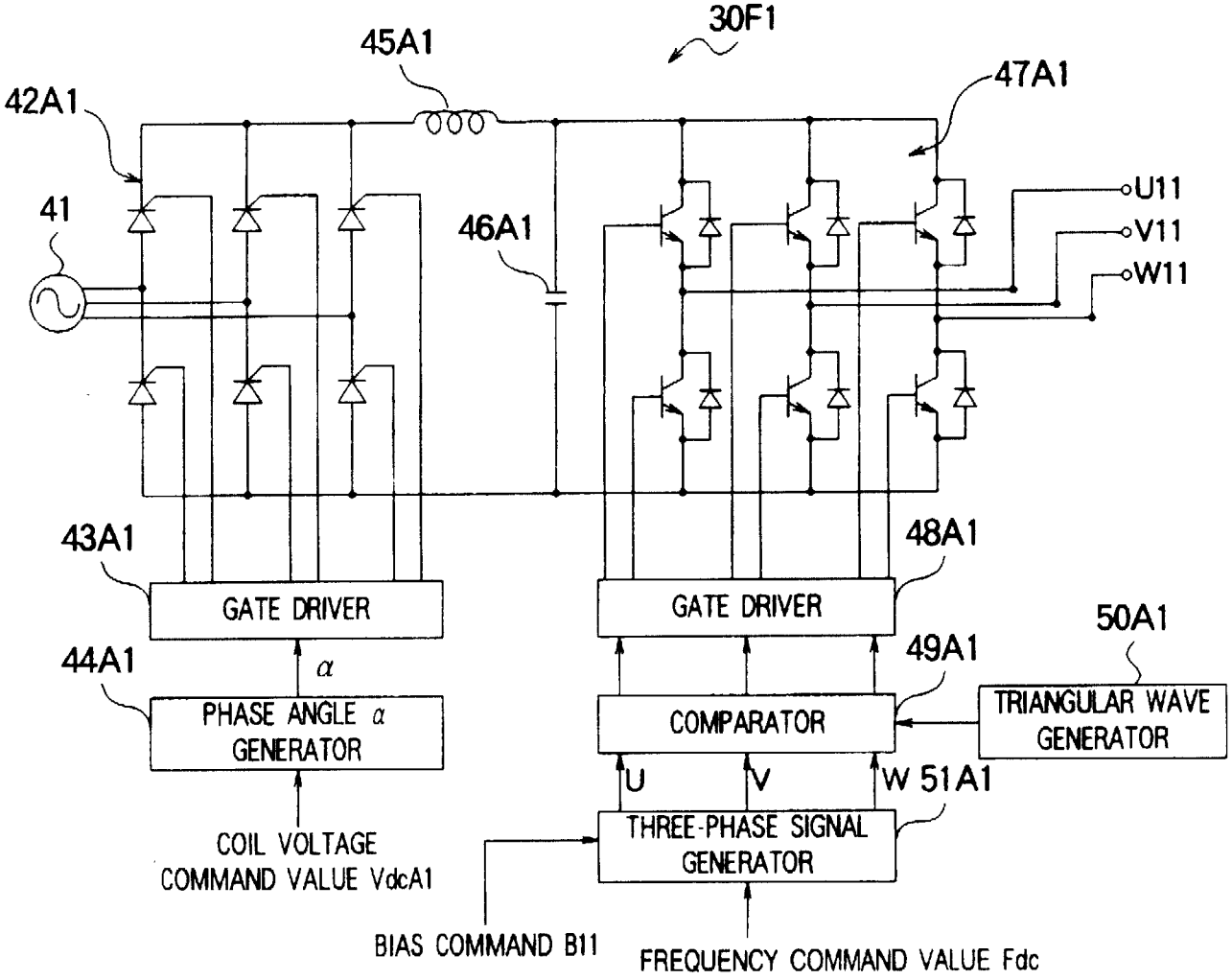
FIG. 44 is a circuit diagram showing a power supply circuit for applying a three-phase AC voltage to a first group of electric coils contained in a linear motor 6F.

FIG. 44 shows a power supply circuit 30F1 for flowing a three-phase current to the first group of electric coils **CF1*a* to CF1*r* of the linear motor 6F. In FIG. 44, a three-phase AC power supply 41 (three-phase power line) is connected to a thyristor bridge 42A1 for DC rectification, the output (pulsating flow) of which is smoothed by an inductor 45A1 and a capacitor 46A1. The smoothed DC voltage is applied to a power transistor bridge 47A1 for forming three-phase current. The power transistor bridge 47A1 operates to apply a U phase of the three-phase current to the power supply connector U11 shown in FIG. 30, a V phase to the power supply connector V11, and a W phase to the power supply connector W11**.

A coil voltage command value VdcA1 is applied to a phase angle α calculator 44A1. This command value is defined to generate a small thrust as indicated by arrows of FIG. 5. The phase angle α calculator 44A1 calculates a conducting phase angle α (thyristor trigger phase angle) corresponding to the command value VdcA1 and then applies a signal representing the phase angle α to a gate driver 43A1. The gate driver 43A1 operates to trigger the thyristor of each phase at a phase angle α for conducting the thyristor. This phase angle is counted from a zero-cross point of each phase. By triggering it, the DC voltage represented by the command value VdcA1 is applied to the transistor bridge 47A1.

On the other hand, a three-phase signal generator 51A1 operates to generate a constant voltage three-phase AC signal having a frequency specified by a frequency command value Fdc (in this embodiment, 20 Hz), to shift the signal by a DC level specified by the bias command value B11 and to give the shifted signal to a comparator 49A1. A triangular wave generator 50A1 operates to give a constant voltage triangular wave of 3 KHz to a comparator 49A1. When the U phase signal is positive, the comparator 49A1 operates to apply a signal to a gate driver 48A for a U-phase positive interval (for a transistor for outputting a U-phase positive voltage). The signal is kept at high level H (setting the transistor on) if the U phase signal is higher than or equal to the level of a triangular wave given by the triangular wave generator 50A1. The signal is kept at low level L if the former is lower than the latter. When the U phase signal is negative, the comparator 49A1 operates to apply a signal to the gate driver 48A1 for a U phase negative interval (for a transistor for outputting a U phase negative voltage). The signal is kept at high level if the U phase negative signal is equal to or lower than the level of the triangular wave given by the generator 501A or at low level L if the former is higher than the latter. This holds true for the V phase signal and the W phase signal. The gate driver 48A1 operates to turn on or off each transistor of the transistor bridge 47A1 in response to the signals for the positive and the negative intervals of each phase.

By this operation, a U phase voltage having a DC biased component (B11) of the three-phase current is applied to the power supply connector U11. Further, the similar V phase voltage is applied to the power supply connector V11. Likewise, the W phase voltage is applied to the power supply connector W11. The voltage level between an upper peak and a lower,peak is defined by the coil voltage command value VdcA1, and the bias DC component is defined by a bias command B11. In this embodiment, a three-phase voltage frequency is defined as 20 Hz by the frequency command value Fdc. That is, a three-phase AC voltage of 20 Hz is applied to the linear motors 6F and 6L shown in FIGS. 28 and 30 and the first group of electric coils CF1*a* to CF1*r*. The voltage contains a peak voltage value (thrust) specified by the coil voltage command value VdcA1 and a DC component (braking force) specified by the bias command B11.

Figure 45:
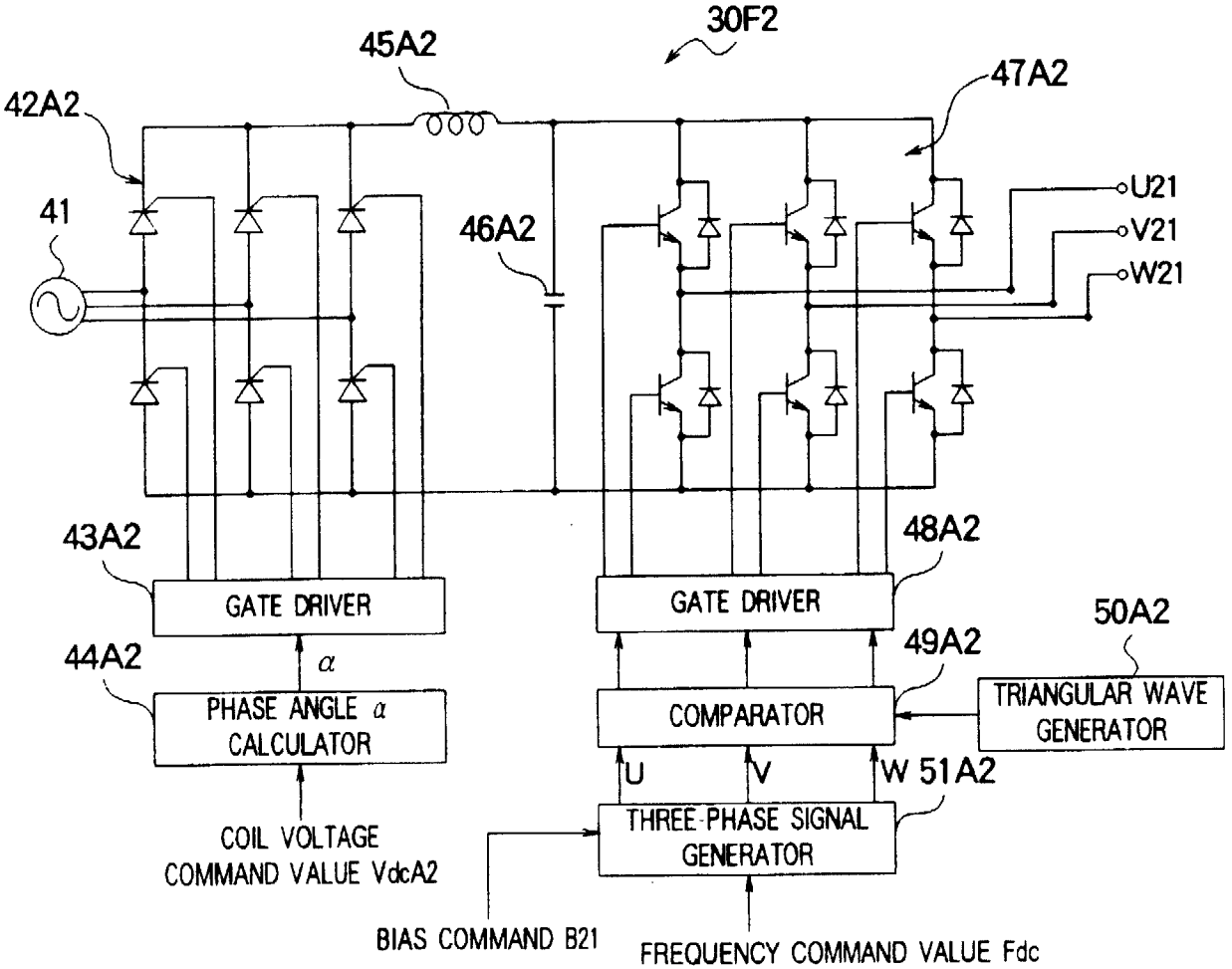
FIG. 45 is a circuit diagram showing a power supply circuit for applying three-phase AC voltage to a second group of electric coils contained in the linear motor 6F.
Figure 46:
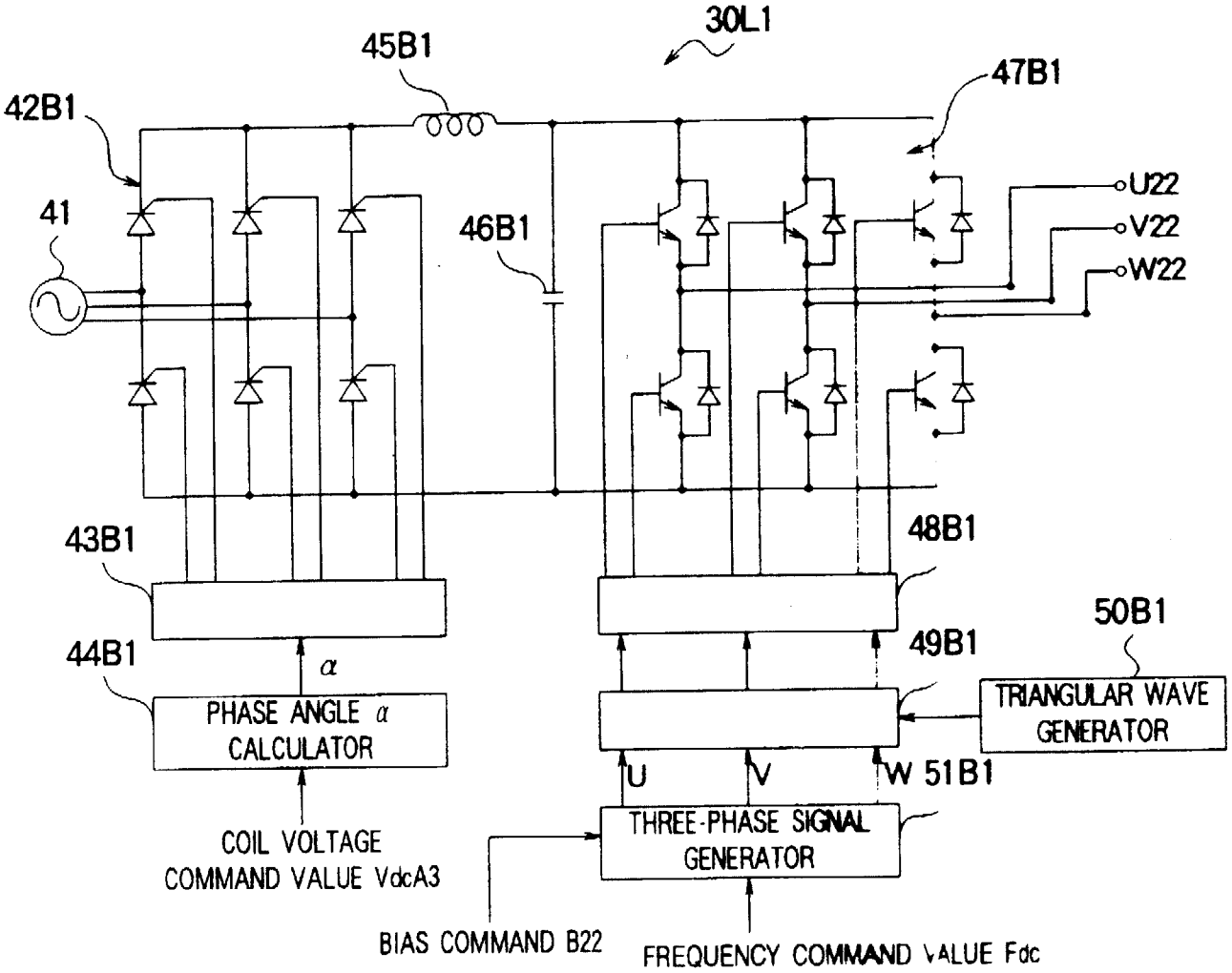
FIG. 46 is a circuit diagram showing a power supply circuit for applying three-phase AC voltage to a first group of electric coils contained in a linear motor 6L.
Figure 47:
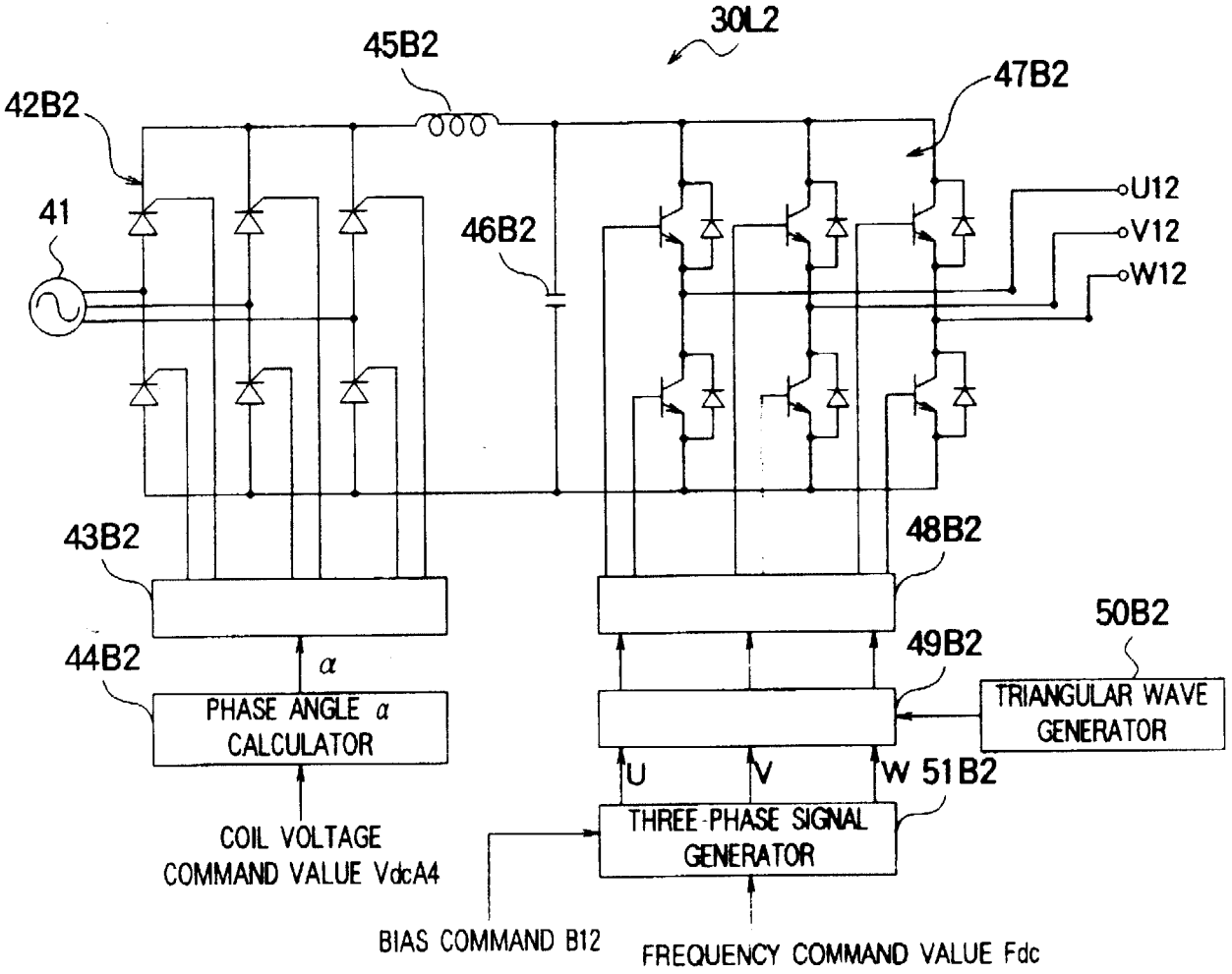
FIG. 47 is a circuit diagram showing a power supply circuit for applying three-phase AC voltage to a second group of electric coils contained in the linear motor 6L.

FIG. 45 shows a power supply circuit 30F2 for supplying three-phase current to the second group of electric coils CF2*a* to CF2*r* of the linear motor 6F. FIG. 46 shows a power supply circuit 30L1 for supplying three-phase current to the second group of electric coils CL2*a* to CL2*r* of the linear motor 6L. FIG. 47 shows a power supply circuit 30L2 for supplying three-phase current to the first group of electric coils CL1*a* to CL1*r* of the linear motor 6L. Each arrangement of the power supply circuits 30F2, 30L1 and 30L2 is the same as that of the foregoing circuit 30F1, except for the coil voltage command values (VdcA 2 to 4) and bias commands (B21, B22, B12).

That is, the second group of electric coils CF2*a* to CF2*r* of the linear motor 6F are actuated to apply a coil voltage command value VdcA2 to a phase angle α calculator 44A2. The coil voltage command value VdcA2 is defined to generate larger thrust, indicated by the arrow of FIG. 5. The second group of electric coils CL2*a* to CL2*r* of the linear motor 6L are actuated to apply a coil voltage command value VdcA3 to a phase angle α calculator 44B1. The coil voltage command value VdcA3 is defined to generate a larger thrust, indicated by the arrow of FIG. 5. Further, the first group of electric coils CL1*a* to CL1*r* of the linear motor 6L are actuated to apply a coil voltage command value VdcA4 to a phase angle α calculator 44B2. The coil voltage command value VdcA is defined to generate smaller thrust, indicated by the arrow of FIG. 5.

The bias command B11 (see FIG. 44) specifies a DC bias level (braking force) of three-phase current to be applied to the first group of electric coils CF1*a* to CF1*r* of the linear motor 6F. The bias command B21 (see FIG. 45) specifies a DC bias level (braking force) of three-phase current to be applied to the second group of electric coils CF2 to CF2*r* of the linear motor 6F. The bias command B22 (see FIG. 46) specifies a DC bias level (braking force) of three-phase current to be applied to the second group of electric coils CL2*a* to CL2*r* of the linear motor 6L. The bias command B12 (see FIG. 47) specifies a DC bias level (braking force) of three-phase current to be applied to the first group of electric coils Cl1*a* to Cl1*r* of the linear motor 3L.

Figure 48:
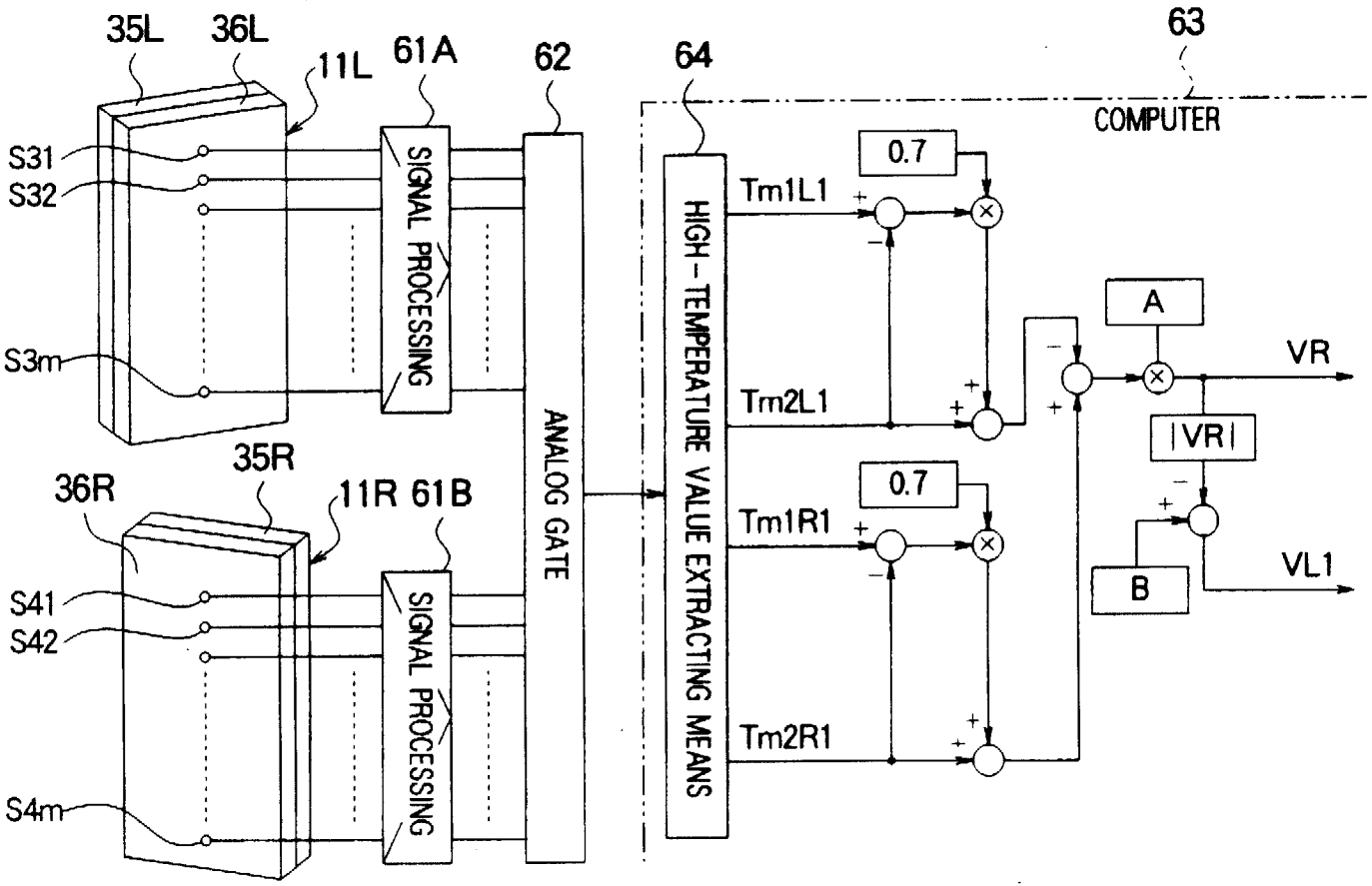
FIG. 48 is a block diagram showing rear portions of short sides 11L and 11R of a casting mold and an electric circuit connected to thermocouples provided therewith.
Figure 49:
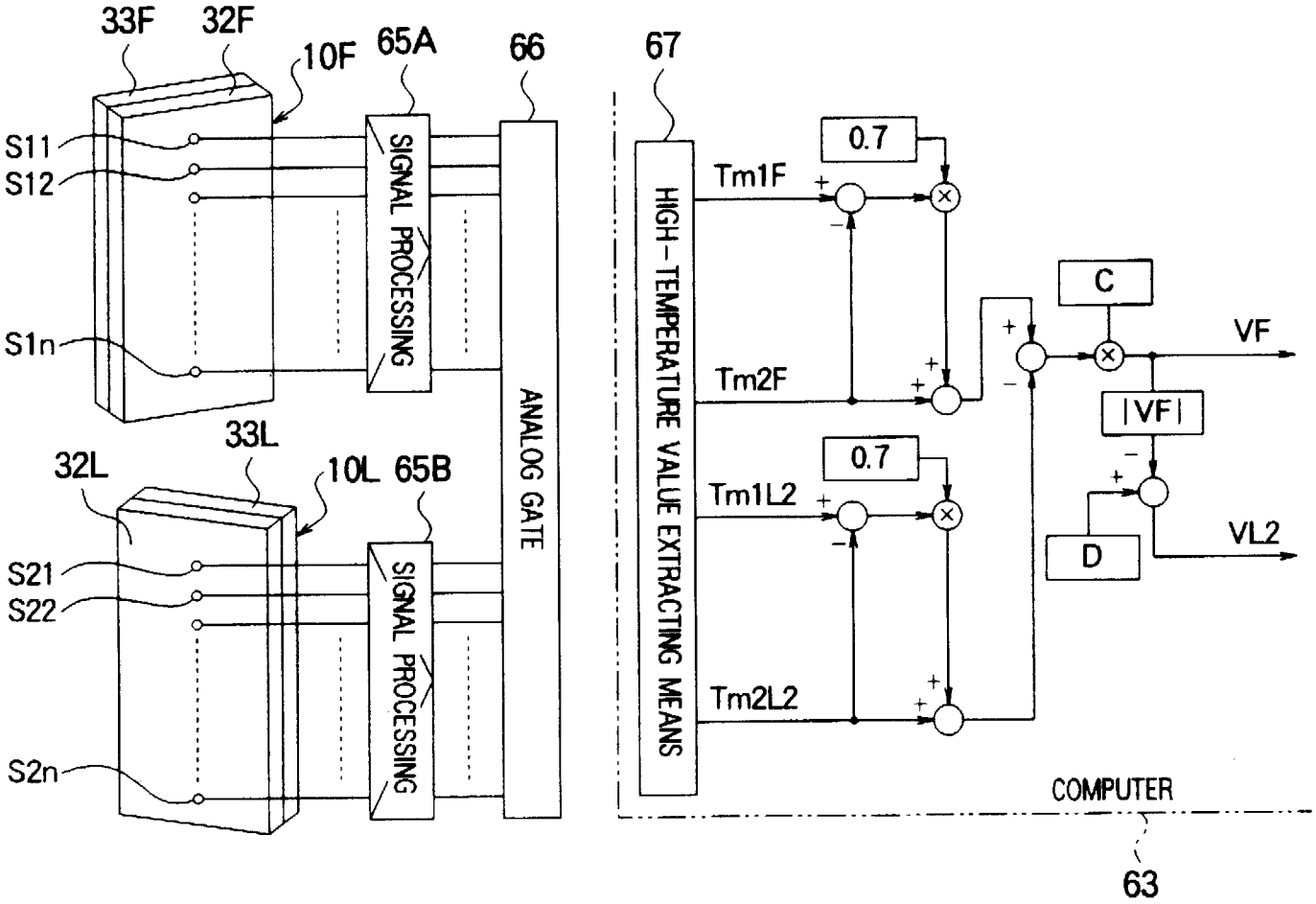
FIG. 49 is a block diagram showing rear portions of long sides 10F and 10L of the casting mold and an electric circuit connected to thermocouples provided therewith.
Figure 50:
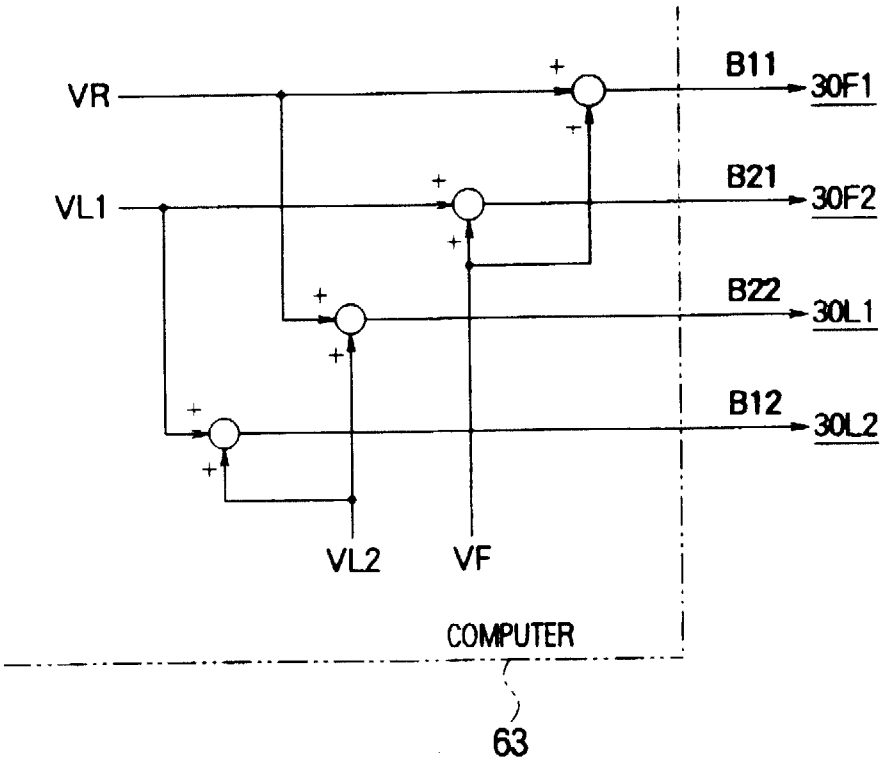
FIG. 50 is a block diagram showing an output of a computer 63 shown in FIGS. 48 and 49.

These bias commands B11 (see FIG. 44), B21 (see FIG. 45), B22 (see FIG. 46) and B12 (see FIG. 47) are given to the power supply circuits 30F1, 30F2, 30L1 and 30L2 under the control of computers 63 indicated in FIGS. 48 to 50.

FIG. 48 shows a rear portion of the mold short sides 11L and 11R shown in FIG. 28. Along these short sides 11L and 11R, thermo-couples S31 to S3*n* and S41 to S4*n* are ranged in columns at regular intervals in the direction of pulling the mold. Each thermo-couple is located to pass through a backed stainless plate and operates to sense a temperature of a slight interior (surface contacting with the molten metal) of a copper plate. That is, a signal processing circuit 61A operates to generate an analog signal (sensing signal) representing a temperature sensed by the thermo-couple and apply the analog signal to an analog gate 62.

The computer 63 operates to control the output of the analog gate 62, to sequentially analog-to-digital convert the sensing signals of the thermo-couples S31 to S3*n* and S41 to S4*n*, and to read the converted signals. A high temperature extracting means 64 is activated to extract the highest temperature value TmlLl and the second highest temperature value Tm2L1 from the temperatures sensed by the thermo-couples S31 to S3*n* and the highest temperature value Tm1R1 and the second highest temperature value Tm2R1 from the temperatures sensed by the thermo-couples S41 to S4*n*. Then, a representative temperature of the short side 11R is derived as follows:

$$(Tm1R1-Tm2R1)\times 0.7+Tm2R1$$

A representative temperature of the short side 11L is also derived as follows:

$$(Tm1L1-Tm2L1)\times 0.7+Tm2L1$$

Then, a representative temperature difference between both of the temperatures, that is, the short sides 11R and ilL is derived as follows:

$$(Tm1R1-Tm2R1)\times 0.7+Tm2R1-(Tm1L1-Tm2L1)\times 0.7-Tm2L1$$

If the representative temperature difference is positive (higher than or equal to zero), that is, the short-side copper plate 35R has a higher temperature, VR=Representative Temperature Difference×A (Coefficient) is calculated, and VL1=B−VR is also calculated. If the representative temperature difference is negative, that is, the short-side copper plate 35L has a higher temperature, VL1=−Representative Temperature Difference×A is calculated, and VR=B−VL1 is also calculated.

VR denotes a braking component (bias component) command value to be applied to the electric coils CF1*a* to CF1*r* (left half of the linear motor 6F in FIG. 28) and CL2*a* to CL2*r* (left half of the linear motor 6L in FIG. 28) on the short-side copper plate 35R. VL1 denotes a braking component (bias component) command value for the electric coils CF2*a* to CF2*r* (right half of the linear motor 6F in FIG. 28) and CL1*a* to CL1*r* (right half of the linear motor 6L in FIG. 28) on the short-side copper plate 35L. If the representative temperature difference is positive (the short-side copper plate 35R has a higher temperature), these command values are specified to increase the DC current (bias components) flowing through the left half (see FIG. 28) of the electronic coils of the linear motors 6F and 6L for applying stronger braking force to the molten metal and reduce DC current flowing through the right half of the electric coils for applying weaker braking force to the molten metal. Conversely, when the representative temperature difference is negative (the short-side copper plate 35L has a higher temperature), these commands are specified to increase the DC current be flowing through the right half of the electronic coils of the linear motors 6F and 6L for applying stronger braking force to the molten metal or reduce the DC current flowing through the left half of the electric coils for applying weaker braking force to the molten metal.

FIG. 49 shows a rear portion of the long sides 10F and 10L of the mold shown in FIG. 28. On these long sides 10F and 10L, the thermo-couples S11 to S1*n* and S21 to S2*n* are horizontally ranged in columns at regular intervals. Each thermo-couple is located to pass through a backed stainless plate for sensing a temperature of a slight interior (surface contacting with the molten metal) of the copper plate. That is, a signal processing circuit 65A operates to generate an analog signal (sensing signal) representing a temperature sensed by the thermo-couple and then to apply the analog signal to an analog gate 66.

A computer 63 operates to control the output of the analog gate 66, to sequentially analog-to-digital convert the sensing signal of the thermo-couples S11 to S1*n* and S21 to S2*n*, and then to read the digital signals. A high temperature value extracting means 67 operates to extract the highest temperature value Tm1F and the second highest temperature value Tm2F from the sensed temperatures of the thermo-couples S11 to S1*n* and the highest temperature value Tm1L2 and the second highest value Tm2L2 from the sensed temperatures of the thermo-couples S21 to S2*n*.

Then, a representative temperature of a long side 10F is derived as follows:

$$(Tm1F-Tm2F)\times 0.7+Tm2F$$

A representative temperature of a long side 10L is also derived as follows:

$$(Tm1L2-Tm2L2)\times 0.7+Tm2L2$$

Then, a representative temperature difference between both of them, that is, the long sides 10F and 10L is derived as follows.

$$(Tm1F-Tm2F)\times 0.7+Tm2F-(Tm2L2)\times 0.7-Tm2L2$$

If the representative temperature difference is positive (higher than or equal to zero), that is, the long side 10F has a higher temperature, VF=Representative Temperature Difference×C (Coefficient) is calculated, and VL2=B−VF is also derived. If the representative temperature difference is negative (the long side 10L has a higher temperature), VL2=−Representative Temperature Difference×C is calculated, and VF=B−VL2 is calculated.

VF denotes a braking component (bias component) command value to be given to the linear motor 6F (containing the electric coils CF1*a* to CF1*r* and CF2*a* to CF2*r*) on the long side 10F. VL2 denotes a braking component (bias component) command value to be given to the linear motor 6L (containing the electric coils CL2*a* to C12*r* and CL1*a* to CL1*r*) on the long side 10L. When the representative temperature difference is positive (the long side 10F has a higher temperature), these command values are specified to increase the DC current (bias components) flowing through the electric coils of the linear motor 6F for applying stronger braking force to the molten metal or reduce the DC current (bias components) the through the electric coils of the linear motor 6L for applying weaker braking force to the molten metal. Conversely, when the representative temperature difference is negative, that is, the long side 10L has a higher temperature, these command values are specified to increase the DC current flowing through the electric coils of the linear motor 6L for applying stronger braking force to the molten metal or reduce the DC current flowing through the electric coils of the linear motor 6F for applying weaker braking force to the molten metal.

As shown in FIG. 50, the computer 63 operates to perform the following calculations:

$$B11=VR+VF \quad B21=VL1+VF$$

$$B22=VR+VL2 \quad B12=VL1+VL2$$

These values are given to the power supply circuits 30F1 (see FIG. 44), 30F2 (see FIG. 45), 30L1 (see FIG. 46) and 30L2 (see FIG. 47).

As shown in FIGS. 43A and 43B, when the flow of the molten metal from the outlet 39 to the short side 14L is weak and the flow of the molten metal to the short side 11R is strong (the short side 11R has a higher temperature than the short side 11L), VR is larger but VL1 is smaller, so that B11, B22>B21, B12 is established. As such, the electric coils in the right halves of the linear motors 6F and 6L pass a higher DC component than the electric coils in the left halves so as to apply a strong braking force to the flow of the molten metal toward the short side 11R for suppressing the flow speed. The braking force against the flow of the molten metal for the short side 11L is made weaker and the flow speed of the molten metal for the short side 11L is increased.

When the flow of the molten metal from the outlet 39 to the short side 11L has substantially the same speed as the flow of the molten metal for the short side 11R, if the flow of the molten metal injected from the dipping nozzle 2 is drifted toward the long side 10F, the long side 10F has a higher temperature than the long side 10L. In this case, since VF is large and VL2 is small, B11, B21>B22, B12 is established. As such, the electric coils of the linear motor 6F pass a higher DC component than those of the linear motor 6L so as to apply a stronger braking force to the molten metal along the long side 10F for suppressing the flow speed. The braking force against the molten metal along the long side 10L is made weaker, so that the flow speed of the molten metal along the long side 10L is increased.

On the principle as set forth above, the continuous casting apparatus according to the foregoing embodiment is arranged to suppress the drift of the flow speed of the molten metal in the direction x, that is, along the long sides of the mold, and the drift of the flow speed of the molten metal in the direction y, that is, along the short sides of the mold. This results in unifying the temperature distribution of the molten metal in the mold.

The foregoing description has been concerned with the DC application. In place, alternating current is allowed to pass through the electric coils without bringing about a shifting field. Further, if alternating current passes through the electric coils, that is, the linear motor with the shifting field, the shifting field directed in opposition to the flow of the molten metal is brought about in the linear motor so that the braking force is applied to the molten metal. Next, the description will be oriented to another continuous casting apparatus of this embodiment in which the thrust is induced by the shifting field for applying braking force to the molten metal.

Figure 51A:
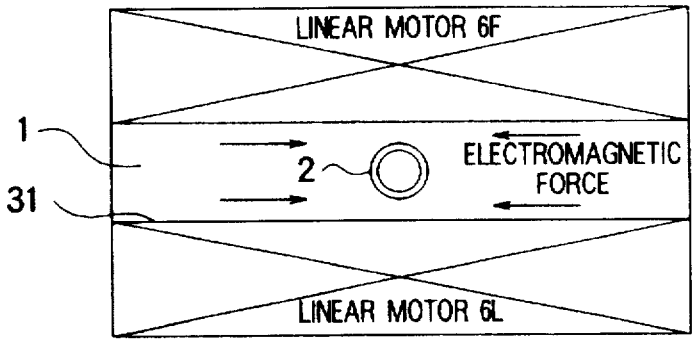
FIG. 51A is a plane view showing direction of electromagnetic force of a linear motor according to the fourth embodiment of the invention.
Figure 51B:
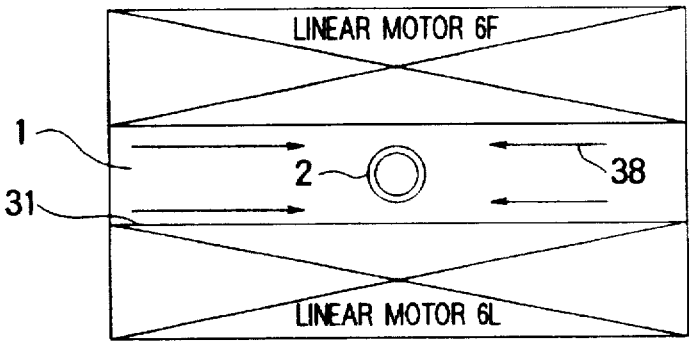
FIG. 51B is a plane view showing how a surface flow is drifted when injecting molten metal.
Figure 51C:
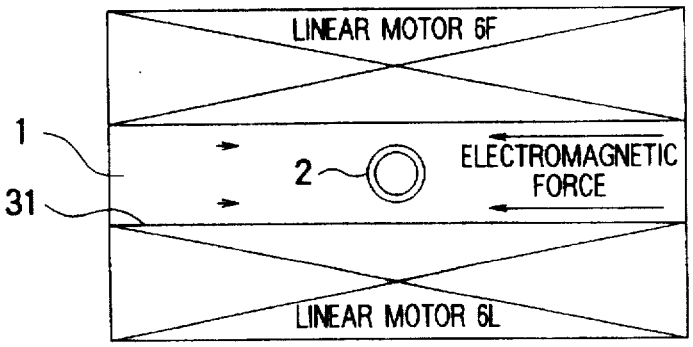
FIG. 51C is a plane view showing electromagnetic force caused by the linear motor for suppressing the drift of the surface flow shown in FIG. 51B.
Figure 52:
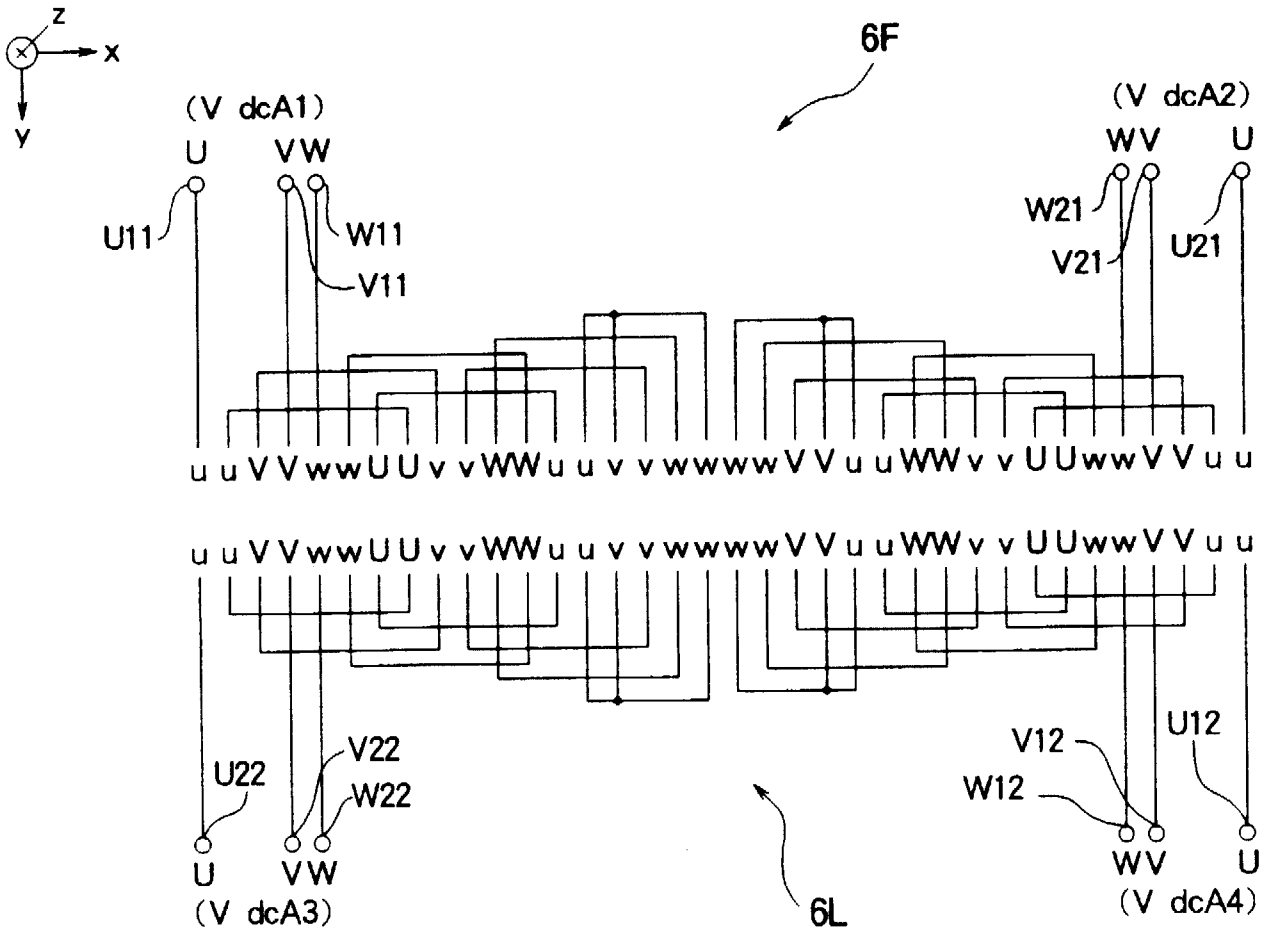
FIG. 52 is a horizontal sectional view showing phase divisions of electric coils contained in the linear motor according to the fourth embodiment of the present invention.

In this apparatus, as shown in FIG. 51A, the wiring connections of the linear motors 6F and 6L are changed as shown in FIG. 52 in a manner to generate electromagnetic force (thrust) oriented to the dipping nozzle 2 along the long side of the mold. If the drift is caused as shown in FIG. 51B, a stronger surface flow takes place on the left hand side of the dipping nozzle than on the right hand side. In this case, the short side on the left hand side of the nozzle has a higher temperature. To overcome this imbalance, as shown in FIG. 51C, the electromagnetic force applied to the highly heated portion is decreased. That is, the electromagnetic force applied to the less heated portion is increased.

Figure 53:
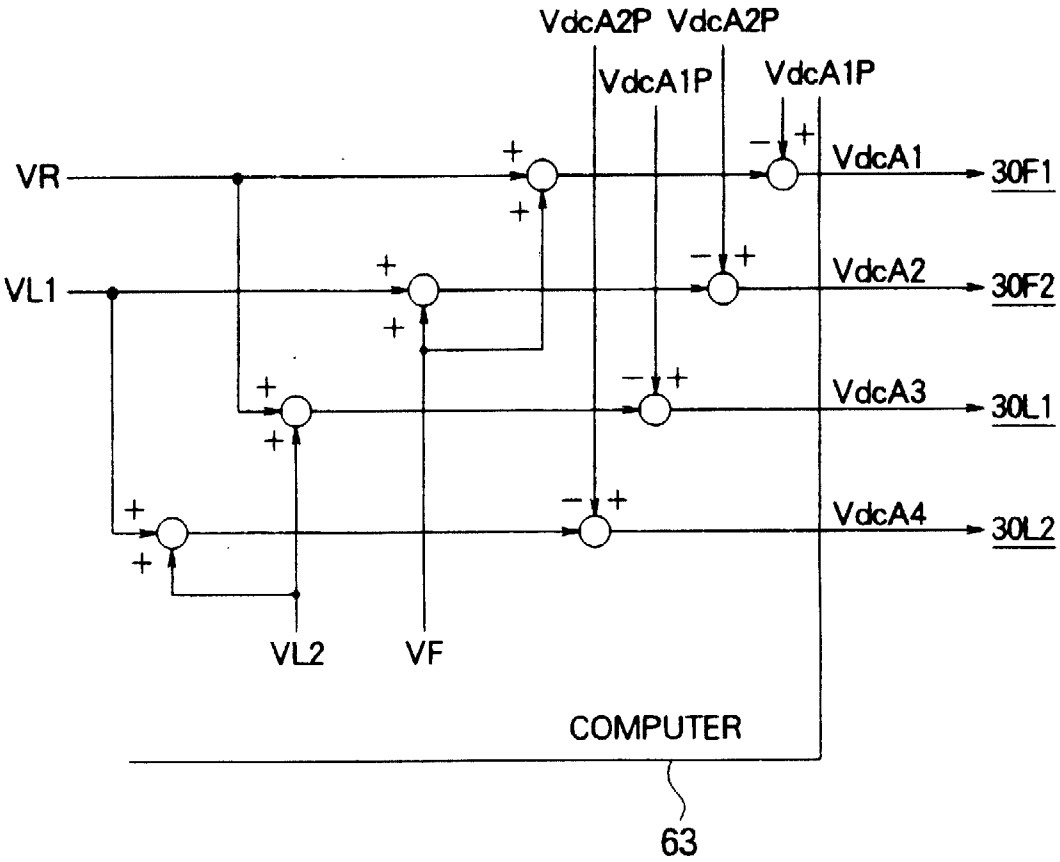
FIG. 53 is a block diagram showing the content of a processing operation executed in a computer 43 included in the fourth embodiment of the present invention.

The operating process of the computer 63 is illustrated in FIG. 53. To apply the DC braking force, the DC bias (B11, B12) is made higher around a low temperature portion, while the DC bias (B21, B12) is made lower around a low temperature portion. In this embodiment, an AC voltage (VdcA1, VdcA3) is lowered around a high temperature portion, while an AC voltage (VdcA2, VdcA4) is raised around a low temperature portion. That is, an accelerating thrust to the molten metal is made lower around a high temperature portion, and an accelerating thrust to the molten metal is made higher around a low temperature portion. The DC bias (B11, B22) of the foregoing embodiment is reverse to the AC voltage (VdcA1; VdcA3) of the present embodiment with respect to the magnitude of voltage or current. As such, as shown in FIG. 53, the computer 63 operates to subtract a value corresponding to a required braking force computed like the foregoing embodiment from the current output coil voltage (VdcA1p to VdcA4P), to update the resulting value as new coil voltage command values VdcA1 to VdcA4, to output these command values to the power supply circuits 30F1, 30F2, 30L1 and 30L2, and to update the value (data of a register) VdcA1P to VdcA4P representing the current coil voltages as the new command values.

If the drift is brought about as shown in FIG. 51B, a stronger surface flow takes place on the left hand side of the dipping nozzle 2 than on the right hand side of the nozzle 2, the temperature is made higher in the short side an the left. The computer 63 operates to make the values VdcA1 and VdcA3 on the high temperature side small and make the values VdcA2 and VdcA4 on the low temperature side large. Hence, the first group of electric coils CF1*a* to CF1*r* of the linear motor 6F and the second group of electric coils CL2*a* to C12*r* of the linear motor 6L operate to reduce their DC value of three-phase current and lower the electromagnetic force (thrust). The second group of electric coils CF2*a* to CF2*r* of the linear motor 6F and the first group of electric coils CL1*a* to C11*r* of the linear motor 6L operate to increase their current values of three-phase current and enhance the electromagnetic force (thrust). The electromagnetic force induced by the linear motors 6F and 6L is changed as shown in FIG. 51C. Then, the weak surface flow on the right hand side is intensified by the drift, so that the uniform current may be formed on the meniscus.

If the drift is reverse to the drift shown in FIG. 51B, that is, the surface flow on the left hand side of the dipping nozzle 2 is weak and the surface flow on the right hand side is strong, the short side on the right of the nozzle is hotter than the short side on the left. In response to this, the computer 63 operates to decrease the values VdcA2 and VdcA4 on the high temperature side and increase the values VdcA1 and VdcA3 on the low temperature side. Hence, the first group of electric coils CF1*a* to CL1*r* of the linear motor 6F and the second group of electric coils CL2*a* to CL2*r* of the linear motor 6L pass an enlarged value of three-phase current and thereby bring about larger electromagnetic force (thrust). On the contrary, the second group of electric coils CF2*a* to CF2*r* of the linear motor 6F and the first group of electric coils CL1*a* to CL1*r* of the linear motor 6L pass a lowered current value of three-phase current and thereby apply lower electromagnetic force (thrust) These actions result in strengthening the surface flow in the left hand, which has been weakened by the drift, and making the current on the meniscus uniform.

On the principle as set forth above, the continuous casting apparatus according to this embodiment operates to suppress the variation of the flow speed of the molten metal in the direction x, that is, along the long side of the mold with the center of the dipping nozzle 2. This gives rise to the uniform temperature distribution of the molten metal in the mold.

Since a high braking force is applied to the flow of the molten metal around a portion having a high flow speed of the molten metal, the drift of the molten metal is suppressed. That is, the flow speed of the molten metal is uniformly distributed. Hence, the temperature is made constant in any spot of the molten metal in the mold.

In turn, the description will be oriented to a continuous casting apparatus according to a fifth embodiment of the invention.

In the foregoing embodiments, to give rise to a stable current, it is necessary to apply strong electromagnetic force to the molten metal. For example, the right half of the linear motor 6F and the left half of the linear motor 6L are required to apply an electromagnetic force strong enough to overcome the flow of the molten metal to be ejected from the dipping nozzle 2 to the mold. Then, the change of a wiring connection or the provision of plural power supplies are used for producing strong electromagnetic force.

The foregoing linear motors are operated to bring about a surface of the molten metal for giving rise to the current of the molten metal. The wiring connection may be replaced for producing strong electromagnetic force. The magnitude of current flowing through the coil, however, depends on the cooling capability. This cause will be explained below.

In each slot formed on the coil of the linear motor, assume that a slot width is $\tau_a$ [m], a slot depth is $\alpha_b$ [m], a number of turns wound around a coil core is n, and a magnitude of current is I [A]. A current density j corresponds to a total number of power lines passed per a unit area of space. It is represented as follows:

$$j=(\beta\times nI)/(\tau_a\times Tb) \tag{6}$$

wherein β is a space factor of an electric coil on a slot section.

From the expression (6), the current density j is proportional to the magnitude of current. If the coil is heated by the flowing current, the temperature is enhanced with the increase of the current density. Hence, the amount of current flowing through the coil is restricted by the cooling condition of the coil. If the coil is made of copper, the amount of current flowing is restricted in the range of 3 to $6\times10^6$ A/m$^2$ by the cooling capability of a water cooling method or in the range of 1 to $2\times10^6$ A/m$^2$ in the case of an air cooling method. To change the distribution of electromagnetic force, it is merely needed to reduce the magnitude of current, which does not bring about so large electromagnetic force.

The continuous casting apparatus according to this embodiment is intended to more effectively prompt floating of bubbles, to prevent powder from being entrained in the molten metal and/or wipe out the inner surface of the mold nearby the surface of the molten metal.

Figure 54:
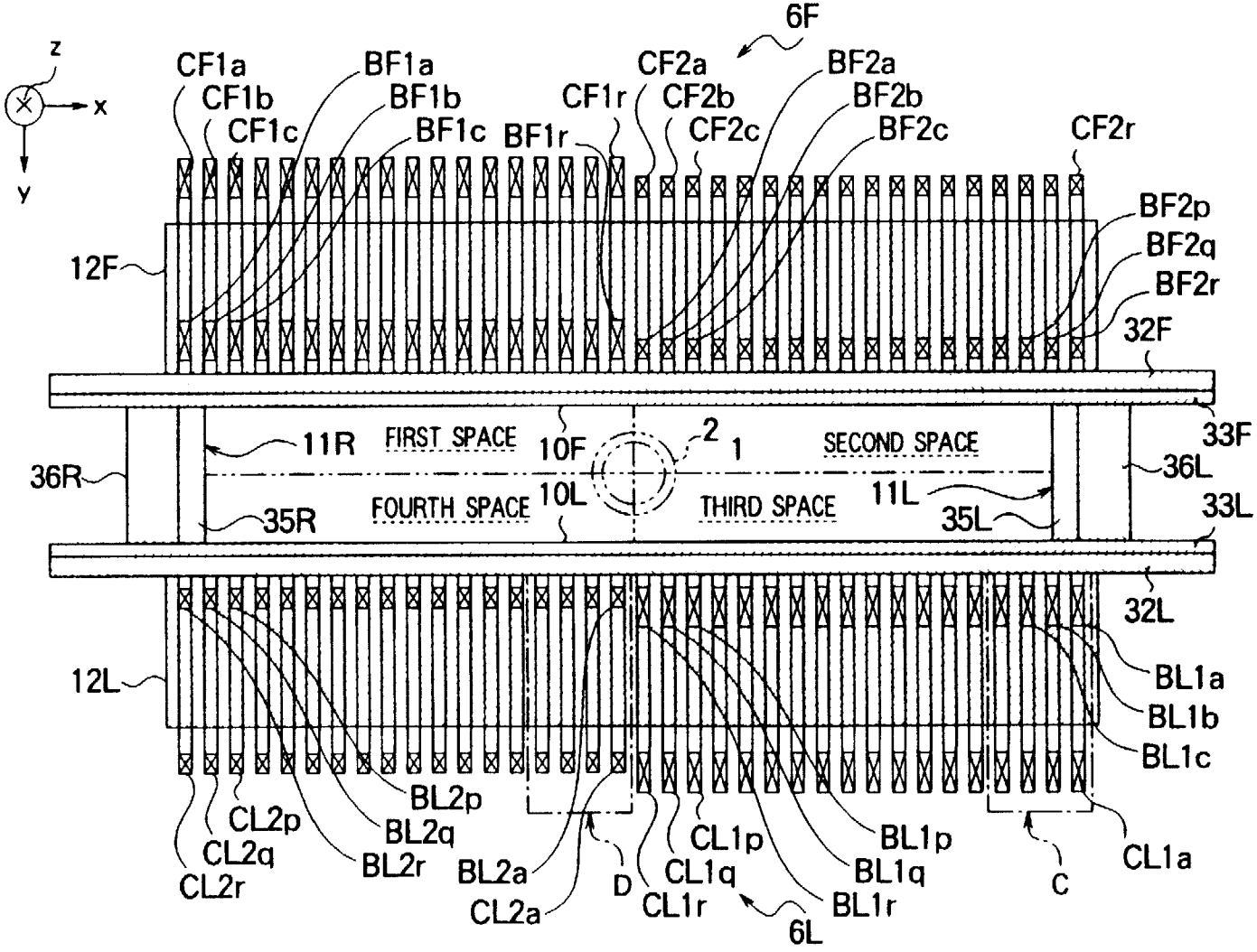
FIG. 54 is an expanded sectional view showing horizontal sections of cores 12F and 12L contained in a continuous casting apparatus according to a fifth embodiment of the present invention.

As shown in FIG. 54, the continuous casting apparatus according to this embodiment includes a first linear motor (6F) including a magnetic core 12F having plural slots BF1*a* . . . located along one side (10F) of the mold enclosing molten metal 1 therein and plural electric coils CF1*a* . . . inserted to at least some of the slots, a second linear motor 6L including a magnetic core 12L having plural slots BL1*a* . . . located along one side 10L opposed to that side and plural electric coils CL1*a* . . . inserted to at least some of the slots, and conducting means for conducting the first and the second linear motors 6F and 6L.

According to the first aspect of this embodiment, a space enclosed by the mold sides is divided into four parts by a first virtual plane extending perpendicularly to the side of the mold and passing through a center of a nozzle member for feeding the molten metal to a space defined by the mold sides and a second virtual plane extending perpendicularly to the first plane and passing through the center of the nozzle member. These four parts are called a first space, a second space, a third space and a fourth space, clockwise around the center of the nozzle member. At least some slots BF1*a* to BF1*r* and BL1*a* to BL1*r* are formed more deeply than the other slots BF2*a* to BF2*r* and BL2*a* to B12*r*, those deep slots located as opposed to the first and the third spaces.

Figure 59:
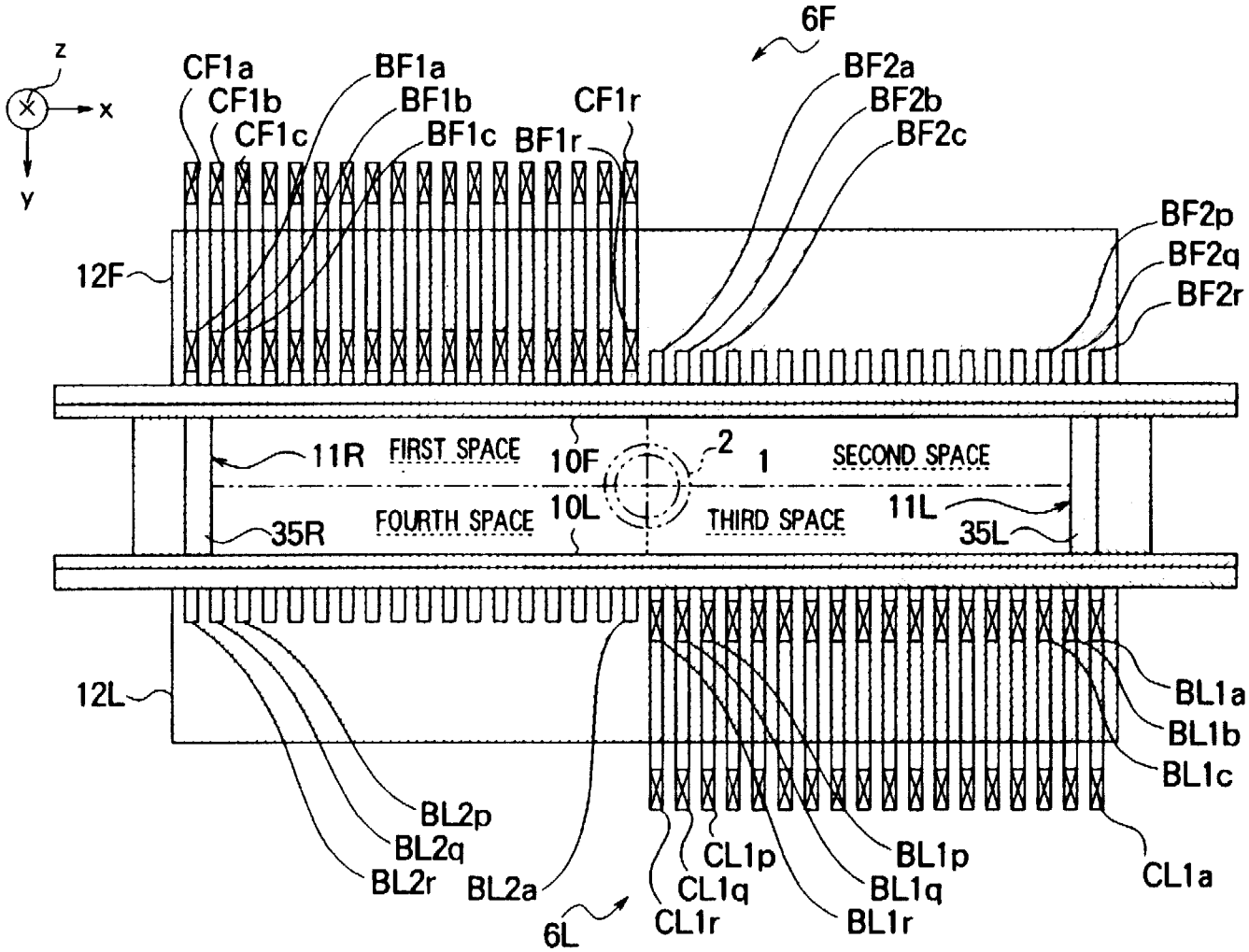
FIG. 59 is an expanded sectional view showing horizontal sections of cores 12F and 12L according to the second aspect of the fifth embodiment.

According to a second aspect of this embodiment, as shown in FIG. 59, the first linear motor 6F includes the electric coils CF1*a* to CF1*r* only in the slots BF1*a* to BF1*r* opposed to the first space. The second linear motor 6L includes the electric coils CL1*a* to CL1*r* only in the slots BL1*a* to BL1*r* opposed to the third space.

Figure 60A:
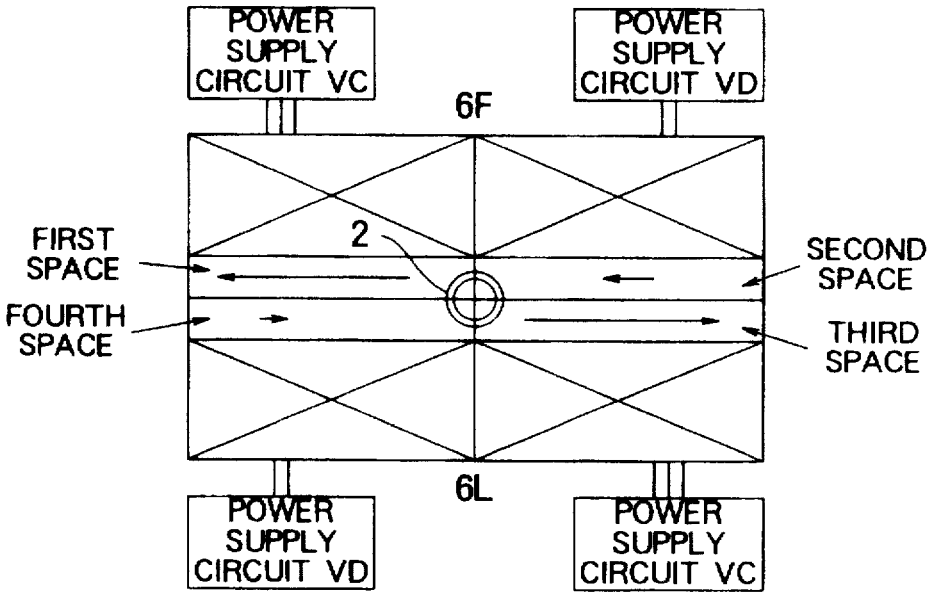
FIG. 60A is a block diagram showing a connecting relation between linear motors and power supply circuits according to a third aspect of the fifth embodiment.

According to a third aspect of this embodiment, as shown in FIG. 60A, a first conducting means VC is provided for conducting alternating current through the electric coils CF1*a* to CF1*r* opposed to the first space of the first linear motor 6F and the electric coils CL1*a* to CL1*r* opposed to the third space of the second linear motor. The conducting means VC operates to move the molten metal in these spaces along the sides of the mold. And, a conducting or cuttings circuit VD is provided for conducting or cutting-DC current through the electric coils CF2*a* to CF2*r* opposed to the second space of the first linear motor 6F and the electric coils CL2*a* to CL2*r* opposed to the fourth space of the second linear motor 6L.

Function of First Aspect of Fifth Embodiment

Figure 56A:
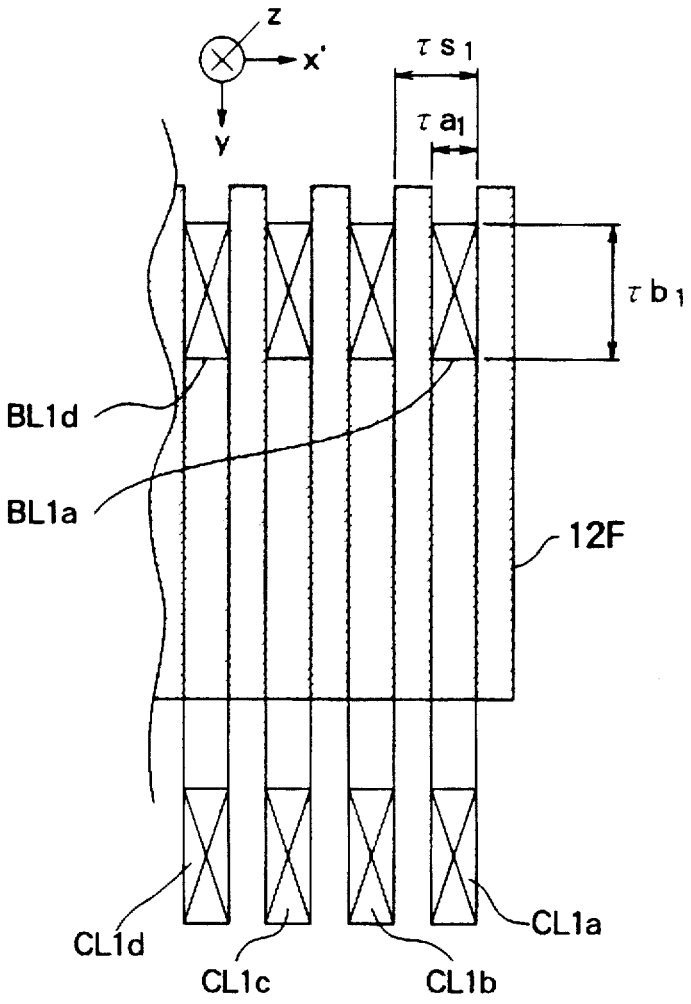
FIG. 56A is an expanded sectional view showing a section enclosed by a broken line C shown in FIG. 54.
Figure 56B:
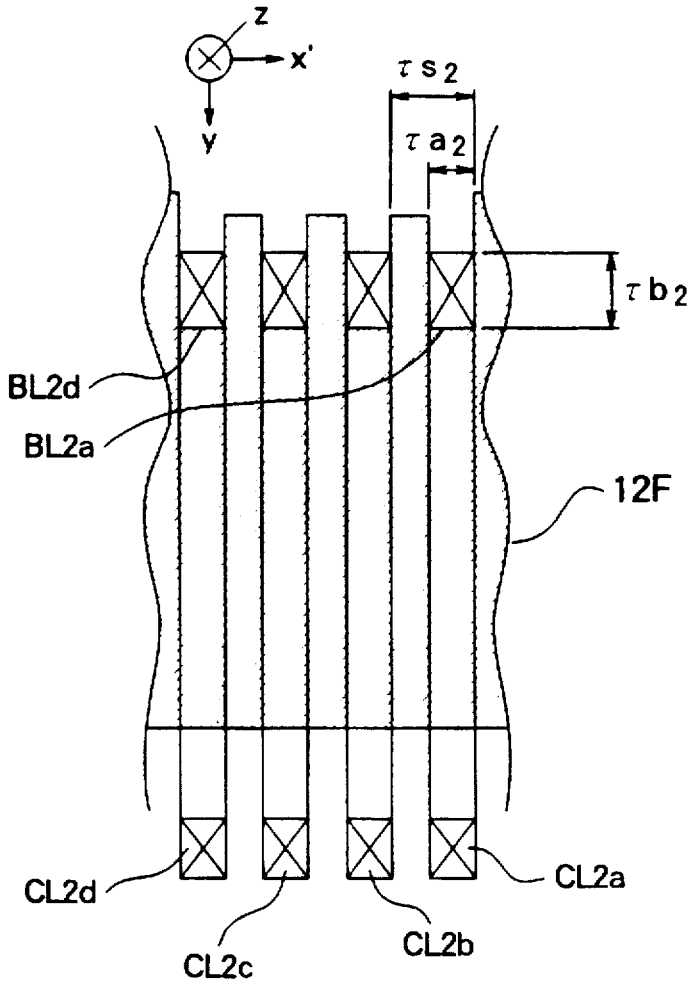
FIG. 56B is an expanded sectional view showing a section enclosed by a broken line D shown in FIG. 54.

FIG. 54 is a plane view showing a linear motor according to a first aspect of the fifth embodiment of the invention, cut in a lengthwise direction (in parallel to the x–y plane). FIG. 56A is an expanded plane view showing a part of the core 12L enclosed by an alternate long and short dash line C of FIG. 54. FIG. 56B is an expanded plane view showing a part of the core 12L enclosed by an alternate long and short dash line D. It is necessary to induce strong electromagnetic force in order to rise to a surface flow of the molten metal around the mold inner wall 31 and circulate the molten metal at a constant speed. For example, the right half of the linear motor 6F and the left half of the linear motor 6L need such strong electromagnetic force to overcome the flow of the molten metal ejected from the dipping nozzle 2 to the mold. The amount of current flowing through the linear motors is restricted by the cooling condition of the linear motor. To overcome this restriction, the continuous casting apparatus according to the first aspect of the fifth embodiment is formed to increase an ampere conductor $\alpha$, that is, make the slots deeper for increasing an ampere turn (turns×conducting current value) of the electric coils to be inserted therein, thereby producing strong electromagnetic force.

Figure 61A:
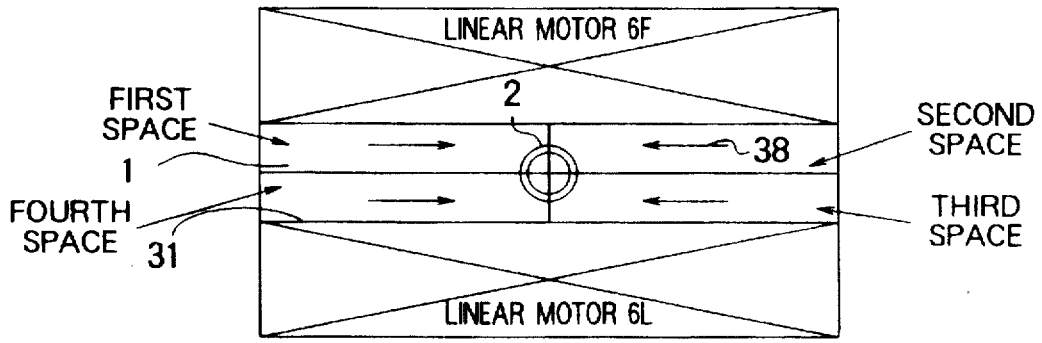
FIG. 61A is a plane view showing a surface flow on a meniscus of molten metal in a casting mold when injecting the molten metal through a dipping nozzle.
Figure 61B:
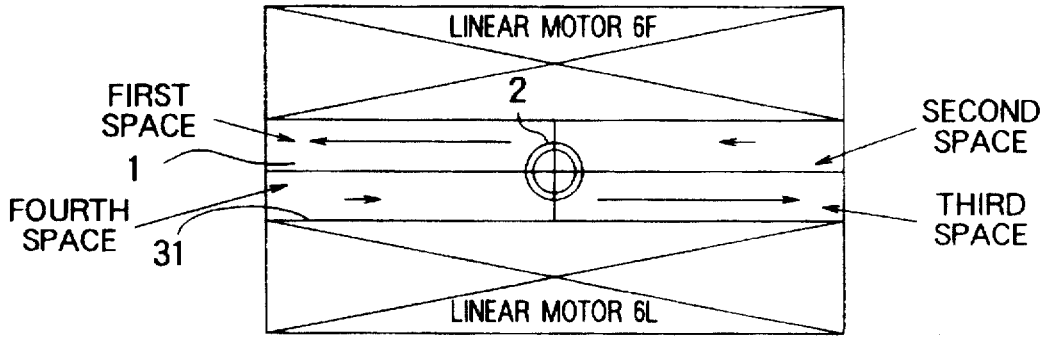
FIG. 61B is a plane view showing a surface flow to be caused by two linear motors with dotted arrows.
Figure 61C:
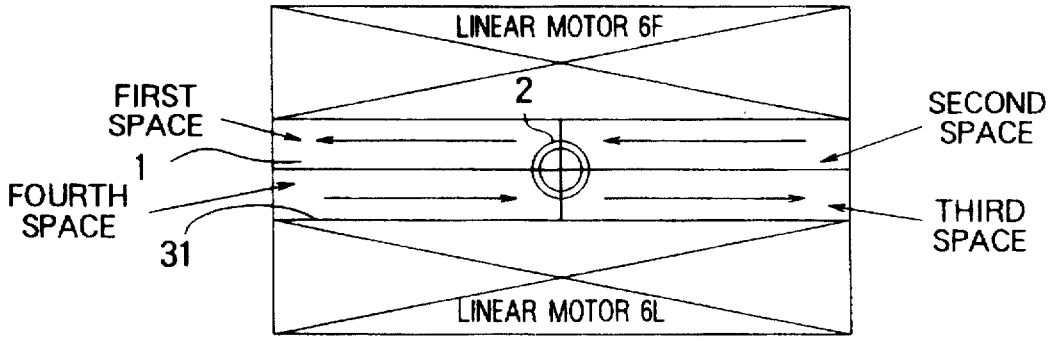
FIG. 61C is a plane view showing a vector sum of a surface flow caused by injecting molten metal through a dipping nozzle and a surface flow caused by the thrust of the two linear motors.

A relation of $f \propto \epsilon^2$ is established between an ampere conductor $\epsilon$ and an electromagnetic force f. Assuming that a current density is j, a space factor is $\beta$, a poll pitch is $\tau s_1$, an x-axial slot width is $\tau a_1$, and a y-axial slot depth is $\tau b_1$, as shown in FIG. 56A, $\epsilon$ is expressed by the following expression:

$$\begin{aligned} \epsilon &= (n \times I)/\tau s_1 \\ &= j \times (\tau a_1/\tau s_1) \times \tau b_1 \times \beta [A/m] \end{aligned} \quad (7)$$

wherein the current density j and the space factor $\beta$ are constants defined by the cooling conditions of the linear motor. Assuming that $\tau a_1/\tau s_1$ is a constant, to increase a value of $\epsilon$, it is possible to simply increase a value of tb1. Comparing FIG. 56A with FIG. 56B, $\tau s_1=\tau s_2$ and $\tau a_1=\tau a_2$ are given and $\tau b_1=2\tau b_2$ is given. Assuming that a half of the core 12F provides the coils CF1*a* to CF1*r* (called a first group) wound therearound and the other half of the core 12F provides the coils CF2*a* to CF2*r* (called a second group) wound therearound, the coil part having the first group coil wound therearound provides twice as large a electromagnetic force as the coil part having the second group coil wound therearound. This holds true to for the linear motor 6L. Hence, as shown in FIG. 61B, the current of the molten metal on the meniscus is brought about depending on the electromagnetic force of the motor. The surface flow caused by the ejection of the molten metal as shown in FIG. 61A is cancelled or strengthened. Finally, the surface of the molten metal is brought about as keeping a uniform speed distribution around the inner wall 31 of the mold as shown in FIG. 61C.

Figure 57:
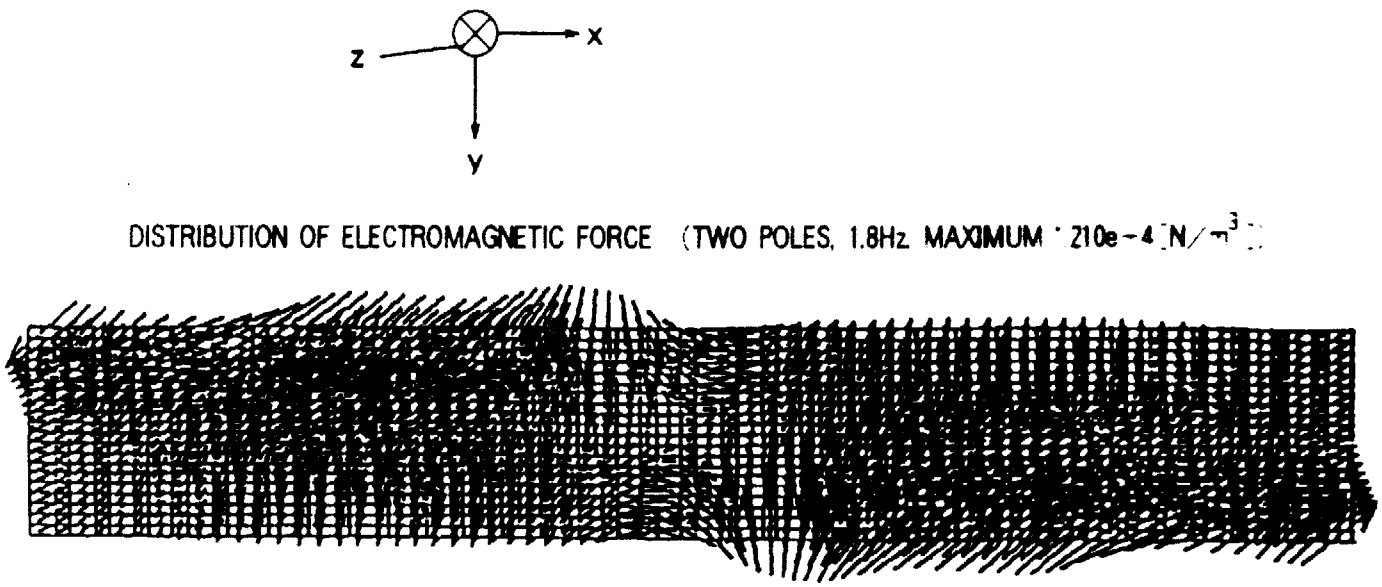
FIG. 57 is a plane view showing a distribution of electromagnetic force caused by two two-pole linear motors having slots according to a first aspect of the fifth embodiment.

FIG. 57 shows a distribution of electromagnetic force to be applied to a surface layer of the molten metal in the mold according to the first aspect of this embodiment. Further, FIG. 34 shows a distribution of electromagnetic force to be applied to the surface of the molten metal in the mold in the linear motor provided with slots of uniform depth. Both of these figures illustrate by arrows the distribution of electromagnetic force on a horizontal plane of the surface layer of the molten metal 1 in the mold in the case that the linear motors 6F and 6L having slots of n=36 (that is, 36 electric coils) located along one long side of the mold are laid on both of the sides of the mold. The direction of the arrow indicates the direction of the electromagnetic force, and the length of the arrow indicates the strength of the electromagnetic force. The illustrated electromagnetic force is an integral value for one period in the case of conducting three-phase current of 1.8 Hz through the electric coils. If the linear motor provides a small number of poles (two poles) and no special devise for slots like the conventional distribution shown in FIG. 34, the linear motor is able to induce large electromagnetic force. However, the electromagnetic force contains too large y-axial (along the short side of the mold) electromagnetic components (in these figures, the relevant arrow is long in the y-axial direction). Hence, the two anticlockwise eddies of the electromagnetic force take place in the right and the left of the chart. Such electromagnetic force gives rise to an eddy of the molten metal, which may catch powder in the current of the molten metal. Further, the x-axial electromagnetic force components along the wall surfaces (inner surfaces of the long sides) of the mold are variably distributed, so that the x-axial inner surface of the mold is not evenly wiped out and the flow of the molten metal may be partially stagnated.

In the first aspect (two poles provided in the illustrative arrangement) of this embodiment as shown in FIG. 57, the y-axial component of the electromagnetic force substantially disappears. Hence, no eddy of the electromagnetic force takes place so that the flow of the molten metal appears only along the inner surface of the mold. This provides a quite high preventive effect of catching powder in the flow, forms the even x-axial components of the electromagnetic force along the overall long side of the mold (in the x-axial direction) and keeps the flow along the inner surface of the mold in the fixed direction (x-axial) and at a constant speed, thereby making it possible to evenly wipe the inner surface of the mold and prompt bubbles to float up.

According to the first aspect of this fifth embodiment, the linear motor provides a new slot form. Concretely, these slots are formed so that opposed slots have respective depths. Hence, this continuous casting apparatus offers the same function and effect as described with reference to FIGS. 56A, 56B and 57.

Function of Second Aspect of Fifth Embodiment

FIG. 59 shows a continuous casting apparatus according to the second aspect of the fifth embodiment, which is arranged to exclude the second group of electric coils CF2*a* to CF2*r* (see FIG. 54) of the linear motor 6F and the second group of electric coils CL2*a* to CL2*r* of the linear motor 6L from the arrangement according to the first aspect of the fifth embodiment. The arrangement of the second aspect does not apply substantial linear driving force to the molten metal 1 in the first and the third spaces. That is, no linear driving force is applied for prompting the surface flow caused by ejecting the molten metal from the dipping nozzle 2. Hence, the linear driving forces caused by the first group of the electric coils CF1*a* to CF1*r* and CL1*a* to CL1*r* of the linear motors 6F and 6L are required so that the overpowered difference from the surface flow of the first or the third space caused by ejecting the molten metal through the dipping nozzle 2 is made to be substantially the same as the speed of the surface flow in the second or the fourth space. As such, as shown in FIG. 61B, on the meniscus, the surface flow takes place according to the magnitude of the electromagnetic force of the motor. This surface flow serves to overcome or strengthen the surface flow formed by the ejecting flow shown in FIG. 61A. Finally, it is possible to give rise to a surface flow of the molten metal while keeping a highly uniform speed distribution around the inner wall 31 of the mold shown in FIG. 61C.

Function of Third Aspect of Fifth Embodiment

Figure 60B:
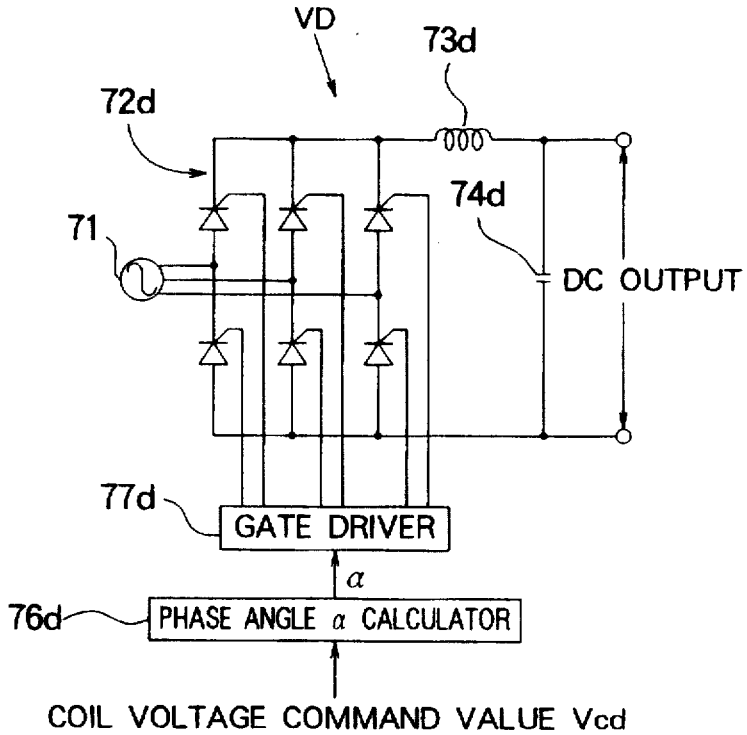
FIG. 60B is a circuit diagram showing an arrangement of a power supply circuit VD shown in FIG. 60A.

FIGS. 60A and 60B show a power supply circuit according to a third aspect of the fifth embodiment. The linear motor used in this aspect is the same as that shown in FIG. 54 or 28. This power supply circuit operates to pass such alternating current to bring about the same linear driving force as the first and the second embodiments through the first group of electric coils CF1*a* to CF1*r* and CL1*a* to CL1*r* of the linear motors 6F and 6L. The power supply circuit provides a DC conduction circuit VD (see FIGS. 60A and 60B) for the second group of electric coils CF2*a* to CF2*r* and CL2*a* to CL2*r*. The circuit VD operates to conduct direct current through the second group of electric coils or shut down the conduction (which is equivalent to zero DC current value). This makes it impossible to apply substantial linear driving force to the molten metal 1 in the second and the fourth spaces. When direct current over zero level is conducted in the electric coils, any braking force is applied for inhibiting the surface flow (see FIG. 61A) caused by ejecting the molten metal from the dipping nozzle 2 in the second and the fourth spaces. The linear driving force caused by the first group of electric coils CF1*a* to CF1*r* and CL1*a* to CL1*r* of the linear motors 6F and 6L is required so that an overpowered difference from the surface flow of the first and the third spaces caused by ejecting the molten metal from the dipping nozzle 2 is made to be substantially same as the speed of the surface flow of the second and the fourth spaces. In the arrangement for conducting direct current over zero, the surface flows in the second and the fourth spaces are made lower in speed. To make the surface flow uniform in speed, it is not required to have a linear driving force as large as that caused by the first group of electric coils CF1*a* to CF1*r* and CL1*a* to CL1*r*. Hence, as shown in FIG. 61B, on the meniscus, the surface flow takes place depending on the magnitude of the electromagnetic force induced by the motor. This surface flow serves to overcome or strengthen the surface flow caused by the ejecting flow shown in FIG. 61A. Finally, it is possible to give rise to a surface flow of the molten metal as keeping a highly uniform speed distribution along the inner wall 31 of the mold shown in FIG. 61C.

The continuous casting apparatus according to each aspect of the fifth embodiment will be discussed in detail.

First Aspect of Fifth Embodiment

FIG. 54 is a section showing the inner wall 31 shown in FIG. 27, which is horizontally cut by the core 12F and 12L of the linear motors 6F and 6L in this figure. The inner wall 31 of the mold includes long sides 10F and 10L opposed to each other and short sides 11R and 11L opposed to each other. Each side is composed of a copper plate 33F, 33L, 35R or 35L and a non-magnetic stainless plate 32F, 32L, 36R or 36L for backing the corresponding copper plate.

According to the first aspect of the fifth embodiment, the core 12F or 12L of the linear motor 6F or 6L is slightly longer than an effective length of the long side 10F or 10L of the mold (the x-axial length with which the molten metal 1 contacts). On the overall length of each core, 18 slots having respective depths (y-axial lengths) are formed at predetermined pitches. T That is, totally, 36 slots are formed. The slots BF1*a* to BF1*r* formed on the core 12F of the linear motor 6F and the slots BL1*a* to BL1*r* formed on the core 12L of the linear motor 6L are deeper than the slots BF2*a* to BF2*r* formed on the core 12F of the linear motor 6F and the slots BF2*a* to BL2*r* formed on the core 12L of the linear motor 6L. In this aspect of the embodiment, the former is twice as deep as the latter, and the former may provide twice as numerous as ampere turns of electric coils inserted to the slots than the latter.

Each slot of the core 12F of the linear motor 6F is equipped with the first group of electric coils CF1*a* to CF1*r* and the second group of electric coils CF2*a* to CF2*r*. Likewise, each slot of the core 12L of the linear motor 6L is equipped with the first group of electric coils CL1*a* to CL1*r* and the second group of electric coils CL2*a* to CL2*r*.

The linear motors 6F and 6L operate to apply thrust indicated by dotted arrows of FIG. 61B to the molten metal 1. The first group of electric coils CF1*a* to CF1*r* and CL1*a* to CL1*r* of the linear motors 6F and 6L are responsible for applying strong thrust to the molten metal 1, while the second group of electric coils CF2*a* to CF2*r* and CL2*a* to CL2*r* are responsible for applying weak thrust to the molten metal 1. By making the slots of the first group deeper than the slots of the second group, therefore, a larger thrust component or a smaller thrust component takes place on the diagonal of the meniscus. This brings about acceleration or offset of a flow speed displacement of the molten metal ejected from the dipping nozzle 2 on the meniscus, thereby giving rise to a uniform flow of the molten metal 1 for stirring it.

Figure 55:
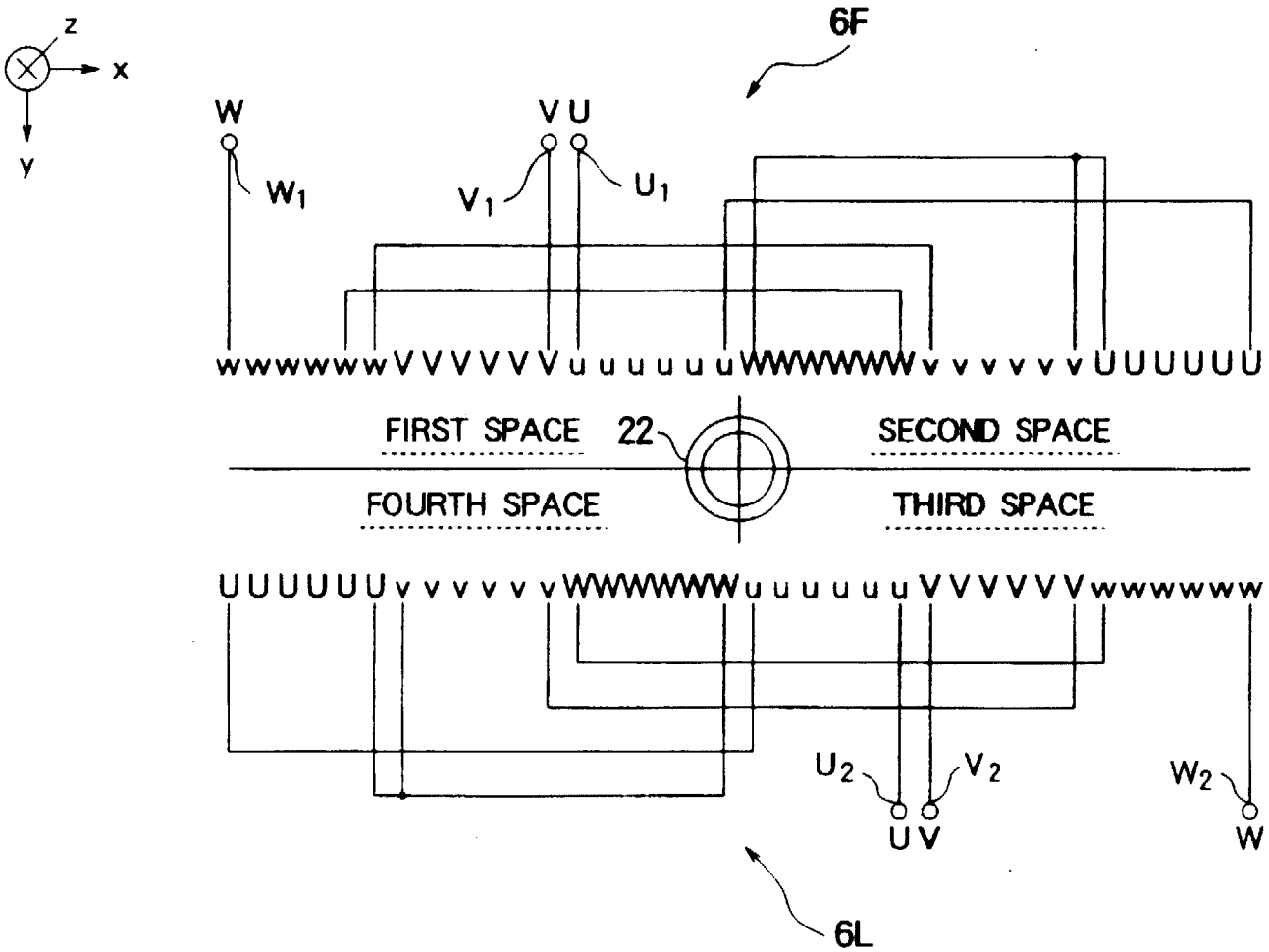
FIG. 55 is a circuit diagram showing wiring connections of electric coils contained in the continuous casting apparatus according to the fifth embodiment of the present invention.

FIG. 55 shows wiring connections of all the electric coils shown in FIG. 54. This wiring connection provides two poles (N=2) so that three-phase current (M=3) is passing through the electric coils. For example, the first group of electric coils CF1*a* to CF1*r* of the linear motor 3F are correspondingly represented as w, w, w, w, w, w, V, V, V,se, V, V, u, u, u, u, u, u. The second group of the electric coils CF2*a* to CF2*r* are correspondingly represented as W, W, W, W, W, W, v, v, v, v, v, v, U, U, U, U, U, U. "U" represents a positive phase conduction of a U phase of three-phase current (straightforward conduction). "u" represents a reverse phase conduction of the U phase (conduction of current whose phase is shifted by 180° from the U phase). The electric coil"U" receives the U phase at its start of the turn, while the electric coil "u" receives the U phase at its end of the turn. Likewise, "V" represents a positive phase conduction of a V phase of three-phase current. "v" represents a reverse phase conduction of the V phase. "W" represents a positive phase conduction of a W phase of three-phase current. "w" represents a reverse phase conduction of the W phase. In FIG. 55, the terminals U1, V1 and W1 are power supply connectors for the first and the second group of electric coils CF1*a* to CF1*r* and CF2*a* to CF2*r* of the linear motor 6F. The terminals U2, V2 and W2 are power supply connectors for the first and second groups of electric coils CLIa to CLIr and CL2*a* to CL2*r* of the linear motor 6L.

As set forth above, the three-phase AC current of 20 Hz is applied to the two-polar linear motors 6F and 6L. These linear motors 6F and 6L operate to apply thrust indicated by dotted arrows of FIG. 61B to the molten metal 1 inside of the inner wall 31 of the mold. ith the applied thrust, the flow of the molten metal 1 is synthesized with the flow of the molten metal ejected from the dipping nozzle 2. The synthesized flow is shown by real arrows of FIG. 61C, that is, circulating flow. The flow of the molten metal 1 produces so small an eddy that powder may not be substantially caught in the eddy. Further, near the inner surface of the long side of the mold, the electromagnetic force on the outer edges of the adjacent eddies are concatenated. The resulting electromagnetic force contains quite small y-axial components and even x-axial components on the overall length of the long side (in the x-axial direction). This electromagnetic force gives rise to flow along the inside wall of the mold as keeping the constant direction (x-axial direction) and the constant speed. The flow makes it possible to evenly wipe out the inner surface of the mold and to prompt the bubbles to float up.

Second Aspect of Fifth Embodiment

FIG. 59 is an expanded cross-section showing the continuous casting apparatus according to the second aspect of the fifth embodiment, in which the cores 12F and 12L are horizontally cut in this figure. The second group of slots (slots BF2*a* to BF2*r* and BL2*a* to BL2*r*) formed on the cores 12F and 12L are not wound around the coil. The other arrangement is the same as that of the first aspect of the fifth embodiment. Since the second group of slots (slots BF2*a* to BF2*r* and BL2*a* to BL2*r*) are not wound around the coil, only the coils (CF1*a* to CF1*r* and CL1*a* to CL1*r*) wound around the first group of slots (slots BF1*a* to BF1*r* and BL1*a* to BL1*r*) operate to generate electromagnetic force in the cores 12F and 12L.

Figure 58:
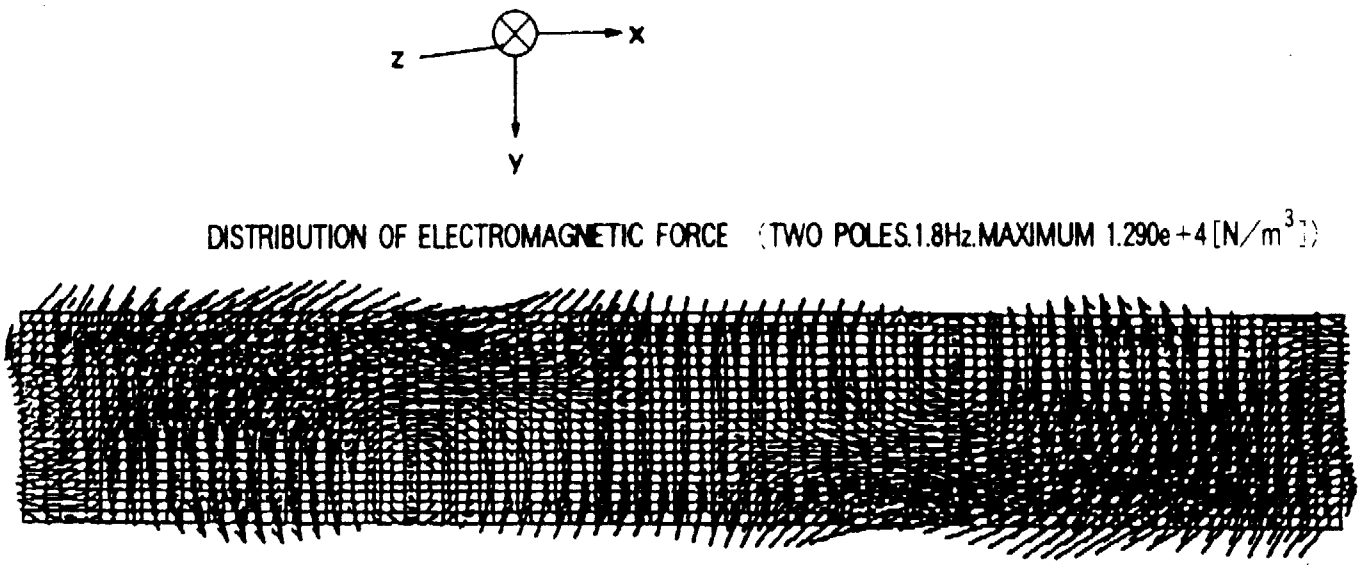
FIG. 58 is a plane view showing a distribution of electromagnetic force caused by two two-pole linear motors having slots according to a second aspect of the fifth embodiment.

The distribution of electromagnetic force to be applied to the surface of the molten metal in the mold is illustrated in FIG. 58. This electromagnetic force generated by the second aspect of the fifth embodiment is substantially the same as the electromagnetic force generated by the first aspect of the fifth embodiment as shown in FIG. 57. The former may give rise to the flow along the inner surface of the mold. Further, this arrangement does not required troublesome operation of winding coil, which leads to reducing the time and the cost in production. Moreover, the x-axial components of the electromagnetic force are made even on the overall (x-axial) long side of the mold. This results in giving rise to flow moving along the inner surface of the mold in the constant direction (x-axial) and at a constant speed, thereby enhancing the preventive effect of catching the powder in the eddy, evenly wiping out the inner surface of the mold and prompting bubbles to float up.

Transformation of Second Aspect of Fifth Embodiment The continuous casting apparatus according to the second aspect of the fifth embodiment does not need a core portion from which the electric coils are removed. Hence, the transformation of the second aspect is arranged so that the cores 12F and 12L of the linear motors 6F and 6L are made to have the same length as the portion around which the first group of electric coils CF1*a* to CF1*r* and CL1*a* to CL1*r* are wound.

Third Aspect of Fifth Embodiment

In the third aspect of the fifth embodiment, the linear motors 6F and 6L shown in FIG. 54 or 28 are connected to the power supply circuits VC and VD as shown in FIG. 60A. That is, like the first and the second aspects of this embodiment, the three-phase AC power supply circuit VC having the same arrangement as the power supply circuit as shown in FIG. 31 operates to apply three-phase alternating current to the first group of the electric coils CF1*a* to CF1*r* and CL1*a* to CL1*r* of the linear motors 6F and 6L. However, the DC power supply circuit VD shown in FIG. 60B operates to pass direct current through the second group of the electric coils CF2*a* to CF2*r* and CL2*a* to CL2*r* or cut off the current passage.

The DC power supply circuit VD shown in FIG. 60B is arranged to exclude the transistor bridge 47A from the power supply circuit shown in FIG. 31 and output a DC voltage of the capacitor 46A without any change. The DC output voltage of the DC power supply circuit VD shown in FIG. 60B is defined by a coil voltage command value Vcd to be applied to a phase angle α calculator 76*d*. If Vcd is at zero level, a gate driver 77*d* does not issue a trigger signal. Hence, a thyristor bridge 72*d* is turned off so that the DC output voltage is made zero. That is, the current passage of the second group of the electric coils CF2*a* to CF2*r* and CL2*a* to CL2*r* is cut off.

As the coil voltage command value Vcd is gradually rising, the gate driver 77*d* operates to issue a trigger signal at a point before a zero cross point of input three-phase alternating current. In response to the trigger signal, the thyristor bridge 72*d* is turned on. With the rise of the coil voltage command value Vcd, the DC output voltage is raised. The direct current flowing through the second group of the electric coils CF2*a* to CF2*r* and CL2*a* to CL2*r* serves to apply braking force to a surface flow 38 (see FIG. 61A) of the molten metal 1 in the second and the fourth spaces. This braking force is made stronger as the DC output voltage of the DC power supply circuit VD is rising. To define the coil voltage command value Vcd for a large DC output voltage, it is possible to reduce an AC current value (corresponding to the linear driving force to be applied to the first and the third spaces) flowing through the first group of the electric coils CF1*a* to CF1*r* and CL1*a* to CL1*r* for unifying the speed distribution of the current indicated by real arrows of FIG. 61C. However, the surface flow lowers its speed. To enhance the speed of the surface flow, the braking force is lowered and the linear driving force. In order to allow such adjustments to be done in each of the first to the fourth spaces, as shown in FIG. 60A, the continuous casting apparatus according to the third aspect of the fifth embodiment provides two pairs of AC power supply circuits VC and two pairs of DC power supply circuits VD. These power supply circuits operate to apply three-phase alternating current to the first group of the electric coils of the linear motors 6F and 6L and direct current to the second group of the electric coils.

Transformation of Third Aspect of Fifth Embodiment

This transformation is arranged to have a pair of AC power supply circuits VC for passing three-phase alternating current through the first group of the electric coils of the linear motors 6F and 6L or a pair of DC power supply circuits VD for passing direct current through the second group of the electric coils of the linear motors 6F and 6L. This transformation does not provide a capability of adjusting each AC current value of the first group of the electric coils of the linear motors 6F and 6L and each DC current value of the second group of the electric coils. However, this transformation has a quite effective construction in that the inside spaces of the mold are located symmetrically with respect to the dipping nozzle 2.

According to the aspects of this embodiment as set forth above, the linear motor provides opposed cores whose slots have respective depths. Hence, the electromagnetic force applied by the linear motor does not substantially include the y-axial component, so that no eddy takes place. That is, only the flow along the inner surface of the mold substantially takes place in the molten metal. Hence, the continuous casting apparatus of this embodiment provides a high effect of preventing powder from being caught in the molten metal. Further, the electromagnetic forces at the outer edges of the adjacent eddies are concatenated. The resulting electromagnetic force contains quite small y-axial components and even x-axial components on the overall long side of the mold (in the x-axial direction). As such, the electromagnetic force gives rise to the flow moving along the inner surface of the mold in the fixed (x-axial) direction and at a constant speed. This flow serves to evenly wipe out the inner surface of the mold and thereby prompt bubbles to float up.

In turn, the description will now be oriented to a continuous casting apparatus according to a sixth embodiment of the present invention.

Figure 62A:
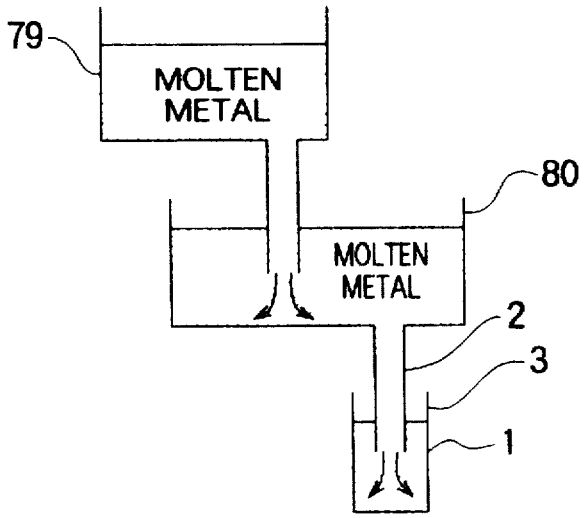
FIG. 62A PRIOR ART
FIG. 62A is a vertical sectional view showing a casting mold 3, a tun dish 80 for feeding molten metal to the casting mold, and a source pot 79 for feeding molten metal to the tun dish 80.
Figure 62B:
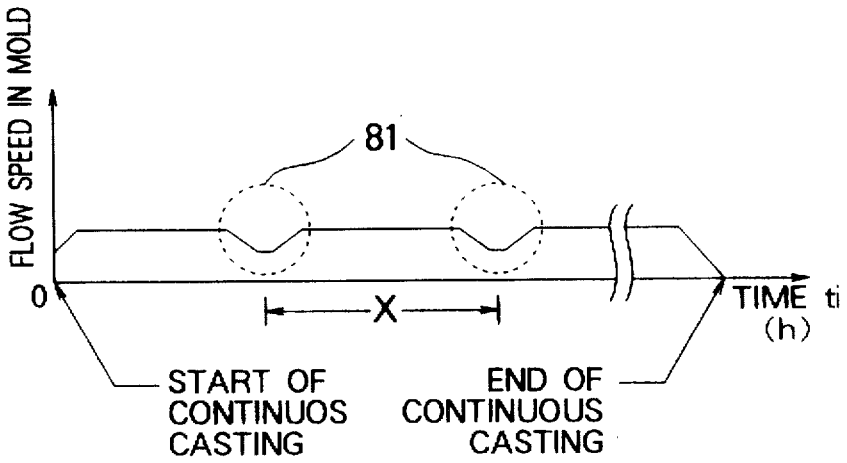
FIG. 62B PRIOR ART
FIG. 62B is a graph showing a change of a flow speed in the mold from the start to the end of the continuous casting with the time.

Conventionally, as shown in FIG. 62A, a molten metal 1 is poured from a source pot 79 to a tun dish 80 and then to a mold 3. In replacing the source pot 79 with a new one, the molten metal in the tun dish 80 temporarily lowers its quality. This causes the pouring pressure of the molten metal 1 from the tun dish 80 to the mold 3 to be varied at an exchange period X of the source pot 79. This variation may vary the casting speed as shown in FIG. 62B, for example. A cast piece produced at the lower casting speed is called a yield Q piece (low-quality material), which is identified as a degraded good or defective. The surface flow of the molten metal caused by the conventional linear motor leads to giving rise to the circulation of the molten metal. The conventional apparatus does not provide a capability of controlling the surface flow to such an extent as to suppress the occurrence of the yield Q piece provided while the pouring pressure is varying.

An object of this embodiment is to provide a flow speed control device which is capable of controlling a surface flow of molten metal according to the current working condition of the tun dish.

The continuous casting apparatus according to this embodiment, as shown in FIGS. 63 to 68, includes a first linear motor 6F including a core 12F and plural electric coils CF1*a*. . . , the magnetic core having plural slots BF1*a*. . . distributed along one side 10F of the mold enclosing the molten metal 1 and those electric coils inserted to the corresponding slots; a second linear motor 6L including a magnetic core 12L and plural electric coils CL1*a*, the magnetic core having plural slots BL1*a*. . . distributed along an opposite side to the side of the mold and those electric coils inserted to the corresponding slots; conducting means CC1 to CC4, 30*a* to 30*d* for conducting electricity through the electric coils of the first and the second linear motors 6F and 6L; flow speed sensing means 91*a* to 91*d*, 98*d* for sensing a flow speed vs1 to vs4 of a surface flow of the molten metal at each location of the surface of the molten metal in the space defined by the mold sides; flow speed converting means 98*c* for converting the sensed flow speed vs1 to vs4 into the corresponding flow speed component Ms, Mp, Ma, Mt to each of the predetermined surface flow speed distribution modes; compensation computing means 98*c* for comparing each of the converted flow speed components Ms, Mp, Ma, Mt to the corresponding target value Mso, Mpo, Mao, Mto of each mode and computing a flow speed component deviation dMs, dMp, dMa, dMt; reverse converting means 98*c* for reversely converting the flow speed component deviation dMs, dMp, dMa, dMt of the surface flow of the molten metal at each of those locations; and conduction control means 98*c* for controlling a current value of the first and the second linear motors 6F and 6L through the conducting means for reducing these flow speeds dv1 to dv4.

The surface flow speed of the molten metal sensed at each location is a vector sum of plural flow speed components directed in the predetermined directions. Hence, each of the surface flow speeds vs1 to vs4 of the molten metal at each sensing location is represented by the combination of plural surface flow speed distribution mode (components). Likewise, the target flow speed distribution is represented by a combination of plural surface flow speed distribution mode (component target values). To change the surface flow speed distribution to the one most approximate one to the working state, it is just necessary to change the combination Mso, Mpo, Mao, Mto of the surface flow speed distribution mode (component target values) into the most approximate combination for achieving the best flow speed distributions vs1 to vs4.

In the continuous casting apparatus according to this embodiment, the flow speed converting means 98c operates to decompose the actual surface flow speed values vs1 to vs4 into the plural surface flow speed distribution mode (component) values Ms, Mp, Ma, Mt. The compensation computing means 98*c* operates to compute deviations dMs, dMp, dMa, dMt of these component values Ms, Mp, Ma, Mt from the target values Mso, Mpo, Mao, Mto. The reverse converting means 98*c* operates to reversely convert these component deviations dMs, dMp, dMa, dMt into the actual flow speed distribution deviations dv1 to dv4. Then, the conduction control means 98*c* operates to control an electromagnetic force to be applied to the molten metal by the linear motor in a manner to reduce these flow speed deviations dv1 to dv4, that is, give such flow speeds as offsetting and compensating these deviations dv1 to dv4 to those surface locations. With this control, the surface flow speed distribution of the molten metal corresponds to the one specified by the combination Mso, Mpo, Mao, Mto of the surface flow speed distribution (component target values) (the actual flow speeds reversely converted from Mso, Mpo, Mao and Mto).

In order to individually adjust or control the surface flow speeds of the molten metal at the locations, the adjusted change of the flow speed at a location is reflected as a disturbance to the flow speed at another side. Though the unique adjustment or control at each location does not lead to a desired flow speed distribution or the adjustment or convergence needs a considerable length of time, the continuous casting apparatus according to this embodiment just needs to change the target values Mso, Mpo, Mao, Mto into those for the desired flow speed distributions for automatically and swiftly achieving the target flow speed distributions. As such, this apparatus enables the flow speed distribution to be easily set, change or adjust. This makes it possible to adequately and timely change the driving pattern and the driving force according to the change of the working conditions. For example, when the speed of pouring the molten metal to the mold is made lower in exchanging the source pot 79, the stirring mode (see 72A) is made stronger for compensating for the drop amount of the surface flow caused by lowering the speed of pouring the molten metal from a nozzle member 2. This compensation prevents occurrence of the yield Q piece or shortens the Q piece in length.

This embodiment will be discussed in more detail below.

Figure 63:
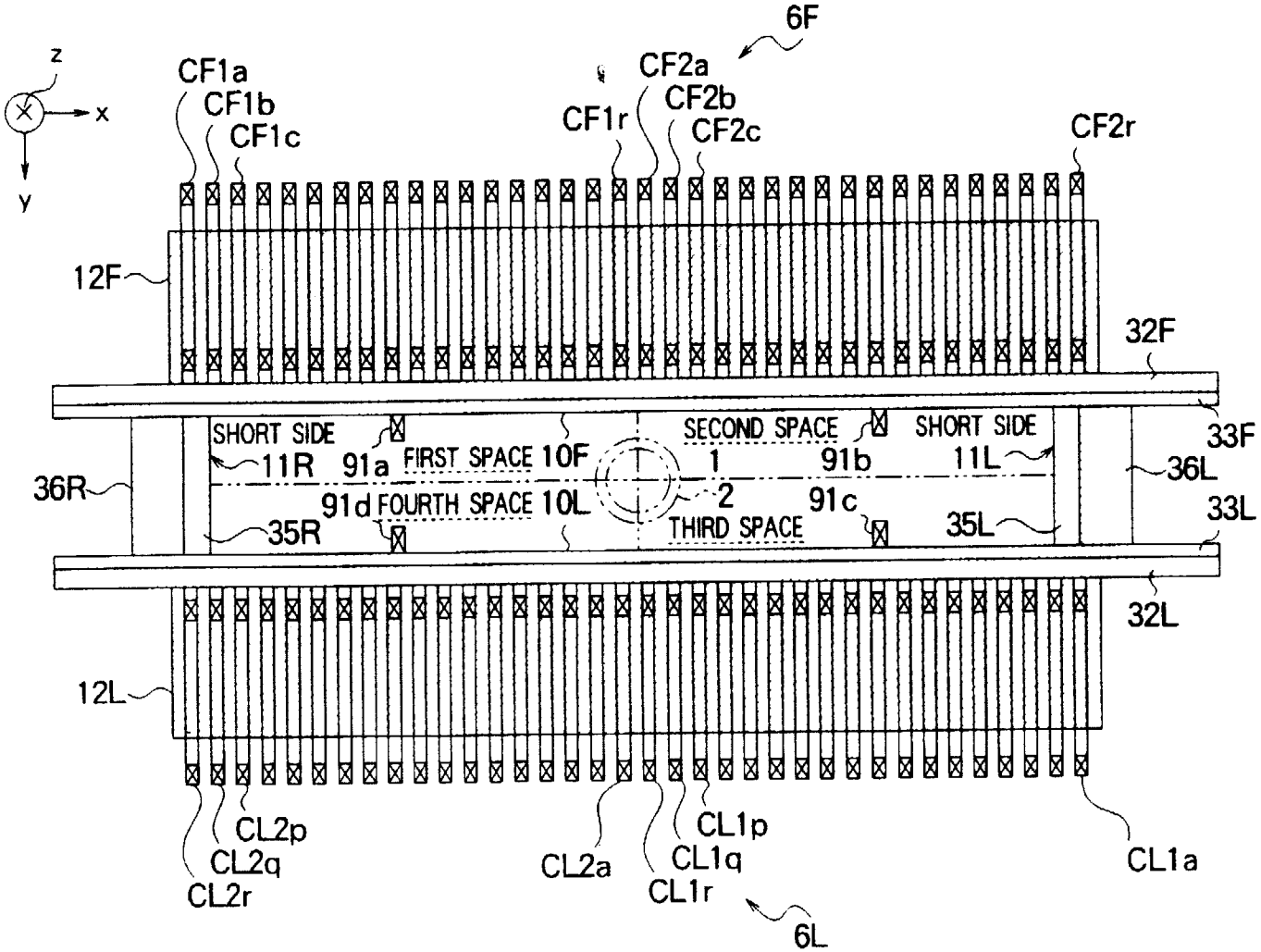
FIG. 63 is an expanded sectional view showing horizontal sections of cores 12F and 12L included in the continuous casting apparatus according to a sixth embodiment of the present invention.

FIG. 63 is a section showing the continuous casting apparatus of this embodiment horizontally cut through an inner wall shown in FIG. 27 and cores 12F and 12L of linear motors 6F and 6L. The inner wall 31 of the mold includes long sides 10F and 10L opposed to each other and short sides 11R and 11L opposed to each other. Each side includes a copper plate 33F, 33L, 35R or 35L and a non-magnetic stainless plate 32F, 32L, 36R or 36L for backing the corresponding copper plate.

In this embodiment, the core 12F or 12L of the linear motor 6F or 6L is slightly longer than an effective length (an x-axial length with which the molten metal 1 contacts). 36 slots are cut along the overall length of the core at predetermined pitches.

Above the molten metal 1, flow speed sensors 91*a* to 91*d* are suspended by a pedestal (not shown). The flow speed is made lower on a necessary timing for measuring a surface flow speed (surface flow speed) of the molten metal 1. Each of the sensors 91*a* to 91*d* is responsible for measuring the flow speed of each of the spaces (first to fourth spaces) divided in the mold.

Figure 64:
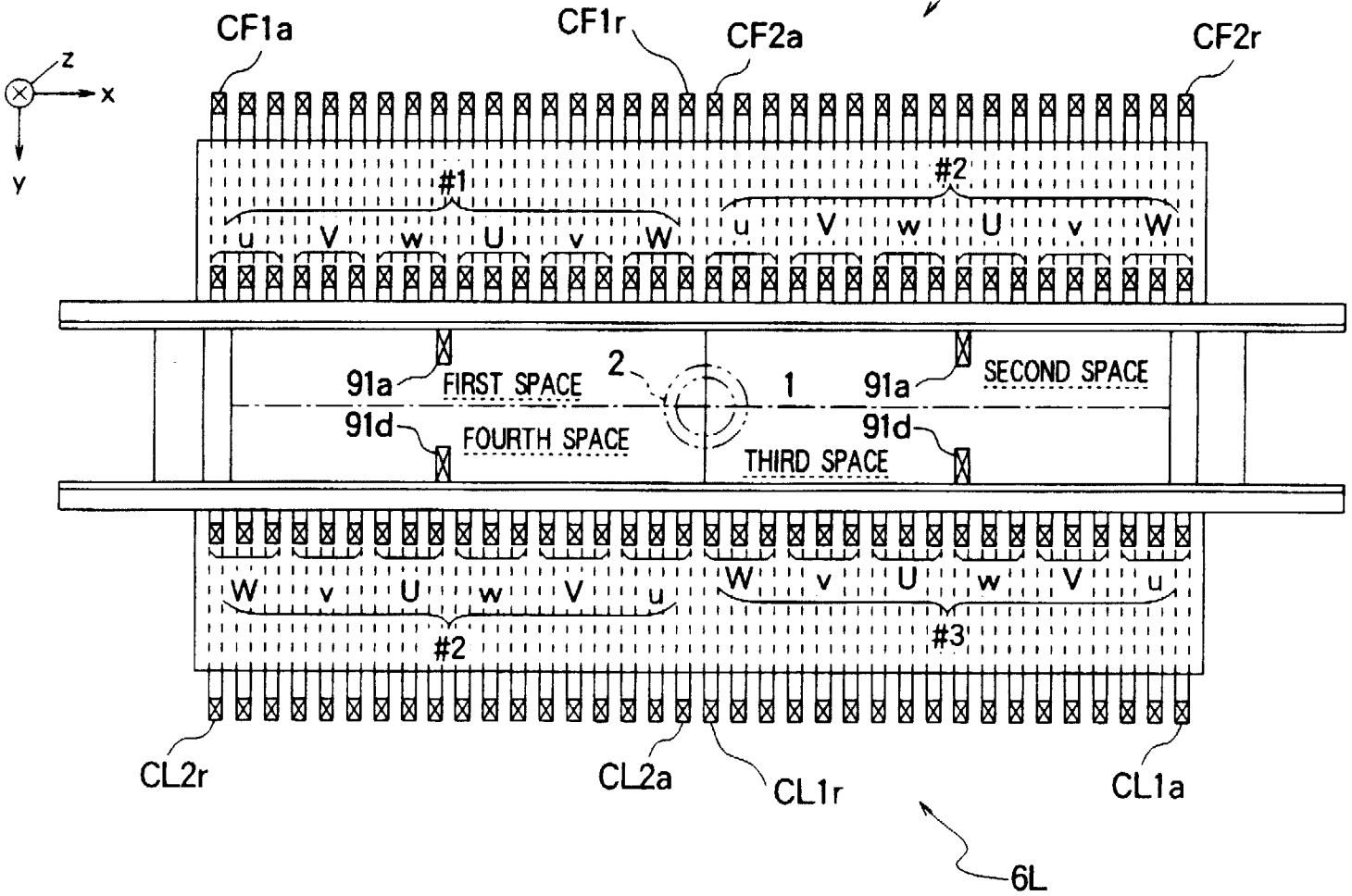
FIG. 64 is a section showing phase divisions and group divisions of electronic coils shown in FIG. 63.
Figure 65:
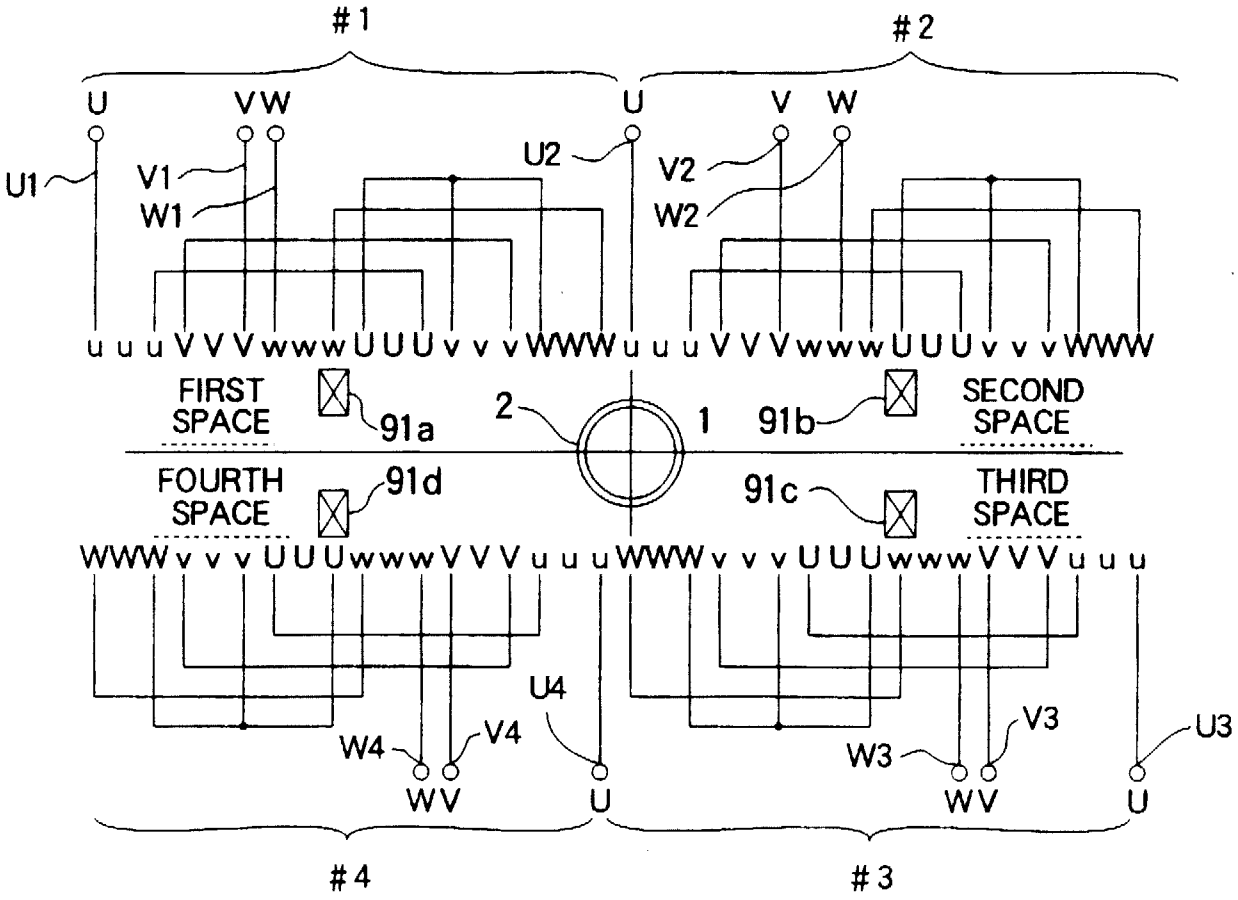
FIG. 65 is a circuit diagram showing wiring connections of electric coils shown in FIG. 63.

FIG. 64 shows a phase section or a group section of the electric coils shown in FIG. 63. FIG. 65 shows wiring connections of all the electric coils shown in FIG. 63. These wiring connections are arranged for four poles (N=4) so as to conduct three-phase current through the electric coils. For example, in FIG. 65, the electric coils (#1: CF1*a* to CF1*r*) and (#2: CF2*a* to CF2*r*) of the #1 and #2 groups of the linear motor 6F are represented in this describing sequence as u, u, u, V, V, V, w, w, w, U, U, U, v, v, v, W, W, W. The electric coils (#3: CL1*a* to CL1*r*) and (#4: CL2*a* to CL2*r*) of #3 and #4 groups are represented in this describing sequence as u, u, u, V, V, V, w, w, w, U, U, U, v, v, v, W, W, W. "U" represents a positive-phase conduction (straightforward conduction) of a U phase of three-phase current. "u" represents a reverse-phase conduction of a U phase (conduction whose shift is shifted by 180from the U phase). The electric coil "U" receives the U phase of the alternating current at its winding start. The electric coil "u" receives the U phase of the alternating current at its winding end. Likewise, "V" represents a positive phase conduction of a V phase of three-phase current. "v" represents a reverse phase conduction of a V phase. "W" represents a positive phase of a W phase. "w" represents a reverse phase of a W phase. The terminals U1, V1, W1, U2, V2, and W2 shown in FIG. 65 are power supply connectors of the #1 and the #2 groups of the electric coils CF1*a* to CF1*r* and CF2*a* to CF2*r* of the linear motor 6F. The terminals U3, V3, W3 and U4, V4, W4 are power supply connectors of the #3 and the #4 groups of the electric coils CL1*a* to CL1*r* and CL2*a* to CL2*r*. Each slot of the core 12F of the linear motor 6F is equipped with each coil of the #1 and the #2 groups of the electric coils CF1*a* to CF1*r* and CF2*a* to CF2*r*. Likewise, each slot of the core 12L is equipped with each coil of the #3 and the #4 groups of the electric coils CL1*a* to CL1*r* and CL2*a* to CL2*r*.

Figure 72A:
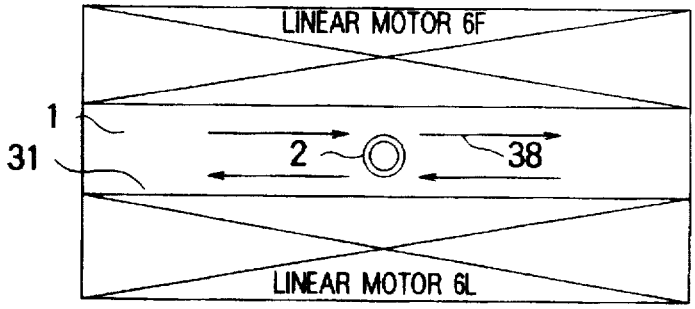

The linear motors 6F and 6L operate to apply to the molten metal 1 the electromagnetic forces in the directions indicated by the arrows of FIG. 72A. As discussed below, these linear motors have a function of applying a braking force to the molten metal 1 if direct current is conducted through the motors.

Figure 71A:
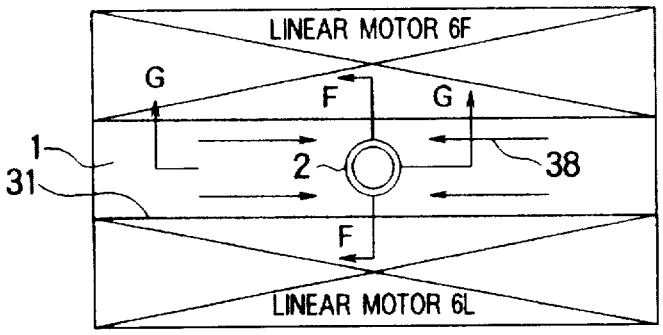
FIG. 71A is a plane view showing a surface flow on a meniscus of the molten metal in a casting mold.
Figure 71B:
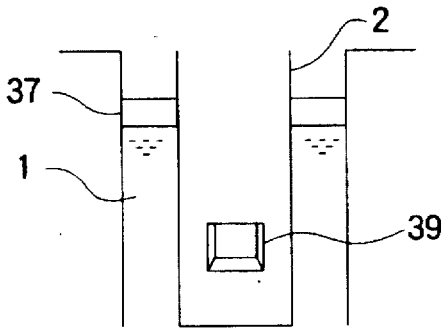
FIG. 71B is an expanded sectional view showing a section cut on the line F—F of FIG. 71A.
Figure 71C:
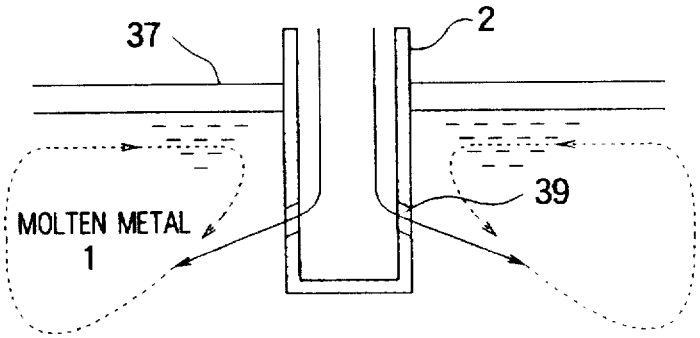
FIG. 71C is an expanded sectional view showing a section cut on the line G—G of FIG. 71A.

The pour of the molten metal from the dipping nozzle 2 to the mold causes the molten metal in the mold to be circulated as shown in FIG. 71C. This leads to surface flow 38 as shown in FIG. 71A. In FIGS. 71C and 71A, the flow of the molten metal is symmetric with respect to the dipping nozzle 2. In actuality, the pour of the molten metal is often asymmetric with respect to the dipping nozzle 2. In this case, the surface flow is asymmetric, accordingly. The preferable stirring form of the surface molten metal is shown in FIG. 72A. Roughly, the linear motors 6F and 6L operate to apply to the molten metal 1 such an electromagnetic force as changing the surface flow shown in FIG. 71A to the surface flow shown in FIG. 72A. However, the surface flow of the molten metal is not limited to the flow shown in FIG. 71A or 72A. To analyze the surface flow of the molten metal, the actual surface flow is identified as a vector sum of a surface flow (component s) of the stirring mode shown in FIG. 72A, a surface flow (component p) of a translational mode shown in FIG. 72B, a surface flow (component a) of an accelerating mode shown in FIG. 72C, and a surface flow (component t) of a twisting mode shown in FIG. 72D. In each mode, each of the surface flow components (indicated by four arrows) is defined to be the same in its absolute value (scalar amount).

(1) Surface Flow at Stirring Mode

In the first and the second spaces, the flows travel along the mold sides in the same directions. In the third and the fourth spaces, the flows travel along the mold sides in the opposite directions to those in the first and the second spaces. In all the spaces, the flows have the same absolute values of speed. In addition, the first to the fourth spaces are indicated in FIG. 63 (see FIG. 72A).

(b) Surface Flow at Translational Mode

Figure 72B:
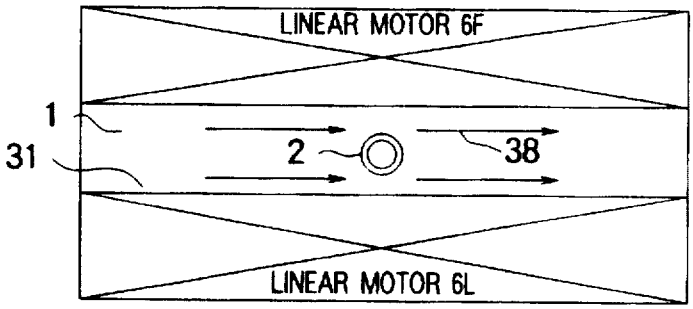

In all the spaces, the surface flows travel along the mold sides in the same direction and at the same flow speed (see FIG. 72B).

(c) Surface Flow at Accelerating Mode

Figure 72C:
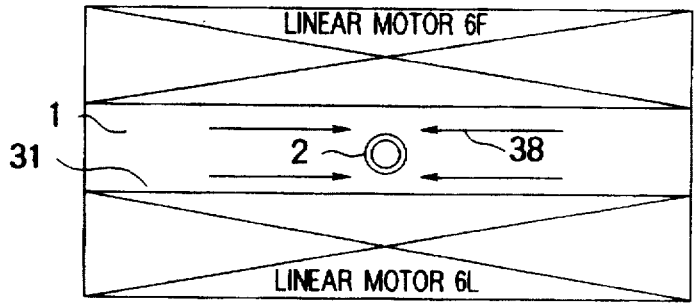
Figure 72D:
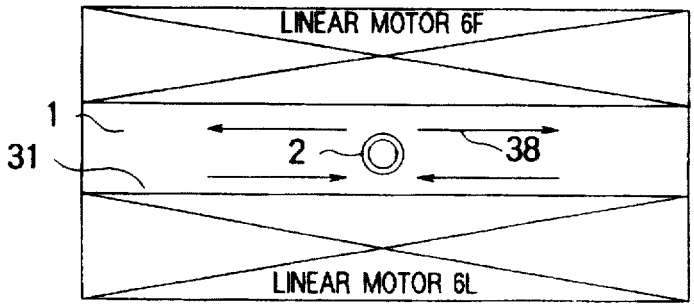

In all the spaces, the surface flows travel along the mold sides toward the nozzle member and at the same flow speed (see FIG. 72C).

(d) Surface Flow at Twisting Mode

In the first and the second spaces, the flows travel along the mold sides and off the nozzle member. In the third and the fourth spaces, the flow travel along the mold sides and toward the nozzle member. In all the spaces, the flows have the same absolute values of speed (see FIG. 72D).

Again, referring to FIG. 63, in this embodiment, the flow speed sensors 91*a* to 91d operate to sense the speeds of the surface flows of the molten metal 1 in the mold 3 in the first to the fourth spaces, respectively. FIGS. 69A, 69B and 70A, 70B show the structure of the flow speed sensor 91*a*.

Figure 69A:
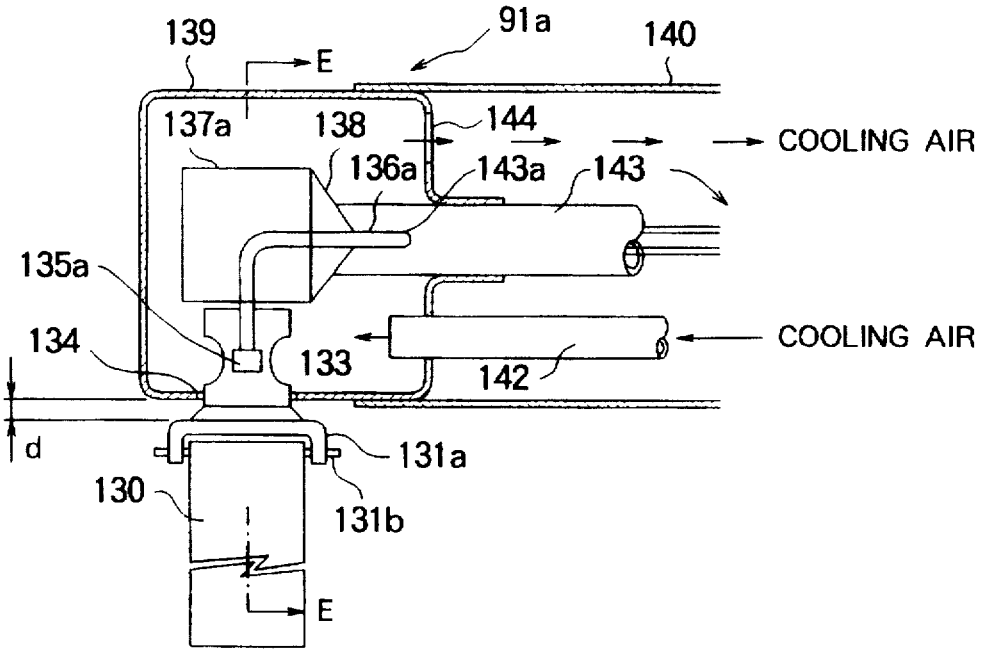
FIG. 69A is an expanded side view showing a flow speed sensor 91*a* shown in FIG. 63 wherein an outer case is cut.
Figure 69B:
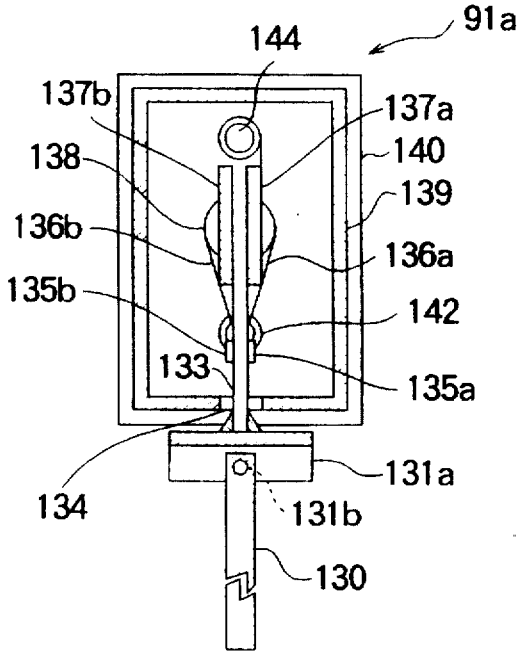
FIG. 69B is a sectional view showing the flow speed sensor 91*a* cut on the line E—E of FIG. 69A.

FIG. 69A is a side view showing a flow speed sensor 91*a* from which its outer cases 139 and 140 are removed. FIG. 69B is a section cut on the line E—E of FIG. 69A. The flow speed sensor 91*a* provides a plate 130 made of molybdenum cermet. The tip of the plate 120 is dipped into the molten metal 1. This plate 130 is rotatively supported on a supporting plate 131*a* through a supporting shaft 131*b*. The supporting plate 131*a* is fixed to a lower end of a leaf 133, the upper end of which is secured to a stationary plate 137*a*. The stationary plate 137*a* is integrated with a hollow tube 143. On the front and the rear of the leaf 133 are pasted distortion gauges 135*a* and 135*b* having a signal line 136*a* connected thereto. The signal line 136*a* passes through the hollow tube 143. The hollow tube 143 is secured to an outer case 139 for protecting the sensor. The outer case 139 has a lower opening 134 through which the leaf 133 is passed. The outer case 139 is inserted to the tip of an outer case 140 serving as a supporting arm. An airflow pipe is provided in the outer case 140 so that the airflow pipe is opened inside. Cooling air is brought into the outer case 139 through the airflow pipe 142. Part of the cooling air goes from the outer case 139 to the outside through the opening 134. The other part of the cooling air enter the outer case 140 from the outer case 139 through the opening 134. The air passes through the inner space of the outer case 140 and then is discharged to the outside from the supporting base (not shown) of the outer case 140.

Figure 70A:
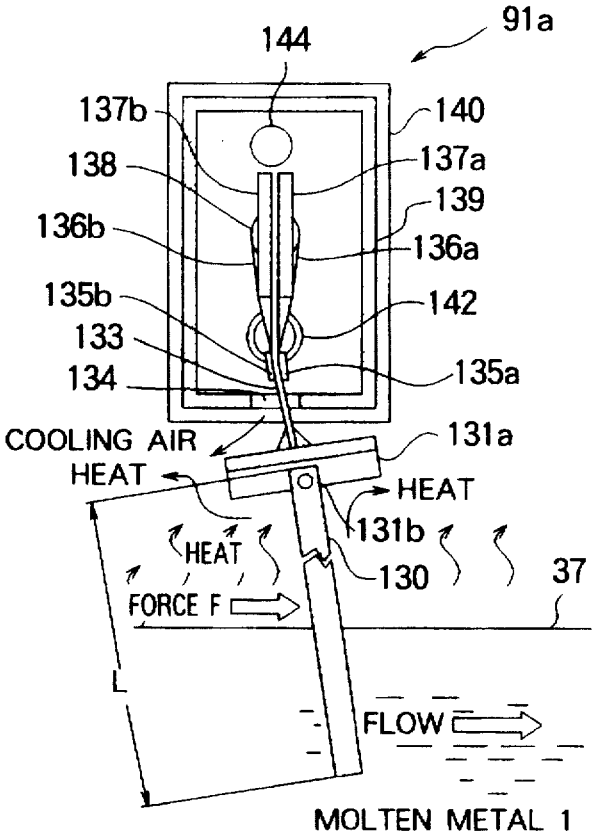
FIG. 70A is a sectional view showing how the flow speed sensor 91*a* shown in FIGS. 69A and 69B is in use.
Figure 70B:
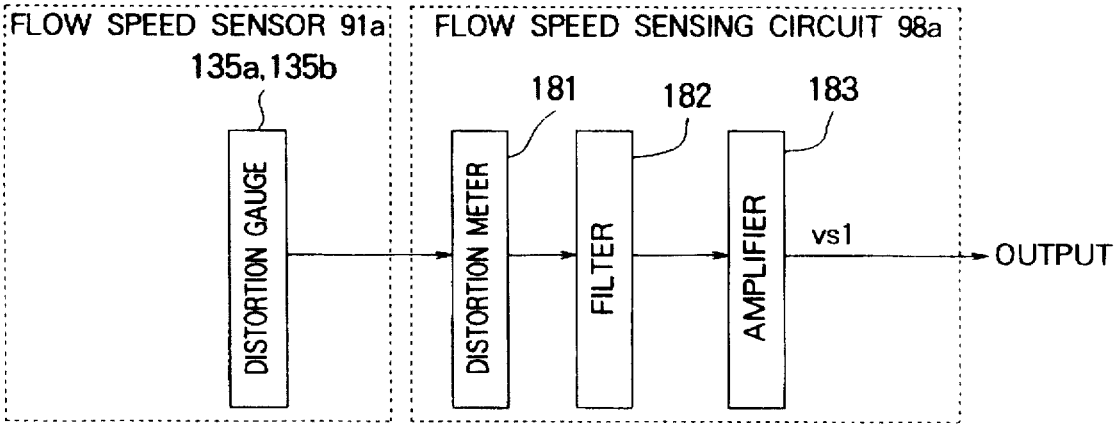
FIG. 70B is a block diagram showing a circuit element, included in the flow speed sensing circuit 98*a* shown in FIG. 66, for generating a flow speed signal from a sensing signal given by the flow speed sensor 91*a;*

When the outer case 140 is lowered to a measuring position, as shown in FIG. 70A, the lower end of the plate 130 is dipped into the molten metal 1 and is presured by the surface flow. This pressure is applied to the leaf 133. The leaf 133 is curved at the distortion gauges 135*a* and 135*b* so that compression stress is applied to one of the distortion gauges 135*a* and 135*b* and tensile stress is applied to the other one. These distortion gauges 135*a* and 135*b* are connected to a dynamic distortion meter 181 for generating a signal representing a difference between the sensing signals of the distortion gauges 135*a* and 135*b*. The difference signal passes through a filter 182 so that only the low-frequency components of the difference signal is supplied to an amplifier 183. The amplifier 183 operates to convert the difference signal into a flow speed signal Vs1 (direction and speed). The flow speed signal Vs1 is applied to an input port of analog-to-digital convertion of a CPU 98*c* (see FIG. 66) through an input interface 98*b* (see FIG. 66).

For example, the flow of the molten metal 1 travels in the direction indicated by an arrow of FIG. 70A. This flow bring about a force F [N] to be applied to the plate 130. Assuming that a resistance coefficient is Cd, a ratio of specific heat of molten metal is ρ, a section area is S, and a flow speed is vs, the force of F is represented by the following expression:

$$F=Cd\times\rho\times vs^2\times S/2g \tag{8}$$

The plate 130 is pressed against the flow of the molten metal 1 by this force F and then is inclined. This force is sensed by the distortion gauge. Assuming that the sensed value of the distortion gauge is ϵ, a value of ϵ is derived as follows:

$$\epsilon=k\times F\times L \tag{9}$$

By substituting the expression (8) for the expression (2), the value of ϵ is derived as follows:

$$\epsilon=k\times Cd\times\rho vs^2\times S/2g\times L \tag{10}$$

From the expression (10), vs can be obtained as follows:

$$vs=\sqrt{\{\epsilon/(k\times Cd\times\rho\times S/2g\times L)\}}$$

The electric circuit from the distortion gauge to the flow speed sensing circuit 98*a* operates to derive the flow speed vs on the principle indicated above. The signal Vs1 representing this flow speed vs is applied to the CPU 98*c*.

The other flow speed sensors 91*b* to 91*d* have the same structure and function as the flow speed sensor 91*a*. Likewise, they are connected to the flow speed sensing circuit 98*a*. Each of these sensors 91*b* to 91*d* operates to apply to the CPU 98*c* a signal representing each of the flow speeds Vs2 to Vs4 (direction and speed) of the surface flow of the second to the fourth spaces.

Figure 66:
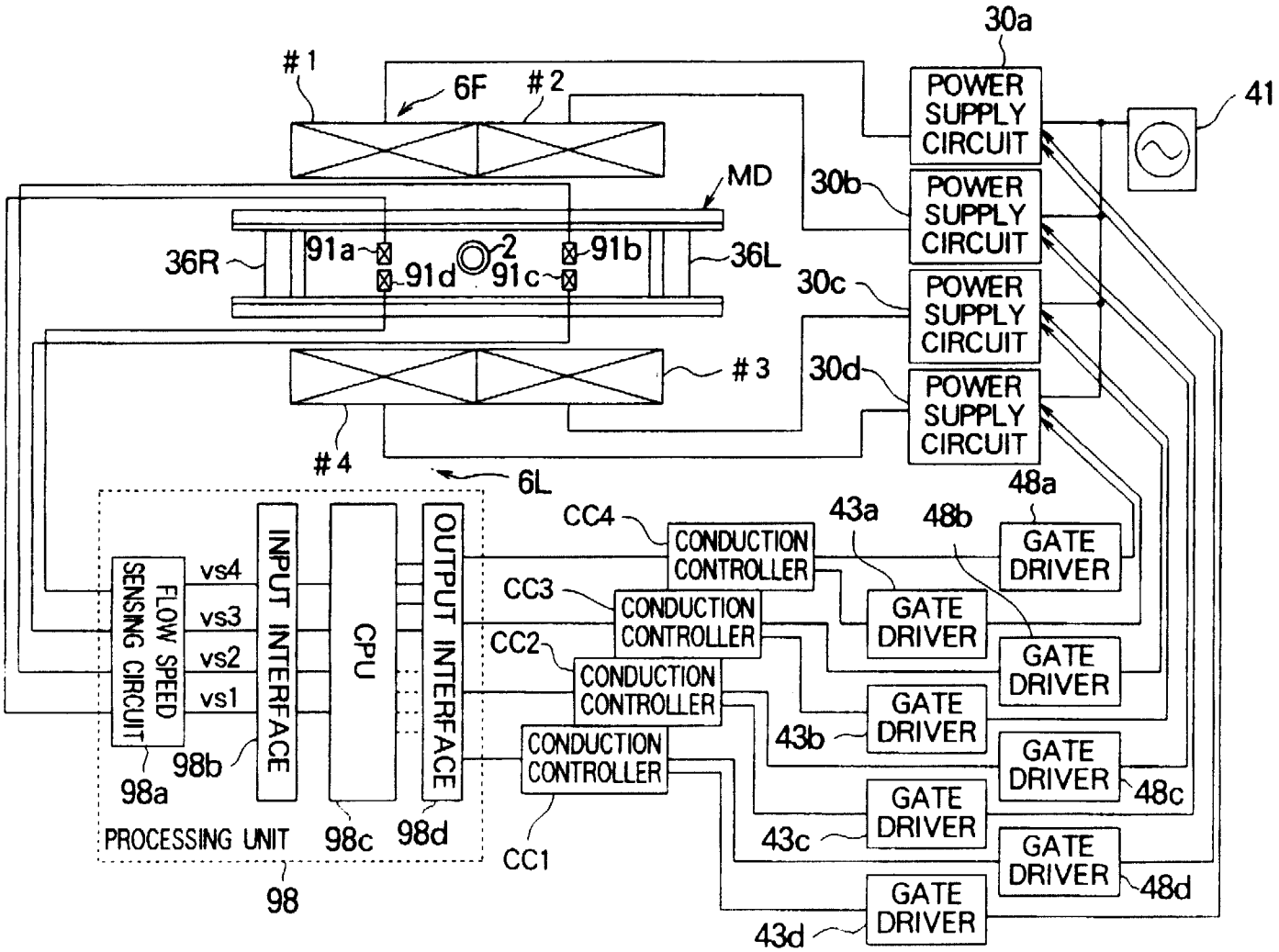
FIG. 66 is a block diagram showing an essential arrangement of a continuous casting apparatus according to the sixth embodiment of the present invention.
Figure 67:
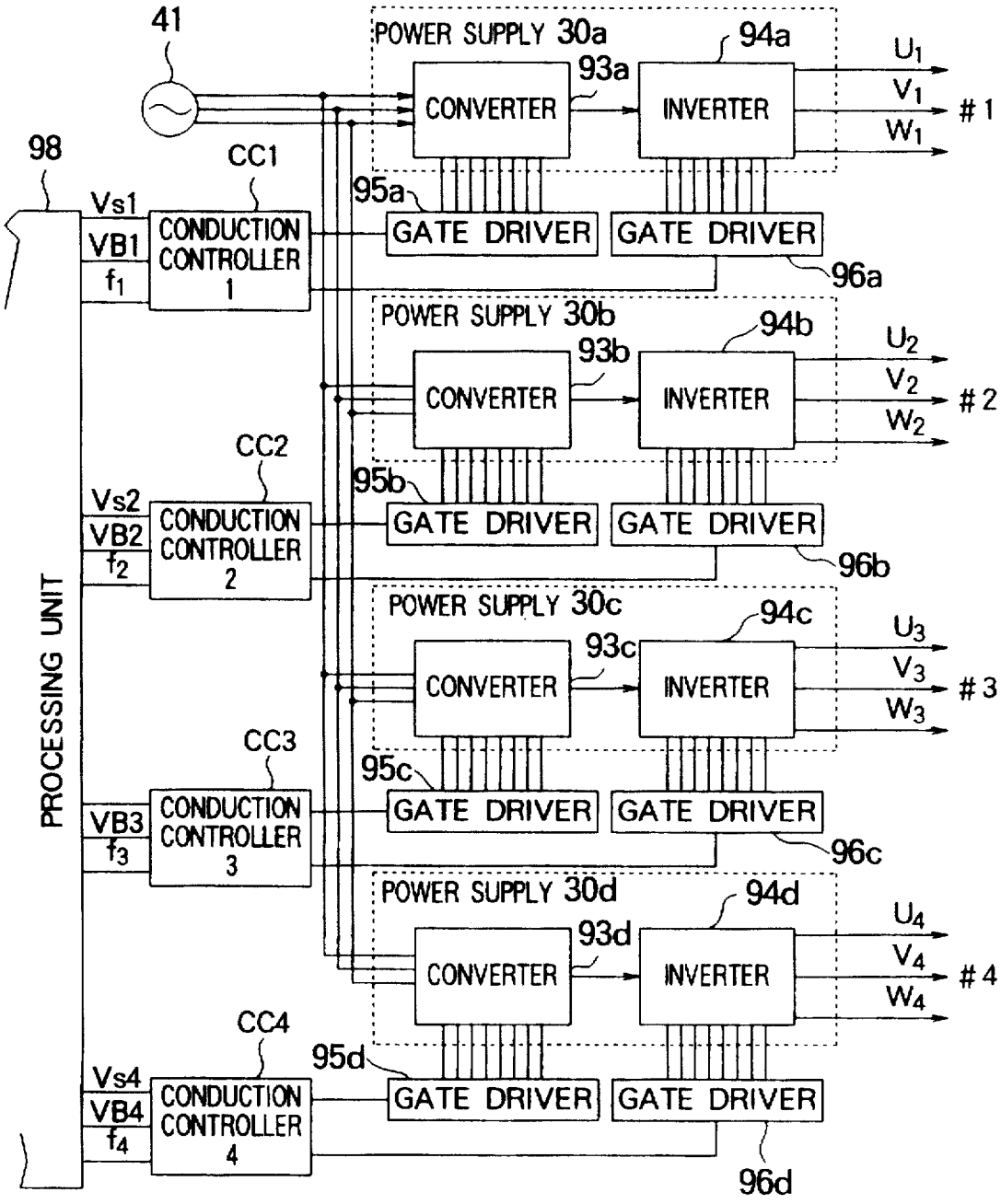
FIG. 67 is a block diagram showing an essential arrangement of a control system for controlling power supply circuits 30*a* to 30*d* shown in FIG. 66.
Figure 68:
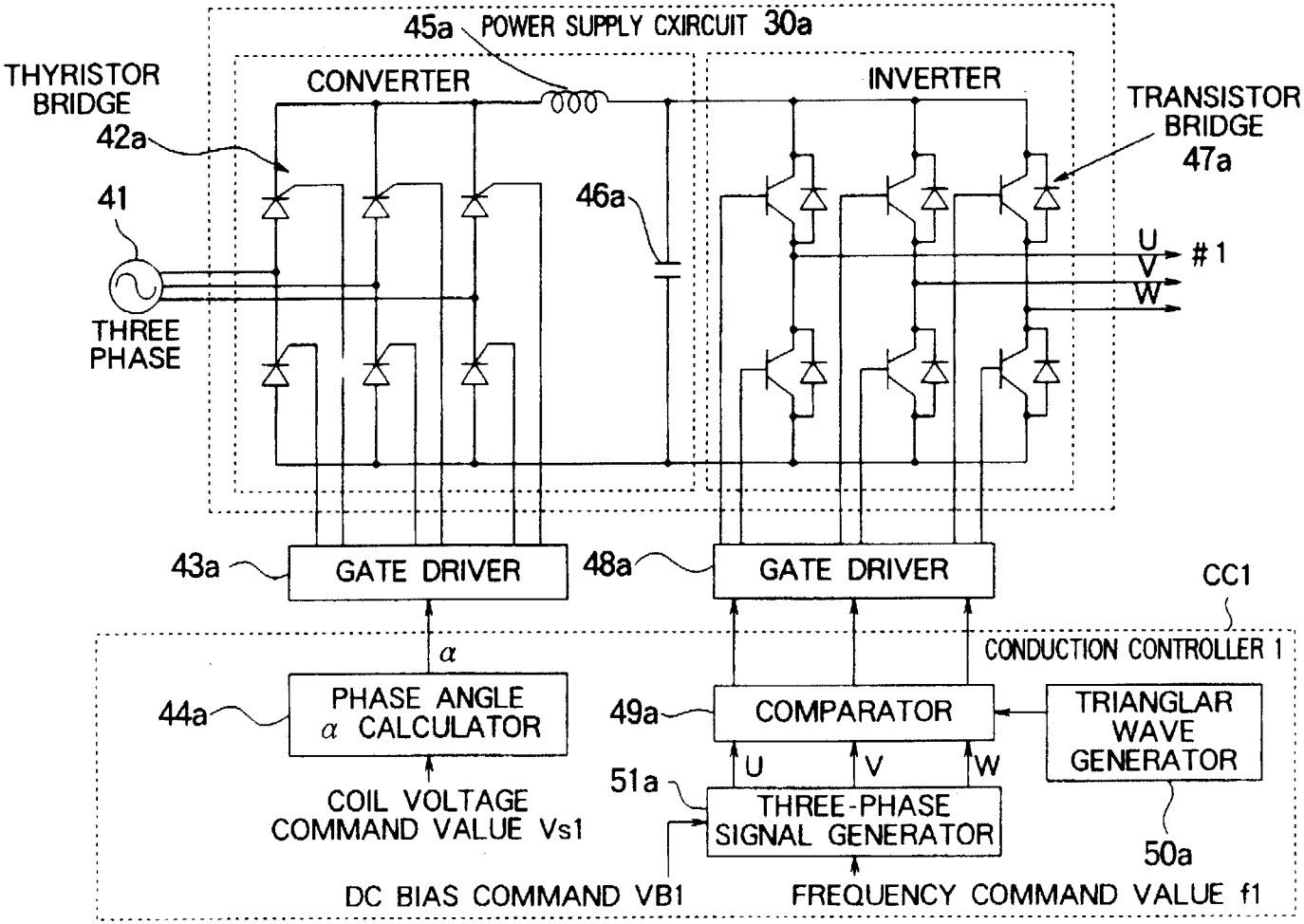
FIG. 68 is a block diagram showing an arrangement of a power supply circuit 92*a* and a conduction controller CC1 shown in FIG. 67.

FIG. 66 shows a general arrangement of an electric circuit for conducting electricity through the electric coils indicated in FIG. 63 (and FIGS. 64 and 65). FIG. 67 shows in detail an electric circuit from a processing unit 98 shown in FIG. 66 to the power supply circuits 92*a* to 92*d*, that is, from the processing unit 98 to the power supply connectors U1, V1, W1, U2, v2, W2, U3, V3, W3, U4, V4, and W4 of the electric coils #1, #2, #3 and #4. FIG. 68 shows the arrangements of the power supply circuit 92*a* and a conduction controller CC1 shown in FIG. 67. Later, the description will be expanded with reference to the drawings.

In this embodiment, the speeds (directions and magnitudes) of the surface flows of the first to the fourth spaces in the mold MD are measured by the flow speed sensors 91*a*, 91*b*, 91*c* and 91*d*, respectively. The sensed speeds are applied to the processing unit 98. Assume that the flow speeds measured by the sensors 91*a* to 91*d* are vs1 to vs4. The measured values vs1 to vs4 are entered into the CPU 98*c* of the processing unit 98 shown in FIG. 66.

The CPU 98*c* operates to decompose a set of measured values vs1 to vs4 into a component value of each mode as shown in FIGS. 72A to 72D, that is, a flow speed of the stirring mode Ms, a flow speed of the translational mode Mp, a flow speed of the accelerating mode Ma, and a flow speed of the twisting mode Mt.

$$\begin{bmatrix} Ms \\ Mp \\ Ma \\ Mt \end{bmatrix} = (1/4)\begin{bmatrix} 1 & 1 & 1 & 1 \\ 1 & 1 & -1 & -1 \\ 1 & -1 & 1 & -1 \\ -1 & 1 & 1 & -1 \end{bmatrix}\begin{bmatrix} Vs1 \\ Vs2 \\ Vs3 \\ Vs4 \end{bmatrix} \tag{11}$$

Then, the deviations are derived between the component values of these modes, Ms, Mp, Ma and Mt and the corresponding target values Mso, Mpo, Mao and Mto preset in the CPU 98*c* as follows.

$$dMs=Mso-Ms,$$

$$dMp=Mpo-Mp,$$

$$dMa=Mao-Ma,$$

$$dMt=Mto-Mt$$

The CPU 98*c* operates to decompose the target flow speed distributions (those four measured values) inputted by an operator from an operating panel (not shown) connected to the CPU 98*c* according to the expression (11) into the target values Mso, Mpo, Mao and Mto in each mode and holds these target values in its register.

The CPU 98*c* then operates to synthesize a set of these deviations, dms, dMp, dMa and dmt for deriving flow speed deviations dv1 to dv4. That is, the component deviation of each mode is reversely converted into the flow speed deviations dv1 to dv4 corresponding to each measured value.

$$\begin{bmatrix} dv1 \\ dv2 \\ dv3 \\ dv4 \end{bmatrix} = \begin{bmatrix} 1 & 1 & 1 & -1 \\ 1 & 1 & -1 & 1 \\ 1 & -1 & 1 & 1 \\ 1 & -1 & -1 & -1 \end{bmatrix}\begin{bmatrix} dMs \\ dMp \\ dMa \\ dMt \end{bmatrix} \tag{12}$$

These flow speed deviations dv1 to dv4 are flow speeds to be compensated by the #1 to #4 groups of electric coils. Next, the CPU 98*c* operates to add each of an integral value of the deviation flow speed from the start of the flow control to this time to the corresponding one of the derived flow speeds dv1 to dv4 (the integral value representing the current driving state of the linear motor, that is, an electromagnetic force applied by the linear motor), save the resulting values Vi1 to Vi4 as new integral values (update the content of the integral value register), derive the output voltages Vs1 to Vs4, the conducting frequencies f1 to f4 and the DC voltages (DC bias) VB1 to VB4 of the power supply circuits 92*a* to 92*d* connected to the #1 to #4 groups of electric coils, and indicate Vs1, f1 and VB1 to the conduction controller CC1 of the power supply circuit 30*a*, Vs2, f2 and VB2 to the conduction controller CC2 of the power supply circuit 30*b*, Vs3, f3 and VB3 to the conduction controller CC3 of the power supply circuit 30*c*, Vs4, and f4 and VB4 to the conduction controller CC4 of the power supply circuit 30*d*.

Further, the CPU 98*c* stores a data map (called table, that is, an area of a memory) in which a voltage Vs, a frequency f and a DC voltage VB are written, the data map being oriented for the integral value. Then, the CPU 98*c* operates to access this data map for reading Vs1, f1 and VB1, Vs2, f2 and VB2, Vs3, f3 and VB3, Vs4, f4 and VB4, which correspond to the integral values Vi1 to Vi4, respectively. Then, these values are outputted to their corresponding conduction controllers. In the data map, the frequency f=0 is given if the integral value is negative (in the reverse direction to the flowing direction of the stirring mode) and as the absolute value of the integral value is made larger, Vs and VB are made higher. When the integral value is positive (in the flow direction of the stirring mode), as the integral value is made larger, f becomes lower, Vs becomes higher, and VB becomes lower.

Figure 73:
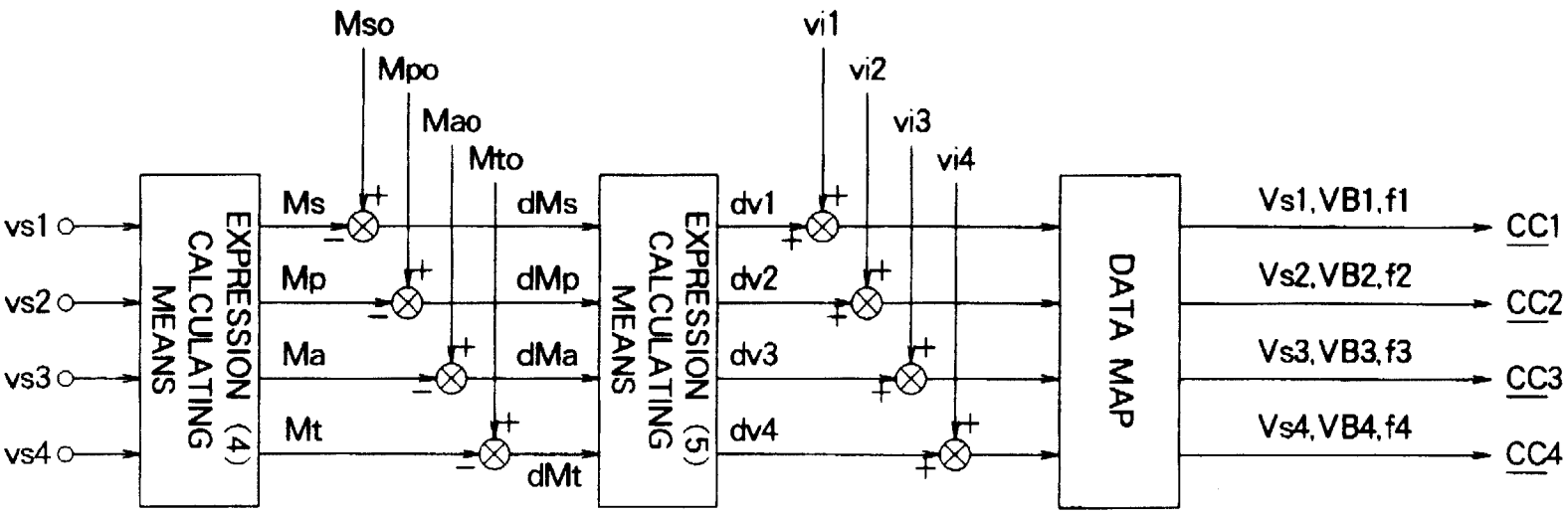
FIG. 73 is a block diagram showing a summary of a part of data processing to be done by a CPU 98*c* shown in FIG. 66.

FIG. 73 shows an operating process, executed by the CPU 98*c*, of generating the command values Vs1 to Vs4, f1 to f4 and VB1 to VB4 from the measured values vs1 to vs4. The CPU 98*c* operates to output the command values Vs1, f1 and VB1 to the conduction controller CC1, the command values Vs2, f2 and VB2 to the conduction controller CC2, the command values Vs3, f3 and VB3 to the conduction controller CC3, and the command values Vs4, f4 and VB4 to the conduction controller CC4 (see FIGS. 6 and 7).

FIG. 68 shows an arrangement of the conduction controller CC1 and the power supply circuit 30 for conducting electricity through the #1 group of electric coils of the linear motor 6F. The three-phase current power supply (three-phase power line) 41 is connected to a thyristor bridge 42*a* for DC rectification, the output (pulsating flow) of which is smoothed by an inductor 45*a* and a capacitor 46*a*. The smoothed direct current is applied to a power transistor bridge 47*a* for forming three-phase current. The power transistor bridge 47*a* operates to apply a U phase of the three-phase current to the power supply connector U1 shown in FIG. 46, a V phase to the power supply connector V1, or a W phase to the power supply connector W1.

The predetermined coil voltage command value Vs1, which is sent to the #1 group of the electric coils CF1*a* to CF1*r* of the linear motor 6F, is applied to a phase angle α calculator 44*a* provided in the conduction controller CC1. The calculator 44*a* operates to derive a conducting phase angle α (thyristor trigger phase angle) and apply a signal representing the angle α to a gate driver 43*a*. The gate driver 43*a* starts to count a phase from the zero-cross point of each phase and triggers the thyristor for the corresponding phase by the phase angle α. With this trigger for conduction, the DC voltage indicated by the command value Vs1 is applied to the transistor bridge 47*a*.

In the conduction controller CC1, on the other hand, a three-phase signal generator 51*a* generates a three-phase current signal to a comparator 49*a*. The three-phase current signal has a constant mountain peak/valley peak voltage (which is zero if f=0), a frequency (0 to 200 Hz in this embodiment) specified by the frequency command value f1 and a DC bias voltage specified by the DC bias command VB1. A triangular wave generator 50*a* operates to apply a constant voltage triangular wave having a constant frequency (high frequency, 3 KHz in this embodiment) to the comparator 49*a*. If the U phase signal is positive, the comparator 49*a* operates to apply to the gate driver 48*a* a high-level signal H (for turning on the transistor) when the U phase signal is higher than the triangular wave applied by the triangular wave generator 50*a* or a low-level signal L (for turning off the transistor) when the U phase signal is lower than or equal to the triangular wave. The signal is applied for a positive period of the U phase (0° to 180°) and for the transistor for outputting the positive voltage of the U phase. If the U phase signal is negative, the comparator 49*a* operates to apply to the gate driver 48*a* a high-level signal H when the U phase signal is lower than or equal to the triangular wave applied by the triangular wave generator 50*a* or a low-level signal L when the former is higher than the latter. The signal is applied for a negative period of the U phase (180° to 360°) and for the transistor for outputting a negative voltage of the U phase. This operation holds true for the V phase signal and the W phase signal. The gate driver 48*a* activates each transistor of the transistor bridge 47*a* to be on or off in response to the signal for a positive or a negative period of each phase.

If f# 0, therefore, the U phase voltage of the three-phase current is applied to the power supply connector U1, the V phase voltage is applied to the power supply connector Vl, and the W phase voltage is applied to the power supply connector WL These voltages are defined by the coil voltage command value Vs1. That is, if f is not equal to zero, the three-phase current voltage having a voltage value specified by the coil voltage command value Vs1, a frequency specified by f1 and a DC bias specified by VB are applied to the #1 group of the electric coils CF1*a* to CF1*r* of the linear motor 6F as shown in FIGS. 63 and 64.

The arrangements and the functions of the conduction controllers CC2 to CC4 and the power supply circuits 30*b* to 30*d* are equivalent to those of CC1 and 20*a*. Like the above operation, these conduction controllers CC2 to CC4 and the power supply circuits 30*b* to 30*d* operate to apply the three-phase current voltage defined by Vs2 to Vs4, f2 to f4 and VB2 to VB4 to the #2 group of the electric coils CF2*a* to CF2*r*, the #3 group of the electric coils CLIa to CL1*r*, and the #4 group of the electric coils.

As set forth above, the continuous casting apparatus of this embodiment operates to apply three-phase current to the linear motors 6F and 6L each with four poles if f is not equal to zero. In response, the linear motors 6F and 6L apply the corresponding thrust to the integral values Vi1 to Vi4 to the molten metal 1 inside of the mold 31. If f is equal to zero, those motors apply a braking force to the molten metal 1. The flow of the molten metal 1 poured from the dipping nozzle 2 is converged to a target flow speed distribution specified by an operator. Hence, if the pouring speed of the molten metal from the dipping nozzle 2 is varied by the change of the working condition of the tun dish, the resulting surface flow of the molten metal moves at a speed closing towards the target flow speed distribution specified by the operator.

To adjust or control a flow speed of each portion of the surface layer of the molten metal, the change of the flow speed caused by the adjustment of the flow speed at a portion of the molten metal is reflected as a disturbance to the flow speed at another portion of the molten metal. Hence, the unique adjustment or control of the flow speed at each portion brings about the following problems: this kind of adjustment does not provide a desired flow speed distribution and needs a considerable length of time for the adjustment itself or the convergence. On the other hand, the continuous casting apparatus according to this embodiment provides a capability of automatically and swiftly achieving a target flow speed distribution merely by changing the target values Mso, Mpo, Mao, Mto to the values corresponding to a desired flow speed distribution. Hence, this continuous casting apparatus operates to easily set, change and adjust the flow speed distribution. For example, while the molten metal is poured to the mold at a lower speed in exchanging the source pot 79, the stirring mode (see FIG. 72A) is made stronger to compensating for a surface flow drop caused by lowering the speed of pouring the molten metal from the dipping nozzle. This makes it possible to prevent the occurrence of a yield Q piece or shorten a Q piece length. That is, the continuous casting method and apparatus of this embodiment enable a driving pattern and/or driving force to change according to the change of the working conditions.

As set forth above, the continuous casting method and apparatus according to the present invention is effective in producing a metal slab with no surface defect, such as a vertical crack, in the case of the continuous casting of the metal slab made of steel or the like.

We claim:

1. A continuous casting method for casting a metal slab, comprising the steps of:

pouring molten metal into a mold from a dipping nozzle provided in a center of a horizontal plane of said mold;

generating electromagnetic force along two long sides of said mold by using at least two electromagnetic stirring coil parts provided along said two long mold sides, said electromagnetic force being directed opposite to each other between said two long sides, and a component of said electromagnetic force directed from said dipping nozzle to a short side of said mold being different from a component of said electromagnetic force directed from said short mold side to said dipping nozzle so as to keep substantially uniform surface flow of said molten metal in said mold; and pulling out coagulated metal while cooling down a part of said mold.

2. A method according to claim 1, wherein in said step of generating the electromagnetic force, the component of said electromagnetic force directed from said dipping nozzle to said short mold side is larger than the component of said electromagnetic force directed from said short mold side to said dipping nozzle.

3. A method according to claim 1, wherein:

each of said electromagnetic stirring coil parts is divided into two parts; and in said step of generating the electromagnetic force, a combination of two of the four divided parts is connected to a different power supply circuit from another combination of the other two of said four divided parts.

4. A method according to claim 2, wherein:

each of said electromagnetic stirring coil parts is divided into two parts; and in said step of generating the electromagnetic force, a combination of two of the four divided parts is connected to a different power supply circuit from another combination of the other two of said four divided parts.

5. A method according to claim 1, wherein:

each of said electromagnetic stirring coil parts is divided into two parts; and in said step of generating the electromagnetic force, the four divided parts of said two electromagnetic stirring coil parts are connected to different power supply circuits from each other.

6. A method according to claim 2, wherein:

each of said electromagnetic stirring coil parts is divided into two parts; and in said step of generating the electromagnetic force, the four divided parts of said two electromagnetic stirring coil parts are connected to different power supply circuits from each other.

7. A continuous casting apparatus for continuously casting a metal slab by cooling down a part of a mold and pulling out coagulated metal while pouring molten metal to said mold from a dipping nozzle provided in a center of a horizontal plane of said mold, said apparatus comprising:

two electromagnetic stirring coil parts, provided along two long mold sides respectively, for controlling flow of said molten metal in said mold through effect of electromagnetic force, said two electromagnetic stirring coil parts including plural magnetic cores ranged along said two long mold sides and plural coils wound therearound;

at least one power supply circuit for generating a two or more phase alternating current having a predetermined frequency; and connecting means for connecting said two electromagnetic stirring coil parts with said at least one power supply circuit so that said plural coils and said connecting means constitute two circuits for said two long mold sides and each of said two circuits are divided into two circuit parts which have different impedances, said electromagnetic force being directed opposite to each other between said two long mold sides, and a component of said electromagnetic force directed from said dipping nozzle to a short side of said mold being different from a component of said electromagnetic force directed from said short mold side to said dipping nozzle.

8. An apparatus according to claim 7, wherein said connecting means connects said two electromagnetic stirring coil parts with said at least one power supply circuit so that the two divided circuit parts are connected in parallel.

9. An apparatus according to claim 8, wherein said coils included in one of the two divided circuit parts are Y-connected while said coils included in the other of the two divided circuit parts are Δ-connected.

10. An apparatus according to claim 8, wherein said plural coils included in said two divided circuit parts are connected in series and said two divided circuit parts have different numbers of said coils from each other.

11. An apparatus according to claim 8, wherein said coils included in one of said two divided circuit parts are connected in series and said coils included in the other of said two divided circuit parts are connected in parallel.

12. An apparatus according to claim 7, wherein:

said at least one power supply circuit includes two power supply circuits; and a combination of two of the four divided circuit parts is connected to a different power supply circuit from another combination of the other two of said four divided circuit parts.

13. An apparatus according to claim 7, wherein:

said at least one power supply circuit includes four power supply circuits; and the four divided circuit parts are connected to different power supply circuits from each other.

14. An apparatus according to claim 7, wherein each of said magnetic cores included in said electromagnetic stirring coil parts has five poles.

15. An apparatus according to claim 7, wherein said predetermined frequency is at least 4 kz.

16. An apparatus according to claim 14, wherein said predetermined frequency is at least 4 Hz.

17. An apparatus according to claim 14, wherein each of said electromagnetic stirring coil parts generate a magnetic field having a magnitude of at least 1200 At/cm.

18. An apparatus according to claim 7, wherein said at least one power supply circuit includes means for overlapping direct current for applying a braking force to said molten metal with said two or more phase alternating current, and said apparatus further comprising:

means for sensing a temperature distribution of said mold; and control means for controlling said at least one power supply circuit so that a larger braking force is applied to a part of said molten metal located near a high-temperature portion of said mold than a part of said molten metal located near a low-temperature portion of said mold on the basis of outputs from said temperature sensing means.

19. An apparatus according to claim 18, wherein:

said temperature sensing means includes temperature sensors for sensing temperatures of two short mold sides respectively; and said control means controls said at least one power supply circuit so that a larger direct current is conducted through said circuit part closer to a high-temperature short side than through said circuit part closer to a low-temperature short side in a manner corresponding to a temperature difference between said two short mold sides.

20. An apparatus according to claim 19, wherein:

said temperature sensor includes plural temperature sensing elements distributed in a direction of pulling out said coagulated metal; and said control means selects the highest temperature among temperatures sensed by said temperature sensing elements as a representative temperature of each side of said mold.

21. An apparatus according to claim 18, wherein:

said temperature sensing means includes two temperature sensors for sensing temperatures of two long mold sides; and said control means controls said at least one power supply circuit so that larger direct current is applied to said circuit part located close to a high-temperature long side than said circuit part located close to a low-temperature long side.

22. An apparatus according to claim 3, further comprising:

temperature sensing means for sensing a temperature distribution of said mold; and control means for controlling said at least one power supply-circuit so that a greater driving force is applied to a portion of said molten metal located close to a low-temperature portion of said mold than a portion of said molten metal located close to a high-temperature portion of said mold in response to outputs of said temperature sensing means.

23. An apparatus according to claim 22, wherein:

said temperature sensing means includes two temperature sensors for sensing temperatures of two short mold sides respectively; and said control means controls said at least one power supply circuit so that a larger two or more phase alternating current is conducted through said circuit part located close to a low-temperature short side than said circuit part located close to a high-temperature short side in a manner corresponding to a temperature difference between said two short mold sides.

24. An apparatus according to claim 23, wherein:

said temperature sensor contains plural temperature sensor elements distributed in the direction of pulling out said coagulated metal; and said control means selects the highest temperature among temperatures sensed by said temperature sensing elements as a representative temperature of each side of said mold.

25. An apparatus according to claim 22, wherein:

said temperature sensing means contains two temperature sensors for sensing temperatures of two long mold sides respectively; and said control means controls said at least one power supply circuit so that a larger two or more phase alternating current is conducted through said circuit part located close to a low-temperature long side of said mold than through said circuit part located close to a high-temperature long side in a manner corresponding to a temperature difference between said two long mold sides.

26. A continuous casting apparatus for continuously casting a metal slab by cooling down a part of a mold and pulling out coagulated metal while pouring molten metal to said mold from a dipping nozzle provided in a center of a horizontal plane of said mold, said apparatus comprising:

two electromagnetic stirring coil parts, provided along two long mold sides respectively, for controlling flow of said molten metal in said mold through effect of electromagnetic force, said two electromagnetic stirring coil parts having plural magnetic cores ranged along said two long mold sides and plural coils wound around at least a part of said magnetic cores; and conducting means for feeding electricity to said two electromagnetic stirring coil parts;

wherein a space inside and outside of said mold is virtually divided into first, second, third and fourth spaces by a plane passing through a center of said dipping nozzle and in parallel to said two long mold sides and a plane passing through the center of said dipping nozzle and perpendicular to said two long mold sides, said third space being symmetric to said first space with respect to the center of said dipping nozzle and said fourth space being symmetric to said second space with respect to the center of said dipping nozzle, said magnetic cores staying in said first and third spaces are longer than those staying in said second and fourth spaces.

27. A continuous casting apparatus for continuously casting a metal slab by cooling down a part of a mold and pulling out coagulated metal while pouring molten metal to said mold from a dipping nozzle provided in a center of a horizontal plane of said mold, said apparatus comprising:

two electromagnetic stirring coil parts, provided along two mold sides respectively, for controlling flow of said molten metal in said mold through effect of electromagnetic force, said two electromagnetic stirring coil parts having plural magnetic cores ranged along said two long mold sides and plural coils wound around at least a part of said magnetic cores; and conducting means for feeding electricity to said two electromagnetic stirring coil parts;

wherein a space inside and outside of said mold is virtually divided into first, second, third and fourth spaces by a first plane passing through a center of said dipping nozzle and parallel to said two long mold sides and by a second plane passing through the center of said dipping nozzle and perpendicular to said two long mold sides, said third space being symmetric to and diagonal from said first space with respect to the center of said dipping nozzle and said fourth space being symmetric to and diagonal from said second space with respect to the center of said dipping nozzle, one of said two long mold sides being located in said first and second spaces and the other of said two long mold sides being located in said third and fourth spaces, one of said two electromagnetic stirring coil parts has said coils only in said first space with said core extending substantially into said second space and the other of said two electromagnetic stirring coil parts has said coils only in said third space with said core extending substantially into said fourth space.

28. An apparatus according to claim 27, wherein:

one of said electromagnetic stirring coil parts has a length for applying electromagnetic force only to said molten metal staying in said first space; and the other of said electromagnetic stirring coil parts has a length for applying electromagnetic force only to said molten metal staying in said third space.

29. A continuous casting apparatus for continuously casting a metal slab by cooling down a part of a mold and pulling out coagulated metal while pouring molten metal to said mold from a dipping nozzle provided in a center of a horizontal plane of said mold, said apparatus comprising:

two electromagnetic stirring coil parts, provided along two long mold sides respectively, for controlling flow of said molten metal in said mold through effect of electromagnetic force, said two electromagnetic stirring coil parts having plural magnetic cores ranged along said two long mold sides and plural coils wound therearound;

wherein space inside and outside of said mold is virtually divided into the first, the second, the third and the fourth spaces by a plane passing through a center of said dipping nozzle and in parallel to said two long mold sides and a plane passing through the center of said dipping nozzle and perpendicular to said two long mold sides, said third space is symmetric to said first space with respect to the center of said dipping nozzle, and said fourth space is symmetric to said second space with respect to the center of said dipping nozzle, conducting means for conducting alternating current through said coils located in a first space and a third space to drive said molten metal along mold sides; and circuit for conducting direct current through said coils located in a second space and a fourth space and cutting off conduction of said alternating current through said coils located in said second and fourth spaced.

30. A continuous casting apparatus for continuously casting a metal slab by cooling down a part of a mold and pulling out coagulated metal while pouring molten metal to said mold from a dipping nozzle provided in a center of a horizontal plane of said mold, said apparatus comprising:

two electromagnetic stirring coil parts, provided along two long mold sides respectively, for controlling flow of said molten metal in said mold through effect of electromagnetic force, said two electromagnetic stirring coil parts having plural magnetic cores ranged along said two mold sides and plural coils wound therearound;

conducting means for feeding electricity to said two electromagnetic stirring coil parts;

flow speed sensing means for sensing surface flow speed of said molten metal at plural locations of a surface of said molten metal in said mold;

flow speed converting means for converting said sensed flow speed into flow speed components in each of predetermined surface flow speed distribution modes;

compensation calculating means for comparing said converted flow speed components with target values in each of surface flow speed distribution modes to calculate flow speed component deviations;

reverse converting means for reversely converting said flow speed component deviations into flow speed deviations of the surface of said molten metal at said plural locations; and control means for controlling said conducting means to reduce these flow speed deviations.

31. An apparatus according to claim 30, further comprising:

plural flow speed sensors for sensing surface flow speed of said molten metal in first, second, third and fourth spaces, wherein space inside and outside of said mold is virtually divided into the first, the second, the third and the fourth spaces by a plane passing through a center of said dipping nozzle and in parallel to said two long mold sides and a plane passing through the center of said dipping nozzle and perpendicular to said two long mold sides, said third space being symmetric to said first space with respect to the center of said dipping nozzle, said fourth space being symmetric to said second space with respect to the center of said dipping nozzle, one of said two long mold sides being located in said first and second spaces, and the other of said two long sides being located in said third and fourth spaces;

said plural surface flow speed distribution modes including:

a stirring mode having flow speed components of a first direction along said mold sides in said first and second spaces and flow speed components of a second direction opposite to the first direction along said mold sides in said third and fourth spaces wherein absolute values of said flow speed components are substantially equal to each other in all the spaces;

a translational mode having flow speed components along said mold side and of the same direction and the same magnitude in all the spaces;

an accelerating mode having flow speed components along said mold side and of a direction for said dipping nozzle and the same magnitude in all the spaces; and a twisting mode having flow speed components along said mold side and of a direction of keeping off said dipping nozzle in said first and second spaces and flow speed components along said mold side and of a direction for said dipping nozzle in said third and fourth spaces wherein absolute values of flow speed components are substantially equal to each other in all the spaces; and said conducting means having a first to a fourth power supply circuits for conducting electricity through totally four parts of said two electromagnetic stirring coil parts existing in said first to fourth spaces, respectively.

32. An apparatus according to claim 30, wherein said conducting means includes a power supply circuit adjustable of an output current level.

33. An apparatus according to claim 31, wherein said conducting means includes a power supply circuit adjustable of an output current level.

34. An apparatus according to claim 30, wherein said conducting means includes a power supply circuit for adjustable of an output current frequency.

35. An apparatus according to claim 31, wherein said conducting means includes a power supply circuit for adjustable of an output current frequency.

36. An apparatus according to claim 30, wherein said conducting means includes a power supply circuit for adjustable of a DC component of output current.

37. An apparatus according to claim 31, wherein said conducting means includes a power supply circuit for adjustable of a DC component of output current.

* * * * *